US006986698B1

(12) United States Patent
Molnar

(10) Patent No.: US 6,986,698 B1
(45) Date of Patent: Jan. 17, 2006

(54) WAFER REFINING

(75) Inventor: Charles J. Molnar, Wilmington, DE (US)

(73) Assignee: Beaver Creek Concepts Inc, Wilmington, DE (US)

( * ) Notice: Subject to any disclaimer, the term of this patent is extended or adjusted under 35 U.S.C. 154(b) by 114 days.

(21) Appl. No.: 10/251,341

(22) Filed: Sep. 20, 2002

Related U.S. Application Data

(63) Continuation-in-part of application No. 09/538,409, filed on Mar. 29, 2000, now Pat. No. 6,568,989, and a continuation-in-part of application No. 09/435,181, filed on Nov. 5, 1999, now Pat. No. 6,283,829.

(60) Provisional application No. 60/393,212, filed on Jul. 2, 2002, provisional application No. 60/127,393, filed on Apr. 1, 1999, provisional application No. 60/128,278, filed on Apr. 8, 1999, provisional application No. 60/128,281, filed on Apr. 8, 1999.

(51) Int. Cl.
*B24B 49/00* (2006.01)
*B24B 51/00* (2006.01)

(52) U.S. Cl. ..... 451/5; 451/8; 451/41; 702/179; 702/182

(58) Field of Classification Search ..... 451/5, 451/8, 36, 37, 41, 285, 286–289, 4, 9, 10, 451/11; 438/690–693, 745, 753, 756, 757; 216/38, 88, 89, 91; 156/345; 252/79.1; 700/266; 702/179, 182; 703/12; 705/1, 705/7, 8; 716/2
See application file for complete search history.

(56) References Cited

U.S. PATENT DOCUMENTS

| | | | |
|---|---|---|---|
| 4,421,068 | A | 12/1983 | Aral |
| 4,544,375 | A | 10/1985 | Rehmat et al. |
| 5,023,045 | A | 6/1991 | Watnabe et al. |
| 5,486,995 | A | 1/1996 | Krist et al. |

(Continued)

OTHER PUBLICATIONS

Bibby, Thomas, "Endpoint Detection for CMP", Journal of Electronic Materials, vol. 27, #10, 1998, pp. 1073-1081.

(Continued)

*Primary Examiner*—Timothy V. Eley

(57) ABSTRACT

A method of in situ control for finishing semiconductor wafers to improve cost of ownership is discussed. A method to use business calculations combined with physical measurements to improve control is discussed. The use of lubricating layer control in the operative finishing interface is discussed. Use of business calculations to change the cost of finishing semiconductor wafers is discussed. The method aids control of differential lubricating films and improved differential finishing of semiconductor wafers. The method aids cost of manufacture forecasting. The method can help manage and/or reduce cost of manufacture for pre-ramp-up, ramp-up, and commercial manufacture of the workpieces. The method can aid cost of manufacture forecasting for pre-ramp-up, ramp-up, and commercial manufacture of the workpieces. The method can aid process control for pre-ramp-up, ramp-up, and commercial manufacture of workpieces. Activity based accounting can be preferred for some applications. Planarization and localized finishing can be improved using differential lubricating films for finishing. New methods and new apparatus for finishing control are disclosed.

95 Claims, 20 Drawing Sheets

U.S. PATENT DOCUMENTS

| | | | | |
|---|---|---|---|---|
| 5,521,814 | A | 5/1996 | Teran et al. | |
| 5,537,325 | A | 7/1996 | Iwakiri | |
| 5,609,511 | A | 3/1997 | Moriyama | |
| 5,647,952 | A | 7/1997 | Chen | |
| 5,667,629 | A | 9/1997 | Pan | |
| 5,682,309 | A | 10/1997 | Bartusiak et al. | |
| 5,691,895 | A | 11/1997 | Kurtzberg et al. | |
| 5,695,660 | A | 12/1997 | Litvak | |
| 5,740,033 | A | 4/1998 | Wassick et al. | |
| 5,774,633 | A | 6/1998 | Baba et al. | |
| 5,799,286 | A | 8/1998 | Morgan et al. | |
| 5,954,997 | A | 9/1999 | Kaufman | |
| 5,972,793 | A | 10/1999 | Tseng | |
| 5,987,398 | A | 11/1999 | Halverson et al. | |
| 6,038,540 | A | 3/2000 | Krist et al. | |
| 6,056,781 | A | 5/2000 | Wassick et al. | |
| 6,110,214 | A | 8/2000 | Klimasauskas | |
| 6,128,540 | A | 10/2000 | Van Der Vegt et al. | |
| 6,157,916 | A | 12/2000 | Hoffman | |
| 6,197,604 | B1 | 3/2001 | Miller et al. | |
| 6,246,972 | B1 | 6/2001 | Klimasauskass | |
| 6,263,255 | B1 | 7/2001 | Tan et al. | |
| 6,268,641 | B1 | 7/2001 | Yano et al. | |
| 6,298,470 | B1 | 8/2001 | Breiner et al. | |
| 6,408,227 | B1 | 6/2002 | Singhvi et al. | |
| 6,526,547 | B2 | 2/2003 | Breiner et al. | |
| 6,567,718 | B1 | 5/2003 | Campbell et al. | |
| 6,568,989 | B1 | 5/2003 | Molnar | |
| 6,796,883 | B1 * | 9/2004 | Molnar | 451/41 |
| 2002/0010563 | A1 | 1/2002 | Ratteree et al. | |
| 2002/0123818 | A1 | 9/2002 | Yamada et al. | |
| 2002/0199082 | A1 | 12/2002 | Shanmugasundram et al. | |
| 2003/0046130 | A1 | 3/2003 | Golightly et al. | |
| 2003/0061004 | A1 | 3/2003 | Discenzo | |
| 2003/0083757 | A1 | 5/2003 | Card et al. | |
| 2003/0093762 | A1 | 5/2003 | Reitman et al. | |

OTHER PUBLICATIONS

Berman, Mike et al., "Review of in Situ and in Line Detection for CMP Applic.", Semiconductor Fabtech, 8th edition, pp. 267-274.

"Understanding and Using Cost of Ownership", Wright Williams & Kelly, Dublin, CA, rev 0595-1.

"Intermetal Dielectric Cost-of-Ownership", Case, C.B. and Case, C. J., *Semiconductor International*, Jun. 1995, pp 83-88.

"Using COO to select Nitride PECVD clean cycle", Anderson, Bob, et al., Semiconductor International, Oct. 1993, pp 86-88.

"The application of cost of ownership simulation to wafer sort and final test", Jimez, D. W. et al., SEMI's Manufacturing test Conference, Jul., 1993.

"Reducing Tungsten Deposition equipment cost of ownership through in situ contamination prevention and reduction", Burghard, R. W., et al., *Microcontamination,* Oct. 1992, pp 23-25.

"Reducing ion-implant equipment cost of ownship through in situ contamination prevention and control", Burghard., R. W., et al., *Microcontamination,* Sep. 1992, pp 27-30.

"Reducing tungsten-etch equipment cost of ownership through in situcontamination prevention and reduction", Burghard, R. W., et al., *Microcontamination*, Jun. 1992, pp 33-36.

"Reducing process equipment cost of ownership through in situ contamination prevention and reduction", Burghard, R. W., et al., *Microcontamination*, May. 1992, pp 21-24.

"Cost of ownership for inspection equipment", Dance D. and Bryson, P., Sematech, Austin, Texas, date unknown.

* cited by examiner

WAFER REFINING

CROSS REFERENCE TO RELATED APPLICATIONS

This application claims benefit of Provisional Application Ser. No. 60/127,393 filed on Apr. 1, 1999 entitled "Control of semiconductor wafer finishing"; Provisional Application Ser. No. 60/128,278 filed on Apr. 8, 1999 entitled "Improved semiconductor wafer finishing control", 60/128,281 filed on Apr. 8, 1999 entitled "Semiconductor wafer finishing with partial organic boundary lubricant", and 60/393,212 filed on Jul. 2, 2002 entitled "Wafer refining". This application claims benefit of Utility patent application Ser. No. 09/435,181 filed on Nov. 5, 1999 entitled "In situ friction detector method for finishing semiconductor wafers" which is now U.S. Pat. No. 6,283,289, and Utility patent application Ser. No. 09/538,409 filed Mar. 29, 2000, now U. S. Pat. No. 6,568,989 entitled "Improved semiconductor wafer finishing control".

Provisional Applications and Regular Applications above are included herein by reference in their entirety.

BACKGROUND OF INVENTION

Chemical mechanical polishing (CMP) is generally known in the art. For example U.S. Pat. No. 5,177,908 issued to Tuttle in 1993 describes a finishing element for semiconductor wafers, having a face shaped to provide a constant, or nearly constant, surface contact rate to a workpiece such as a semiconductor wafer in order to effect improved planarity of the workpiece. U.S. Pat. No. 5,234,867 issued to Schultz et. al. in 1993 describes an apparatus for planarizing semiconductor wafers which in a preferred form includes a rotatable platen for polishing a surface of the semiconductor wafer where a motor for rotating the platen and a non-circular pad is mounted atop the platen to engage and polish the surface of the semiconductor wafer. Fixed abrasive finishing elements are also known for polishing semiconductor layers. An example is WO 98/18159 PCT application by Minnesota Mining and Manufacturing.

Semiconductor wafer fabrication generally requires the formation of layers of material having particularly small thicknesses. A typical conductor layer, such as a metallization layer, is generally 2,000 to 6,000 angstroms thick and a typical insulating layer, for example an oxide layer, is generally 3,000 to 5,000 angstroms thick. The actual thickness is at least partially dependent on the function of the layer along with the function and design of the semiconductor wafer. A gate oxide layer can be less than 100 angstroms thick while a field oxide is in the thousands of angstroms in thickness. In higher density and higher value semiconductor wafers the layers can be below 500 angstroms in thickness. Generally during semiconductor fabrication, layers thicker than necessary are formed and then thinned down to the required tolerances with techniques needed such as Chemical Mechanical Polishing. Because of the strict tolerances, extreme care is given to attaining the required thinned down tolerances. As such, it is useful to accurately control the thinning of the layer during the thinning process and also as it reaches the required tolerances. The end point for the thinning or polishing operation is the final required tolerances. One current method to remove selected amounts of material is to remove the semiconductor wafer periodically from polishing for measurements such as thickness layer measurements. Although this can be done it is time consuming and adds extra expense to the operation. Further the expensive wafers can be damaged during transfer to or from the measurement process further decreasing process yields and increasing costs. Further, merely controlling finishing in a manner that stops polishing at the endpoint, misses the useful aspect of controlling the polishing process itself where defects such as microscratches and other unwanted surface defects can occur. In fact, microscratches which are deep enough to penetrate the target surface can occur before the target surface depth is reached causing lower yields and lost product. Microscratches and other unwanted surface defects formed during polishing can adversely lower the polishing yield adding unnecessary expense to the polishing step in semiconductor wafer manufacture.

BRIEF SUMMARY OF INVENTION

Confidential applicant evaluations show that the control of the finishing step is very complex. The chemical mechanical finishing step has multiple process control parameters. The manufacturing cost for the chemical mechanical finishing step is also complex. To effectively evaluate the cost of manufacture for a chemical mechanical finishing step requires the evaluation of multiple variables, and each with varying effects on the cost of manufacture. Further, some of the variables compete against each other. For instance, a higher finishing rate can lower some aspects of the cost of manufacture such as fixed costs but can also increase other aspects, such as reducing yields. Thus there is a need to evaluate in real time the effects on the cost of manufacture. Confidential analysis shows that there are some particularly preferred parameters of the cost of manufacture to use for real time process control of finishing. Tracking the semiconductor wafer as it undergoes multiple polishing steps to update and change the manufacturing cost model used for effective cost control and process control is unknown to the applicant.

As discussed above, there is a need for an in situ control for a chemical mechanical finishing method which improves the cost of manufacture for a finishing step. There is a need for a finishing method which controls the operative finishing interface during finishing using a cost of manufacture model and/or cost of manufacture parameters. There is a need for a cost of manufacture model which tracks the semiconductor wafer during its various finishing steps and uses a cost of manufacture model appropriate to that individual finishing step. There is a need for sensors which monitor the operative finishing interface in a manner that improves the ability to control and improve the cost of manufacture for a particular finishing step.

It is an advantage of this invention to develop is in a situ control subsystem which controls and/or improves the cost of manufacture for a finishing step. It is an advantage of this invention to develop a finishing method which improves control of the operative finishing interface during finishing using a cost of manufacture model. It is an advantage of this invention to develop a method to use metrics related to cost of manufacture to improve control of the semiconductor wafer cost during its various finishing steps and to use this control to improve the manufacturing cost in situ at one or more individual finishing steps. It is an advantage of this invention to develop a method which can change the cost of manufacture in a new and useful way. It is an advantage of this invention to develop a method which can change the business models in a new and useful way such as for process control. It is an advantage of this invention to develop a preferred method which uses preferred sensors which monitor the operative finishing interface in a manner that improves the ability to control, change, and improve the cost of manufacture of finishing a workpiece for multiple and/or particular finishing steps. It is an advantage of this invention to develop a preferred method which uses preferred sensors which monitor the operative finishing interface in a manner that improves the ability to control, change, and improve the business performance of finishing a workpiece for multiple and/or particular finishing steps.

Further, merely controlling finishing in a manner that stops planarizing and/or polishing at the endpoint, misses the important aspect of controlling the polishing process itself during a time period where defects such as microscratches and other unwanted surface defects can occur. It is generally an advantage of the improved control herein to improve the finishing and planarizing control while also reducing the cost of manufacture of the workpiece. Improved real time control is particularly preferred. Storing and reusing the process control information can provide new and unexpectly useful results such as enhancing business performance.

A preferred embodiment of this invention is directed to a method of finishing a semiconductor wafer during a finishing cycle time comprising a step of providing a finishing surface; a step of providing at least one operative sensor; a step of positioning the semiconductor wafer proximate to the finishing surface and wherein the semiconductor wafer has a tracking code; a step of applying an operative finishing motion between the semiconductor wafer and the finishing surface; a step of sensing a progress of finishing information with the operative sensor; a step of sending the progress of the finishing information to a processor having access to the tracking code, at least one cost of manufacture parameter, and the progress of finishing information; a step of determining a change for a process control parameter using the tracking code, the at least one cost of manufacture parameter, and the progress of finishing information; and a step of changing the process control parameter during the finishing cycle time to change the cost of manufacture of the semiconductor wafer.

A preferred embodiment of this invention is directed to a method of finishing a semiconductor wafer having a semiconductor wafer surface and having a semiconductor wafer tracking code comprising a step of providing a control subsystem having an operative sensor, a processor, and a controller; a step of applying a finishing energy to the semiconductor wafer; a step of sensing progress of finishing information of the semiconductor wafer surface with the control subsystem, the control subsystem having access to a cost of manufacture model, the tracking code, and at least three cost of manufacture parameters during a finishing cycle time; a step of determining at least one change for at least one process control parameter using at least in part at least the cost of manufacture model, the tracking code, the at least three cost of manufacture parameters, and the progress of finishing information during the finishing cycle time; and a step of changing the at least one process control parameters to change the cost of manufacture of the semiconductor wafer during the finishing cycle time.

A preferred embodiment of this invention is directed to a method for finishing a workpiece having a workpiece surface and having a finishing cycle time in minutes, the method comprising a step of providing an operative control subsystem having an operative sensor, a controller, and a processor and wherein the processor has access to at least one cost of manufacture parameter, a quantity of historical performance including a quantity of historical tracked information, a workpiece tracking code, and a quantity of workpiece tracked information; a step of applying an operative finishing motion to the workpiece surface; a step of sensing a progress of finishing information with the operative sensor during at least a portion of the finishing cycle time; a step of determining a change for at least one process control parameter using the at least one cost of manufacture parameter, the quantity of historical performance including the quantity of historical tracked information, the workpiece tracking code, the quantity of workpiece tracked information, and the progress of finishing information with the operative control subsystem during at least the portion of the finishing cycle time; a step of changing the at least one process control parameter which changes the finishing during at least the portion of the finishing cycle time.

A preferred embodiment of this invention is directed to a method of finishing a workpiece during a finishing cycle time comprising a step of providing a finishing surface; a step of providing at least one operative control subsystem having at least one operative sensor, at least one processor, and at least one controller; a step of positioning the workpiece proximate to the finishing surface and wherein the workpiece has a workpiece tracking code; a step of applying an operative finishing motion between the workpiece and the finishing surface; a step of sensing a progress of finishing information with the operative sensor; a step of sending the progress of the finishing information to a processor having access to at least one cost of manufacture parameter, the workpiece tracking code, a quantity of workpiece tracked information, an amount of historical performance including tracked information from the at least 3 workpieces, and the progress of finishing information; a step of determining a change for a process control parameter using the tracking code, the at least one cost of manufacture, the workpiece tracking code, the quantity of workpiece tracked information, the amount of historical performance including tracked information from the at least 3 workpieces, and the progress of finishing information; and a step of changing the process control parameter during the finishing cycle time to change the finishing of the workpiece.

A preferred embodiment of this invention is directed to a method of finishing a workpiece during a finishing cycle time comprising a step of providing a finishing surface; a step of providing at least one operative sensor; a step of positioning the workpiece proximate to the finishing surface and wherein the workpiece has a workpiece tracking code; a step of applying an operative finishing motion between the workpiece and the finishing surface for finishing; a step of sensing a progress of finishing information with the operative sensor; a step of sending the progress of the finishing information to a processor having access to at least one cost of manufacture parameter, the workpiece tracking code, a quantity of workpiece tracked information, at least one business model including cost and revenue, an amount of historical performance including tracked information from at least 3 workpieces, and the progress of finishing information; a step of determining a change for a process control parameter using the at least one cost of manufacture parameter, the workpiece tracking code, and the quantity of workpiece tracked information, the at least one business model including cost and revenue, the amount of historical performance including tracked information from at least 3 workpieces, and the progress of finishing information; and a step of changing the process control parameter during the finishing cycle time to change the finishing of the workpiece.

A preferred embodiment of this invention is directed to a method for finishing a workpiece having a workpiece surface and having a finishing cycle time in minutes, the method comprising a step of providing an operative control subsystem having an operative sensor, a controller, and a processor and wherein the processor has access to at least one cost of manufacture parameter, a workpiece tracking code, and a quantity of workpiece tracked information; a step of applying an operative finishing motion to the workpiece surface; a step of sensing a progress of finishing information with the operative sensor during at least a portion of the finishing cycle time; a step of determining a change for at least one process control parameter using the at least one cost of manufacture parameter, the workpiece tracking code, the quantity of workpiece tracked information, and the progress of finishing information with the operative control subsystem during at least the portion of the finishing cycle time; and a step of changing the at least one process control parameter which changes the finishing during at least the portion of the finishing cycle time.

A preferred embodiment of this invention is directed to an apparatus for finishing a workpiece having a tracking code, the apparatus comprising a workpiece holder for holding a workpiece having the tracking code; an operative control subsystem having an operative sensor, a controller, and a processor and wherein the processor has access to at least three cost of manufacture parameters, at least one cost of manufacture model, and the tracking code for the workpiece; and a finishing surface for applying a finishing energy to the workpiece held by the workpiece holder.

A preferred embodiment of this invention is directed to an apparatus for finishing a workpiece having a tracking code, the apparatus comprising a workpiece holder; an operative control subsystem having at least three operative sensors, a controller, and a processor and wherein the processor has access to at least one cost of manufacture parameter, a cost of manufacture model, a process model, and the tracking code for the workpiece; and an operative finishing surface for applying a finishing energy to the workpiece held by the workpiece holder.

An apparatus as above wherein the apparatus for finishing is connected to a multiplicity of other separate workpiece fabrication machinery, and information derived therefrom in an operative computerized network, the operative control subsystem having access to the other separate workpiece fabrication machinery, metrology equipment, and information derived therefrom for feedforward and feedback control while applying the finishing energy to the workpiece. At least three apparatus for finishing, the at least three apparatus for finishing as above, wherein the at least three apparatus for finishing are connected to a multiplicity of other separate workpiece fabrication machinery, and information derived therefrom in an operative computerized network, the operative control subsystem having access to the other separate workpiece fabrication machinery, metrology equipment, and information derived therefrom for feedforward and feedback control while applying the finishing energy to the workpiece.

A preferred embodiment has tracked information associated with the tracking code. Historical performance including a tracking code (or tracking codes) is preferred for some applications. Historical performance including a tracking code (or tracking codes) with tracked information is more preferred for some applications. A tracking code (or tracking codes) with tracked information for a group of wafers can be preferred for some preferred embodiments. A tracking code (or tracking codes) with tracked information for a batch of semiconductor wafers is more preferred for some applications. A tracking code with tracked information for a (each individual) semiconductor wafer is even more preferred for some applications. Tracking codes and/or tracked information can aid in the development, implementation, and performance of many to of the preferred process control embodiments discussed herein in a new and useful way to get a new and useful result. Use of process control information for multiple purposes can generally improve costs and profitability.

These and other advantages of the invention for one or more preferred embodiments will become readily apparent to those of ordinary skill in the art after reading the following disclosure of the invention.

Other preferred new and useful embodiments are also discussed herein.

REFERENCE NUMERALS IN DRAWINGS

Figure 1:
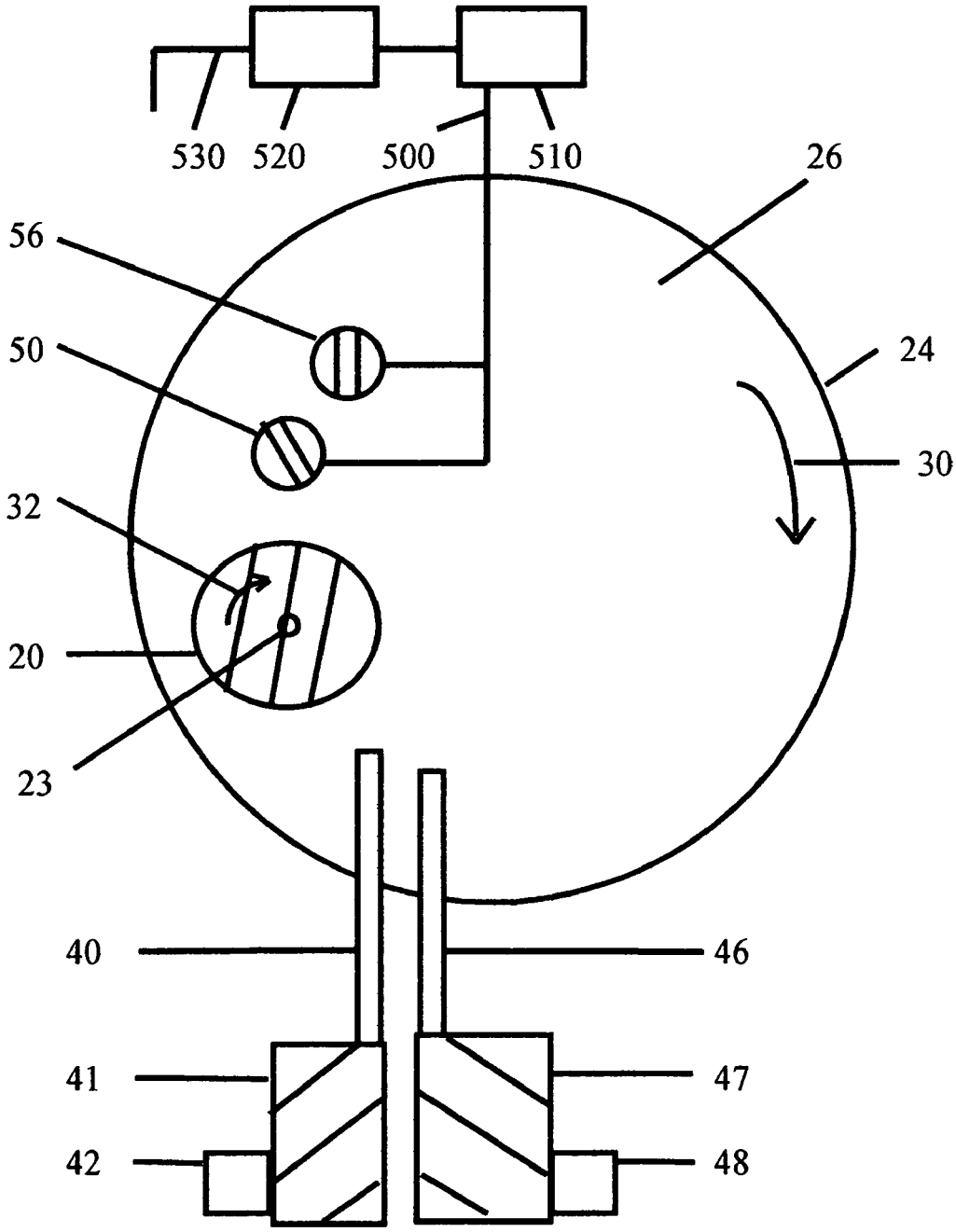
FIG. 1 is an artist's drawing of a preferred embodiment of some equipment

Reference Numeral 20 workpiece
Reference Numeral 21 workpiece surface facing away from the workpiece surface being finished.
Reference Numeral 22 surface of the workpiece being finished
Reference Numeral 23 center of rotation of the workpiece
Reference Numeral 24 finishing element
Reference Numeral 26 finishing element finishing surface
Reference Numeral 28 finishing element surface facing away from workpiece surface being finished
Reference Numeral 29 finishing composition and, optionally, alternate finishing composition
Reference Numeral 30 direction of rotation of the finishing element finishing surface
Reference Numeral 32 direction of rotation of the workpiece being finished
Reference Numeral 33 pressure applied to the operative finishing interface substantially perpendicular to the finishing motion
Reference Numeral 34 operative finishing motion between the workpiece surface being finished and the finishing element finishing surface
Reference Numeral 35 applied pressure between the workpiece surface being finished and the finishing element finishing surface
Reference Numeral 36 operative finishing motion between the first friction sensor probe surface and the finishing element finishing surface
Reference Numeral 37 applied pressure between the second friction sensor probe surface and the finishing element finishing surface
Reference Numeral 38 operative friction motion between the second friction sensor probe surface and the finishing element finishing surface
Reference Numeral 39 applied pressure between the second friction sensor probe surface and the finishing element finishing surface
Reference Numeral 40 finishing composition feed line
Reference Numeral 41 reservoir of finishing composition
Reference Numeral 42 feed mechanism for finishing composition
Reference Numeral 46 alternate finishing composition feed line
Reference Numeral 47 alternate reservoir of finishing composition
Reference Numeral 48 alternate feed mechanism for finishing composition
Reference Numeral 50 first friction sensor probe
Reference Numeral 51 first friction sensor surface
Reference Numeral 52 first friction probe motor
Reference Numeral 54 operative connection between first friction sensor probe and first friction drive motor
Reference Numeral 56 second friction sensor probe
Reference Numeral 57 second friction sensor surface
Reference Numeral 58 second friction probe motor
Reference Numeral 56 operative connection between second friction sensor probe and second friction drive motor
Reference Numeral 61 unwanted raised surface region on the workpiece
Reference Numeral 62 carrier
Reference Numeral 63 operative contact element
Reference Numeral 64 motor for carrier
Reference Numeral 70 platen
Reference Numeral 72 surface of platen facing finishing element
Reference Numeral 74 surface of platen facing base support structure
Reference Numeral 76 surface of the base support structure facing the platen
Reference Numeral 77 base support structure
Reference Numeral 78 surface of the base support structure facing away from the platen
Reference Numeral 90 body of a friction sensor probe
Reference Numeral 92 insulation in a friction sensor probe
Reference Numeral 94 friction sensor element
Reference Numeral 95 friction sensor surface
Reference Numeral 96 operative friction sensor
Reference Numeral 98 thermal adjustment port for friction sensor probe
Reference Numeral 102 operative sensor connections
Reference Numeral 104 processor
Reference Numeral 106 operative connection(s) between processor and controller
Reference Numeral 108 controller
Reference Numeral 110 operative connection(s) between controller and equipment controlled
Reference Numeral 150 effective organic boundary lubricating layer
Reference Numeral 152 regions where the workpiece surface is effectively free of an organic boundary layer lubrication.
Reference Numeral 154 regions where the workpiece surface is effectively lubricated with an organic boundary lubricating layer
Reference Numeral 500 operative sensor.
Reference numeral 510 processor.
Reference Numeral 520 controller.
Reference Numeral 530 operative connections for controlling.
Reference Numeral 800 portion of a semiconductor wafer surface having two unwanted raised regions.
Reference Numeral 802 unwanted raised regions on the semiconductor surface being finished.
Reference Numeral 804 lower local regions on the semiconductor surface being finished proximate to the unwanted raised regions.
Reference Numeral 810 portion of finishing element finishing surface
Reference Numeral 812 finishing element surface local region displaced from but proximate to and lower than the unwanted raised local regions.
Reference Numeral 900 boundary layer lubrication.
Reference Numeral 902 regions of partial or no local boundary layer lubrication
Reference Numeral 904 regions of boundary layer lubrication
Reference Numeral 910 10% of a finishing cycle time with the smallest variable change over time
Reference Numeral 912 illustrates a non-steady state time period having the same variable change at least twice as much as during the more stable period

DETAILED DESCRIPTION OF THE INVENTION

The book *Chemical Mechanical Planarization of Microelectric Materials* by Steigerwald, J. M. et al published by John Wiley & Sons, ISBN 0471138274, generally describes chemical mechanical finishing and is included herein by reference in its entirety for general background. In chemical mechanical finishing the workpiece is generally separated from the finishing element by a polishing slurry. The workpiece surface being finished is in parallel motion with finishing element finishing surface disposed towards the workpiece surface being finished. The abrasive particles such as found in a polishing slurry interposed between these surfaces finish the workpiece.

Discussion of some of the terms useful to aid in understanding this invention are now presented. Finishing is a term used herein for both planarizing and polishing. Planarizing is the process of making a surface which has raised surface perturbations or cupped lower areas into a planar surface and thus involves reducing or eliminating the raised surface perturbations and cupped lower areas. Planarizing changes the topography of the workpiece from non planar to ideally perfectly planar. A preferred planarizing step moves or removes material from the workpiece surface to improve planarity. Polishing is the process of smoothing or polishing the surface of an object and tends to follow the topography of the workpiece surface being polished. A finishing element is a term used herein to describe a pad or element for both polishing and planarizing. A finishing element finishing surface is a term used herein for a finishing element surface used for both polishing and planarizing. A finishing element planarizing surface is a term used herein for a finishing element surface used for planarizing. A finishing element polishing surface is a term used herein for a finishing element surface used for polishing. Workpiece surface being finished is a term used herein for a workpiece surface undergoing either or both polishing and planarizing. A workpiece surface being planarized is a workpiece surface undergoing planarizing. A workpiece surface being polished is a workpiece surface undergoing polishing. The finishing cycle time is the elapsed time in minutes that the workpiece is being finished. The planarizing cycle time is the elapsed time in minutes that the workpiece is being planarized. The polishing cycle time is the elapsed time in minutes that the workpiece is being polishing.

As used herein, a refining surface comprises a surface for refining a workpiece surface using an operative motion selected from a motion consisting of a planarizing operative motion, a polishing operative motion, a buffing operative motion, and a cleaning operative motion or combination thereof.

As used herein, an emulsion is a fluid containing a microscopically heterogeneous mixture of two (2) normally immiscible liquid phases, in which one liquid forms minute droplets suspended in the other liquid. As used herein, a surfactant is a surface active substance, i.e., alters (usually reduces) the surface tension of water. Non limiting examples of surfactants include ionic, nonionic, and cationic. As used herein, a lubricant is an agent that reduces friction between moving surfaces. A hydrocarbon oil is a non limiting example of substance not soluble in water. As used herein, soluble means capable of mixing with a liquid (dissolving) to form a homogeneous mixture (solution).

As used herein, a dispersion is a fluid containing a microscopically heterogeneous mixture of solid phase material dispersed in a liquid and in which the solid phase material is in minute particles suspended in the liquid.

As used herein, an appreciable amount is term which means "capable of being readily perceived or estimated". A change in the cost of manufacture by an appreciable amount (readily perceived or estimated amount) is a preferred nonlimiting example. A change in the cut rate measured in Angstroms per minute by an appreciable amount (readily perceived or estimated amount) is a preferred nonlimiting example.

As used herein, a die is one unit on a semiconductor wafer generally separated by scribe lines. After the semiconductor wafer fabrication steps are completed, the die are separated into units, generally by sawing. The separated units are generally referred to as "chips". Each semiconductor wafer generally has many die which are generally rectangular. The terminology semiconductor wafer and die are generally known to those skilled in the arts. As used herein, within die uniformity refers to the uniformity within the die. As used herein, local planarity refers to die planarity unless specifically defined otherwise. Within wafer uniformity refers to the uniformity of finishing of the wafer. As used herein, wafer planarity refers to planarity across a wafer. Multiple die planarity is the planarity across a defined number of die. As used herein, global wafer planarity refers to planarity across the entire semiconductor wafer planarity. Planarity is important for the photolithography step generally common to semiconductor wafer processing, particularly where feature sizes are less than 0.25 microns. As used herein, a device is a discrete circuit such as a transistor, resistor, or capacitor. As used herein, pattern density is ratio of the raised (up) area in square millimeters to the to area in square millimeters of region on a specific region such as a die or semiconductor wafer. As used herein, pattern density is ratio of the raised (up) area in square millimeters to the total area in square millimeters of a region on a specific region such as a die or semiconductor wafer. As used herein, line pattern density is the ratio of the line width to the pitch. As used herein, pitch is line width plus the oxide space. As an illustrative example, pitch is the copper line width plus the oxide spacing. Oxide pattern density, as used herein, is the volume fraction of the oxide within an infinitesimally thin surface of the die.

FIG. 1 is an artist's drawing of a particularly preferred embodiment of this invention when looking from a top down including the interrelationships of some important objects when finishing. Reference Numeral 20 represents the workpiece being finished. The finishing element finishing surface can comprise inorganic abrasive particles for some applications. The finishing element finishing surface can comprise organic abrasive particles for some applications. The finishing element finishing surface can be free of inorganic abrasive particles for some applications. The finishing element finishing surface can free of organic abrasive particles for some applications. Generally, a finishing surface having abrasive particles therein is a more aggressive finishing surface and can be preferred for some applications, particularly where higher cutting rates are preferred. Generally, a finishing surface free of abrasive particles therein can be preferred for finishing such as wherein an abrasive slurry is used. A finishing element finishing surface, preferably abrasive finishing element finishing surface, free of fluorocarbon matter can be preferred for some types of finishing because the fluorocarbon matter can be difficult to clean from some workpiece surfaces after finishing, particularly with aqueous cleaning compositions. Reference Numeral 23 is the center of the rotation of the workpiece. The workpiece surface facing the finishing element finishing surface is the workpiece surface being finished. Reference Numeral 24 represents the finishing element. Reference Numeral 26 represents the finishing element finishing surface. A finishing element finishing surface which is free of abrasive particles connected to the finishing surface is preferred for some applications. For these applications, a finishing element finishing surface which is free of inorganic abrasive particles connected to the finishing surface is more preferred and a finishing element finishing surface which is free of fixed abrasive particles is even more preferred. Abrasive particles which are connected to and/or fixed to the finishing surface increase the possibility of causing unwanted surface damage to the workpiece surface being finished. Confidential evaluations indicate that preferred lubrication of the operative finishing interface can reduce or eliminate some of these harmful effects of finishing elements finishing surfaces having a fixed abrasive. It is preferred to measure and control active lubrication at the operative finishing interface to minimize some of these harmful effects. It is preferred to have a finishing feedback subsystem with can monitor and function well with or without lubricant changes at the operative finishing interface. By having a finishing surface which is free of attached abrasive particles, potential damage from fixed abrasives is avoided. By having the real time friction sensor subsystems and finishing sensor subsystems of a preferred embodiment of this invention, changes in friction due to real time lubrication at the operative finishing interface can be sensed, controlled and adjusted to improve finishing, with a finishing element surface free of fixed abrasives and with a finishing element surface having fixed abrasives. Feeding a finishing composition without abrasives is preferred and feeding a finishing composition without abrasive particles is more preferred. Supplying a finishing composition without abrasives is preferred and supplying a finishing composition without abrasive particles is more preferred. Feeding a water borne finishing composition having a lubricant which is free of abrasive particles is also preferred and feeding a water borne finishing composition having a lubricant which is free of abrasive particles is particularly preferred. A lubricant separate from and unconnected to the abrasive particles is preferred. Reference Numeral 30 represents the direction of rotation of the finishing element finishing surface. Reference Numeral 32 represents the direction of rotation of the workpiece being finished. Reference Numeral 40 represents a finishing composition feed line for adding chemicals to the surface of the workpiece such as acids, bases, buffers, other chemical reagents, abrasive particles and the like. The finishing composition feed line can have a plurality of exit orifices. A preferred finishing composition is finishing slurry. Reference Numeral 41 represents a reservoir of a finishing composition to be fed to a finishing element finishing surface. Reference Numeral 42 represents a feed mechanism for the finishing composition such as a variable air or gas pressure or a pump mechanism. Reference Numeral 46 represents an alternate finishing composition feed line for adding a finishing chemical composition to the finishing element finishing surface to improve the quality of finishing. Reference Numeral 47 represents an alternate finishing composition reservoir of chemicals to be, optionally, fed to the finishing element finishing surface. The alternate finishing composition can also contain abrasive particles and thus can be a finishing slurry. Reference Numeral 48 represents a feed mechanism for the alternate finishing composition such as a variable pressure or a pump mechanism. A preferred embodiment of this invention is to feed liquids free of abrasives from the finishing composition feed line and the alternate finishing composition feed line in which at least one feed has a liquid having abrasive particles in a slurry. Another preferred embodiment, not shown, is to have a wiping element, preferably an elastomeric wiping element, to uniformly distribute the finishing composition(s) across the finishing element finishing surface. Multiple nozzles to feed the finishing composition and alternate finishing composition can be preferred to better distribute them across the finishing element finishing surface. Nonlimiting examples of some preferred dispensing systems and wiping elements is found in U.S. Pat. No. 5,709,593 to Guthrie et. al., U.S. Pat. No. 5,246,525 to Junichi, and U.S. Pat. No. 5,478,435 to Murphy et al. and are included herein by reference in their entirety for general guidance and appropriate modifications by those generally skilled in the art for supplying lubricants. Alternately supplying the finishing composition through pores or holes in the finishing element finishing surface to effect a uniform distribution of the lubricant is also effective. Reference Numeral 50 represents a first friction sensor probe. Reference Numeral 56 represents an optional second friction sensor probe. A thermal sensor probe is a preferred friction sensor probe. An infrared sensor probe is a preferred thermal sensor probe. A thermocouple probe is a preferred thermal sensor probe. A thermistor probe is a preferred thermal sensor probe. Reference Numeral 500 represents an operative sensor. An energy change sensor is a preferred operative sensor. Reference numeral 510 represents a processor. Reference Numeral 520 represents a controller. Reference Numeral 530 represents the operative connections for controlling. Operative connections are generally known to those skilled in the art. Illustrative preferred examples include controlling the operative finishing motion. Further examples are discussed herein below.

Figure 2:
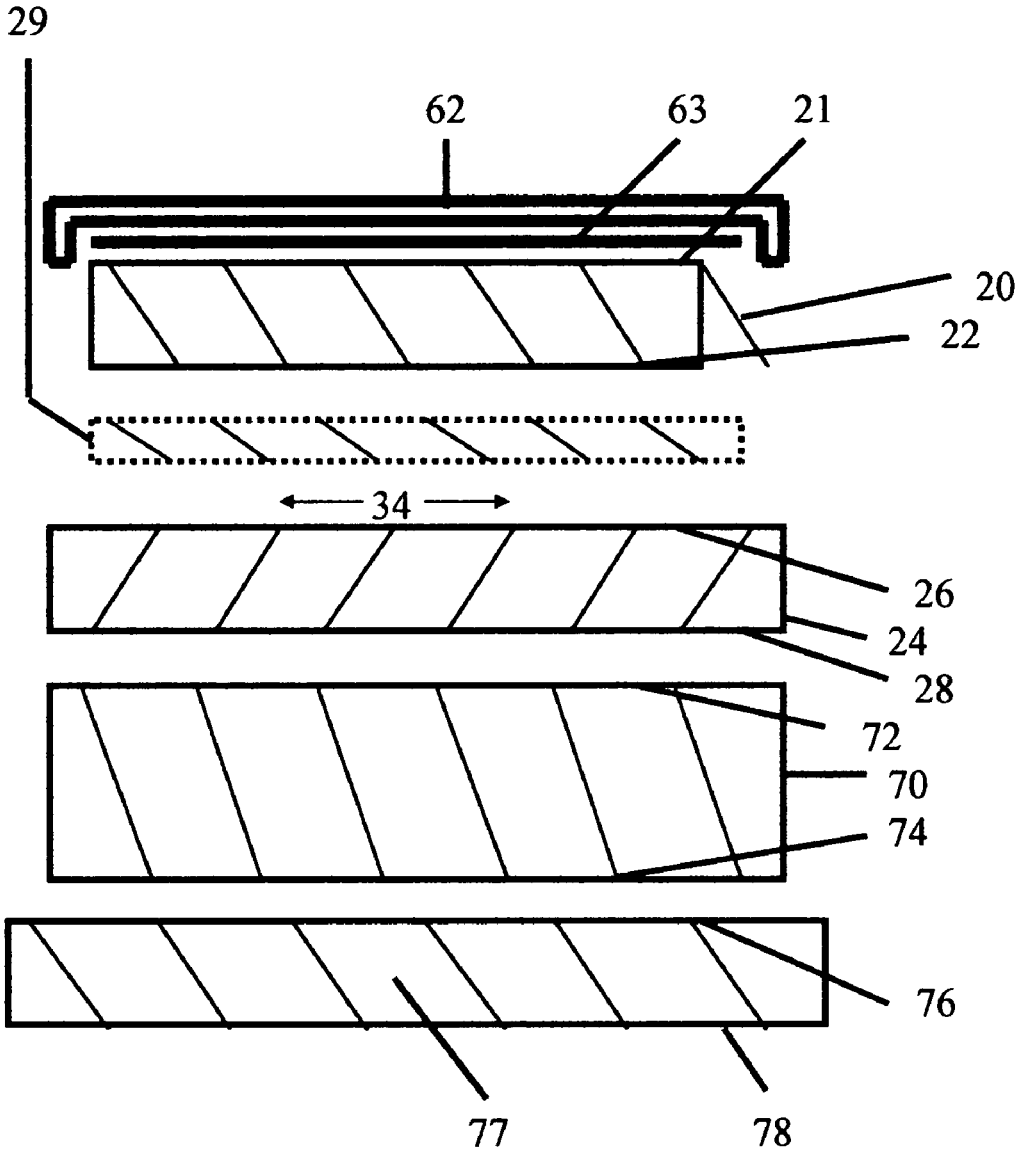
FIG. 2 is an artist's close up drawing of a particular preferred embodiment of some equipment including the interrelationships of the different objects

FIG. 2 is an artist's closeup drawing of a preferred embodiment of this invention showing some further interrelationships of the different objects when finishing according to the method of this invention. Reference Numeral 62 represents a carrier for the workpiece and in this particular embodiment, the carrier is a rotating carrier. The rotating carrier is operable to rotate the workpiece against the finishing element which rests against the platen and optionally has a motor. Optionally, the rotating carrier can also be designed to move the workpiece laterally, in an arch, figure eight, or orbitally to enhance uniformity of polishing. Optionally the carrier can be can have other motions. Optionally and preferably the carrier can have the ability to apply pressure locally in selective amounts as disclosed in U.S. Pat. No. 5,486,129 to Sandhu et al, and U.S. Pat. No. 5,762,536 to Pant et al. which are included by reference in their entirety for guidance and modification by those skilled in the arts. The workpiece is in operative contact with the rotating carrier and optionally, has an operative contact element (Reference Numeral 63) to hold the workpiece to the carrier during finishing. An illustrative example of an operative contact element (Reference Numeral 63) is a workpiece held in place to the rotating carrier with a bonding agent. A hot wax is an illustrative example of a preferred bonding agent. Alternately, a porometric film can be placed in the rotating carrier having a recess for holding the workpiece. A wetted porometric film (an alternate Reference Numeral 63) will hold the workpiece in place by surface tension. An adherent thin film is another preferred example of placing the workpiece in operative contact with the rotating carrier. Reference Numeral 20 represents the workpiece. Reference Numeral 21 represents the workpiece surface facing away from the workpiece surface being finished. Reference Numeral 22 represents the surface of the workpiece being finished. Reference Numeral 24 represents the finishing element. Reference Numeral 26 represents the finishing element surface facing the workpiece surface being finished and is often referred to herein as the finishing element finishing surface. Reference Numeral 28 represents the surface of the finishing element facing away from the workpiece surface being finished. Reference Numeral 29 represents the finishing composition and optionally, the alternate finishing composition supplied between the workpiece surface being finished and surface of the finishing element facing the workpiece. Reference Numeral 34 represents a preferred direction of the operative finishing motion between the surface of the workpiece being finished and the finishing element finishing surface. An operative finishing motion applies an operative finishing energy to the surface of the workpiece for planarizing and/or polishing. A friction energy is a preferred example of an operative finishing energy. A chemical energy is a preferred example of an operative finishing energy. A thermal energy is a preferred example of an operative finishing energy. A tribochemical energy is a preferred example of an operative finishing energy. Reference Numeral 70 represents the platen or support for the finishing element. The platen can also have an operative finishing motion relative to the workpiece surface being finished. Reference Numeral 72 represents the surface of the platen facing the finishing element. The surface of the platen facing the finishing element is in support contact with the finishing element surface facing away from the workpiece surface being finished. The finishing element surface facing the platen can, optionally, be connected to the platen by adhesion. Frictional forces between the finishing element and the platen can also retain the finishing element against the platen. Reference Numeral 74 is the surface of the platen facing away from the finishing element. Reference Numeral 76 represents the surface of the base support structure facing the platen. Reference Numeral 77 represents the base support structure. Reference Numeral 78 represents the surface of the base support structure facing away from the platen. The rotatable carrier (Reference Number 70) can be operatively connected to the base structure to permit improved control of the pressure application at the workpiece surface being finished (Reference Numeral 22).

Figure 3:
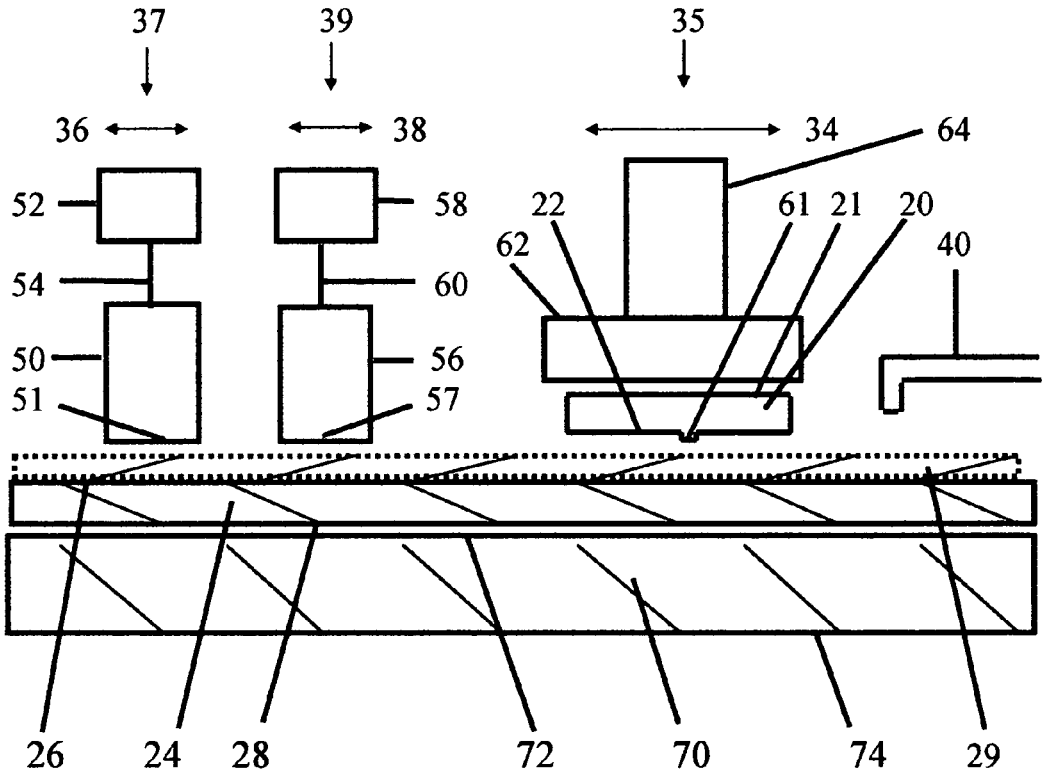
FIG. 3 is a drawing of a preferred embodiment of this invention

FIG. 3 is an artist's drawing of a preferred embodiment showing some further interrelationships of some of the objects when finishing according to the method of this invention. Reference Numeral 20 represents the workpiece being finished. Reference Numeral 21 represents the workpiece surface facing away from the finishing element finishing surface. Reference Numeral 22 represents the workpiece surface being finished. Reference Numeral 61 represents an unwanted raised region on the workpiece surface being finished. Reference Numeral 62 represents a simplified view of the carrier for the workpiece. The carrier for the workpiece can have a number of preferred options, depending on the finishing required, such as a retainer ring, a fluid filled chuck, and/or a chuck capable of applying localized differential pressures across the wafer to better control wafer finishing. Reference Numeral 64 represents the optionally preferred motor for applying a finishing motion to the workpiece being finished. Reference Numeral 34 represents a preferred operative finishing motion. Reference Numeral 35 represents a preferred operative pressure applied to the workpiece surface by urging it against or towards the finishing element finishing surface. Reference Numeral 40 represents the finishing composition feed line. The alternate finishing feed line, Reference Numeral 46, is behind the Reference Numeral 40 and thus is not shown in this particular artist's drawing. Reference Numeral 24 represents the finishing element. Reference Numeral 26 represents the finishing element finishing surface. Reference Numeral 28 represents the finishing element surface facing away from the workpiece surface being finished. Reference Numeral 29 represents the finishing composition and optionally, the alternate finishing composition supplied between the workpiece surface being finished and the surface of the finishing element facing the workpiece. Reference Numeral 50 represent a first friction sensor probe. Reference Numeral 51 represents the surface of the first friction probe in friction contact with the finishing element finishing surface and is often referred to herein as the first friction sensor surface. Reference Numeral 52 represents an optionally preferred motor to rotate the first friction sensor probe. Reference Numeral 54 represents an optional operative connection between the first friction sensor probe and motor. Reference Numeral 36 represents a preferred friction motion between the first friction sensor probe friction sensor surface and the finishing element finishing surface. Reference Numeral 37 represents an operative pressure applied to the first friction probe friction sensor surface by urging it against or towards the finishing element finishing surface. Reference Numeral 56 represents a preferred optional second friction sensor probe. Reference Numeral 57 represents the surface of the second friction probe in friction contact with the finishing element finishing surface and is often referred to herein as the second friction sensor surface. Reference Numeral 58 represents an optionally preferred second motor to rotate the second friction sensor probe. Reference Numeral 60 represents an optional second operative connection between the second friction sensor probe and an optional motor. Reference Numeral 38 represents a preferred friction motion between the second friction sensor probe friction sensor surface and the finishing element finishing surface. Reference numeral 39 represents an operative pressure applied to a second friction probe friction sensor surface by urging it against or towards the finishing element finishing surface. The operative finishing motion, the operative first friction motion, and the operative second friction motion can differ from each other and are preferably controlled independently of each other's motions and/or pressures.

Figure 4:
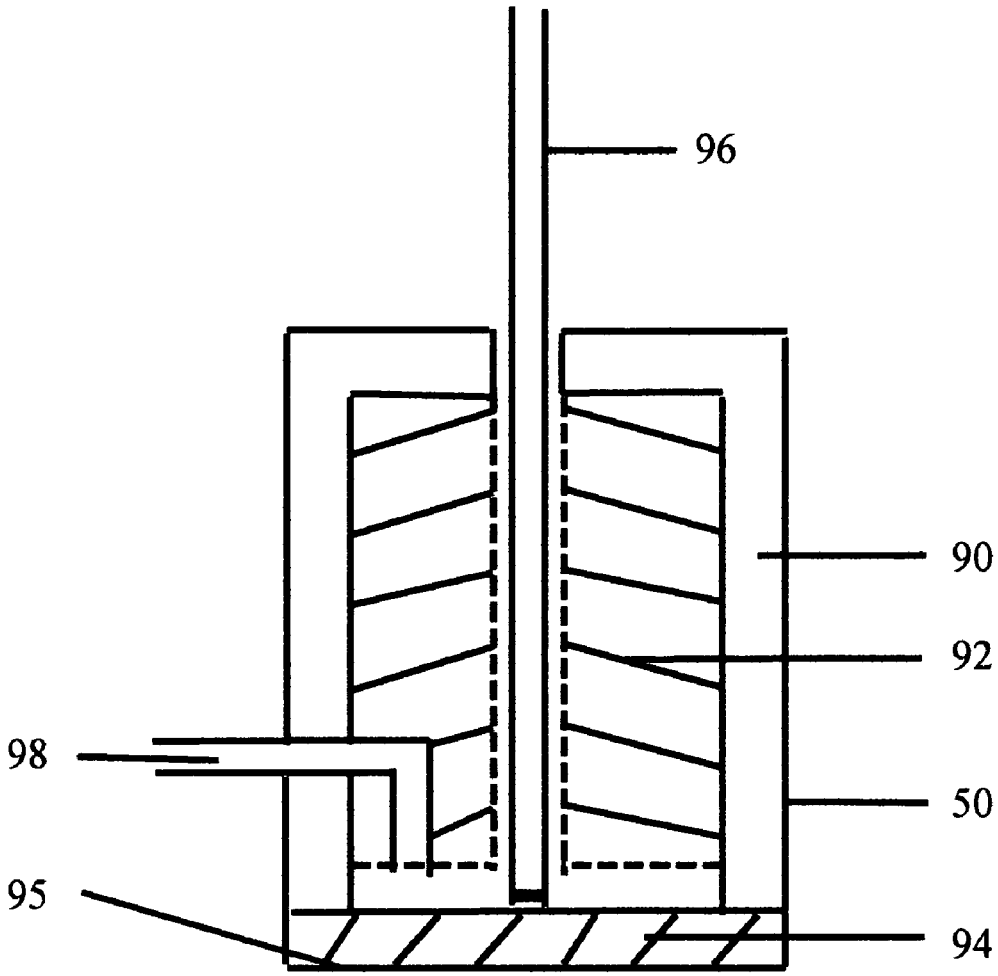
FIG. 4 is cross-sectional view of a preferred thermal sensor probe

FIG. 4 is an artist's drawing of a preferred embodiment of one type of preferred friction sensor probe useful for this invention showing some further interrelationships of the sections in the friction sensor probe. Reference Numeral 50 represents the friction sensor probe. Reference Numeral 90 represents the body of the friction sensor probe. The body of the friction sensor probe can be comprised of many different materials. A friction sensor probe body comprising metal or plastic is preferred. Reference Numeral 92 represents optional, but preferred, insulation in the friction sensor probe. Reference Numeral 94 represents a friction sensor element for the friction sensor probe. During operation, the friction sensor surface (Reference Numeral 95) is in operative friction motion with the finishing element finishing surface and the results of this friction are measured by a friction sensor probe. Shown in this embodiment is an operative friction sensor such as a thermal couple (Reference Numeral 96) which measures friction during operative friction motion by measuring changes in temperature due to increased or decreased friction. A friction sensor surface which responds to operative friction motion is preferred. A friction sensor surface which responds to operative friction motion related to the workpiece surface being finished (or material contained therein) in a manner expressible by a mathematical equation is preferred. Reference Numeral 94 represents an insulating material contained in the friction sensor probe body to improve accuracy of measurement of temperature increases and to reduce heat losses. Reference Numeral 96 represents a friction sensor which in this particular embodiment is a thermocouple. A thermocouple is a preferred example of a non-optical friction sensor. Reference Numeral 98 represents a thermal adjustment port that can be used to adjust the temperature upwards or downwards. A thermal adjustment port for feeding fluid cooling medium is preferred and feeding a gas cooling medium is especially preferred. The optional cooling port is useful to change and more particularly to decrease the temperature rapidly and economically between workpieces being finished.

Some preferred embodiments for the friction sensor element and its friction sensor surface will now be discussed further. A friction sensor element for the friction sensor probe can be an integral member of the friction sensor probe body. This is an example of a preferred permanent friction sensor element attachment to the friction sensor surface. A replaceable friction sensor element is preferred for a number of applications because it can lower the cost of finishing the workpieces. The replaceable friction sensor element is preferably attached to the friction sensor probe body. A preferred example of a replaceable friction sensor element is a temporary friction sensor element. A temporary attachment mechanism attaching the replaceable friction sensor element to the friction sensor probe body is one preferred attachment mechanism. A preferred replaceable friction sensor element can be attached to the friction sensor body with a temporary adhesive mechanism or a temporary mechanical attachment mechanism. A preferred temporary mechanical attachment mechanism is a mechanism selected from the group consisting of a friction fit mechanism, a snap fit mechanism, and a cam lock mechanism. The friction sensor element can be adhered to the friction sensor probe body, snap fit in the friction body, and/or friction fit in the friction sensor probe body. A preferred temporary adhesive mechanism includes a temporary adhesive coating, temporary adhesive surface, and a temporary adhesive tape. A permanently attached friction sensor element can also be preferred for some applications. These friction sensor probes can easily be replaced as a unit and thus reduce operator time for changes. A permanently attached friction sensor can be permanently adhered to the friction sensor body, molded into the friction sensor body, or permanently mechanically attached to the friction sensor body. An abrasion resistant friction sensor surface is often preferred because they last longer in service.

Figure 5:
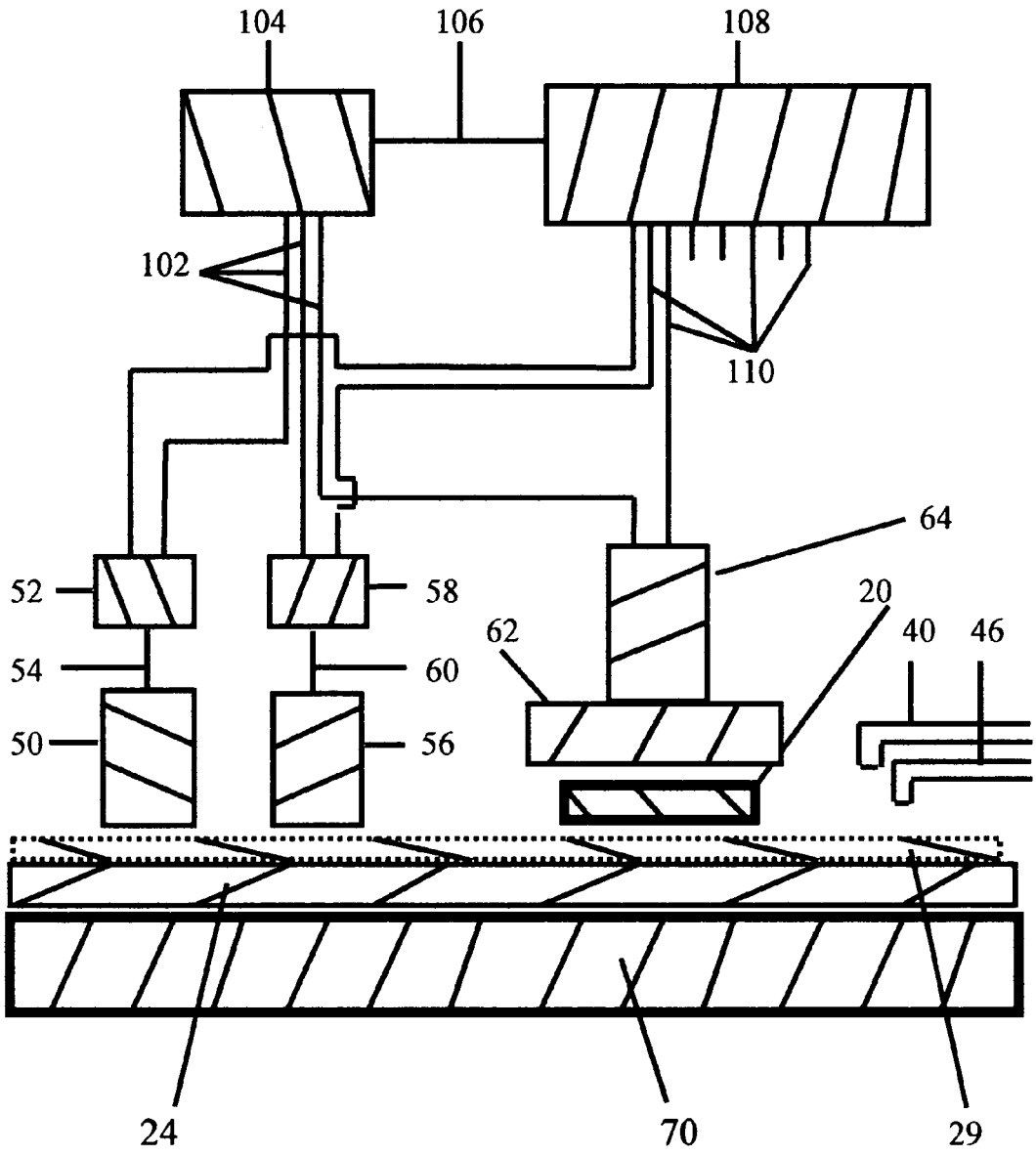
FIG. 5 is an artist's simplified view of the some major components in a finishing sensor

FIG. 5 is an artist's drawing of the some of the objects and their interconnections in a preferred embodiment of the invention. Reference Numeral 20 represents the workpiece being finished. Reference Numeral 24 represents the finishing element. Reference Numeral 29 represents the finishing composition and, optionally, the alternate finishing composition. Reference Numeral 40 represents the feed line for the finishing composition. Reference Numeral 46 represents the feed line for the alternate finishing composition. Reference Numeral 50 represents the first friction sensor probe. Reference numeral 52 represents an optional drive mechanism such as a motor or vibrating transducer for the first friction sensor probe. Reference Numeral 54 represents the operative connection between the first friction sensor probe and the drive mechanism. Reference Numeral 56 represents the second friction sensor probe. Reference numeral 58 represents an optional drive mechanism such as a motor or vibrating transducer for the second friction sensor probe. Reference Numeral 60 represents the operative connection between the second friction sensor probe and the drive mechanism. Reference Numeral 62 represents the carrier for the workpiece. Reference Numeral 64 represents the drive motor carrier for the carrier. Reference Numeral 70 represents the platen. Reference Numeral 102 represents preferred operative sensor connections from the first friction sensor probe, second friction sensor probe, and workpiece finishing assembly to the processor (Reference Numeral 104). Preferably the sensor connections are electrical connections. A data processor is a preferred processor and an electronic data processor is a more preferred data processor and a computer is an even more preferred processor. The processor (Reference Numeral 104) is preferably connected to a controller (Reference Numeral 108) with an operative processor to controller connection(s) represented by Reference Numeral 106. The controller is preferably in operative controlling connection (Reference Numeral 110) with the first friction sensor probe, the second friction sensor probe, and the workpiece finishing sensor subsystem and can adjust finishing control parameters during finishing the workpiece. An operative electrical connection is a preferred operative connection. An operative electromagnetic wave system such as operative infrared communication connections is another preferred operative connection. The controller can also adjust the operating friction probe control parameters such as, but not limited to, pressure exerted against the finishing element finishing surface and the friction probe friction sensor surface and related relative friction motion between the finishing element finishing surface and the friction probe friction sensor surface such as relative parallel motion. Preferred finishing control parameters are discussed elsewhere herein.

The semiconductor industry is in a relentless journey to increase computing power and decrease costs. Finishing of a semiconductor wafer using in situ calculations of cost of manufacture parameters to improve control finishing parameters can help simultaneously to decrease cost and reduce unwanted defects. In situ control of the operative finishing interface is particularly useful to help reduce cost of manufacture. Supplying a controlled organic boundary lubricant to the interface to control and/or adjust the coefficient of friction at the operative finishing interface can facilitate reducing surface defects and reducing the cost of manufacture. Using current cost of manufacture parameters along with a friction sensing method to evaluate and adjust the boundary layer lubrication in a manner that adjustably controls the coefficient of friction in the operative finishing interface can be particularly preferred at reducing unwanted surface defects such as microscratches and microchatter. This system is particularly preferred for finishing with fixed abrasive finishing elements. In addition generally helping to improve such parameters as equipment yield, parametric yield, and defect density, the "cuttability" or cut rate of the fixed abrasive finishing element can generally be extended which improves uptime or equipment utilization. The coefficient of friction in the operative finishing interface can change any number of times during a relatively short finishing cycle time making manual calculations ineffective. Further, the semiconductor wafer cost of manufacture parameters are relatively complex to calculate and the finishing process is relatively short thus manual calculations for equipment adjustment and control are even more difficult and ineffective. Controlling the process control parameters using an operative process sensor(s) operatively connected to a processor with access to cost of manufacture parameters are particularly preferred for real time process control to change the cost of manufacture. Controlling the process control parameters using an operative process sensor(s) operatively connected to a processor with access to cost of manufacture parameters are particularly preferred for real time process control to change the cost of manufacture of step upward while reducing the overall cost of manufacture of the semiconductor wafer. Controlling the process control parameters using an operative process sensor(s) operatively connected to a processor with access to cost of manufacture parameters are particularly preferred for real time process control to increase the cost of manufacture in at least one step while reducing the overall cost of manufacture of the semiconductor wafer. Controlling the process control parameters using an operative process sensor(s) operatively connected to a processor with access to cost of manufacture parameters are particularly preferred for real time process control to increase the cost of manufacture in at least two steps while reducing the overall cost of manufacture of the semiconductor wafer. Controlling the finishing during non-steady state time periods is preferred. Rapid, multiple adjustments of process control parameters using process sensors operatively connected to a processor with access to cost of manufacture parameters are particularly preferred for the rapid in situ process control of this invention which helps to increase computing power by, for instance, helping to attain higher yields in smaller feature sizes in the finished semiconductor wafer and decrease and/control manufacturing costs.

A finishing element finishing surface tends to have a higher friction than necessary with the workpiece being finished. The higher friction can lead to higher than necessary energy for finishing. The higher friction can lead to destructive surface forces on the workpiece surface being finished and on the finishing element finishing surface which can cause deleterious surface damage to the workpiece. The higher friction can lead to premature wear on the finishing element and even to the abrasive slurry particle wear. This premature wear on the finishing element and abrasive slurry particles can unnecessarily increase the cost of finishing a workpiece. Further the higher tangential frictional forces can cause mechanical failure in some semiconductor wafer such as those having a plurality of metal layers, even more particularly when low-k dielectric layers are also incorporated in the semiconductor wafer structure. Further, this higher than necessary friction can lead to higher than necessary changes in performance of the finishing element finishing surface during the finishing of a plurality of workpieces which makes process control more difficult and/or complex. Applicant currently believes that the higher than desirable number of defects in the workpiece surface being finished can at least partially be due to the fact that the abrasive particles in slurries although generally free to move about can become trapped in an elastomeric finishing element surface thus preventing rolling action and leading to a more fixed scratching type action. Further fixed abrasive finishing element surfaces can also scratch or damage of sensitive workpiece surface. Further, abrasive slurry particles which are not lubricated can tend to become dull or less effective at finishing the workpiece surface being finished which can reduce their effectiveness during finishing.

The new problem recognition of this invention and unique solution including, but not limited to, the unique methods of using cost of manufacture parameters, control methods, and in situ processor methods for optimization, and the new finishing methods and apparatus disclosed herein are considered part of the invention.

Finishing Element

A finishing element having a synthetic polymeric body is preferred. A synthetic polymeric body comprising at least one material selected from the group consisting of an organic synthetic polymer, an inorganic polymer, and combinations thereof is preferred. A preferred example of an organic synthetic polymer is a thermoplastic polymer. Another preferred example of an organic synthetic polymer is a thermoset polymer. An organic synthetic polymeric body comprising organic synthetic polymers including materials selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutadienes, polyisoprenes, EPDM elastomers, and styrene butadiene elastomers is preferred. Polyolefin polymers are particularly preferred for their generally low cost. A preferred polyolefin polymer is polyethylene. Another preferred polyolefin polymer is a propylene polymer. Another preferred polyolefin polymer is a ethylene propylene copolymer. Copolymer organic synthetic polymers are also preferred. Polyurethanes are preferred for their inherent flexibility in formulations. A finishing element comprising a foamed organic synthetic polymer is particularly preferred because of its flexibility and ability to transport the finishing composition. A finishing element comprising a foamed polyurethane polymer is particularly preferred. Foaming agents and processes to foam organic synthetic polymers are generally known in the art. A finishing element comprising a compressible porous material is preferred and comprising an organic synthetic polymer of a compressible porous material is more preferred.

A finishing element having a body element comprising a mixture of a plurality of organic synthetic polymers can be particularly tough, wear resistant, and useful. An organic synthetic polymeric body comprising a plurality of the organic synthetic polymers and wherein the major component is selected from materials selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutadienes, polyisoprenes, EPDM elastomers, and styrene butadiene elastomers is preferred. The minor component is preferably also an organic synthetic polymer and is preferably a modifying and/or toughening agent. A preferred example of an organic synthetic polymer modifier is a material which reduces the hardness or flex modulus of the finishing element body such as a polymeric elastomer. A compatibilizing agent can also be used to improve the physical properties of the polymeric mixture. Compatibilizing agents are often also synthetic polymers and have polar and/or reactive functional groups such as carboxylic acid, maleic anhydride, and epoxy groups. Organic synthetic polymers of the above descriptions are generally available commercially. Illustrative nonlimiting examples of commercial suppliers of organic synthetic polymers include Exxon Co., Dow Chemical, Sumitomo Chemical, and BASF.

A finishing element comprising a synthetic polymer composition having a plurality of layers is also preferred. A finishing element comprising at least one layer of a soft synthetic polymer is preferred. A finishing element comprising at least one layer of a elastomeric synthetic polymer is preferred. A finishing element comprising at least one layer of a thermoset elastomeric synthetic polymer is preferred.

The abrasive and fixed abrasive finishing surfaces can be used and preferred for some applications. Particular abrasive surface topographies can be preferred for specific applications. Fixed abrasive finishing elements are generally known to those skilled in the art. Some nonlimiting examples include U.S. Pat. No. 4,966,245 to Callinan, U.S. Pat. No. 5,692,950 to Rutherford, U.S. Pat. No. 5,823,855 to Robinson, WO 98/06541 to Rutherford and WO 98/181159 to Hudson and are included herein by reference in their entirety for general guidance and modification of fixed abrasive finishing elements by those skilled in the art. Illustrative nonlimiting examples of fixed abrasive polishing pads for semiconductor wafers are commercially available 3M Co. and Sony Corporation.

An abrasive finishing element having abrasive asperities on the finishing element finishing surface is preferred. An abrasive finishing element having abrasive asperities having a height from 0.5 to 0.005 micrometers is preferred and an abrasive finishing element having abrasive asperities having a height from 0.3 to 0.005 micrometers is more preferred and an abrasive finishing element having abrasive asperities having a height from 0.1 to 0.01 micrometers is even more preferred and an abrasive finishing element having abrasive asperities having a height from 0.05 to 0.005 micrometers is more particularly preferred. The asperities are preferably firmly attached to the finishing element finishing surface and asperities which are an integral part of the finishing element finishing surface are more preferred. An abrasive finishing element having small asperities can finish a workpiece surface to fine tolerances.

Optional Stabilizing Fillers for Finishing Element

A fibrous filler is a preferred stabilizing filler for the finishing elements of this invention. A plurality of synthetic fibers are particularly preferred fibrous filler. Fibrous fillers tend to help generate a lower abrasion coefficient and/or stabilize the finishing element finishing surface from excessive wear. By reducing wear the finishing element has improved stability during finishing.

Optional Finishing Element Abrasive Surface—Further Guidance

Abrasive finishing elements having abrasive particles, abrasive asperities, and/or compositions can be preferred for some types of finishing, particularly where disposal of spent slurry is an environmental issue. Inorganic abrasive particles comprise preferred abrasive particles. Organic synthetic particles comprise preferred abrasive particles. A fixed abrasive finishing element having abrasive asperities on the finishing surface is a preferred abrasive finishing element. Abrasive particles can be dispersed in the finishing element to make a low cost abrasive finishing element. Abrasive asperities can be molded into a finishing element surface with low cost and at high speed making them preferred for some applications.

The fixed abrasive firmly attached to the finishing element finishing surface is preferred. The abrasive can be firmly attached to the finishing element finishing surface with known adhesives and/or mixed into a surface layer of a polymeric layer, preferably an organic polymeric layer. Particular abrasive surface topographies can be preferred for specific applications. Fixed abrasive finishing elements are generally known to those skilled in the art. Some nonlimiting examples include U.S. Pat. No. 4,966,245 to Callinan, U.S. Pat. No. 5,692,950 to Rutherford, U.S. Pat. No. 5,823,855 to Robinson, WO 98/06541 to Rutherford and WO 98/181159 to Hudson are included herein for general guidance and modification of fixed abrasive finishing elements by those skilled in the art.

An abrasive finishing element having abrasive asperities on the finishing element finishing surface is preferred. An abrasive finishing element having abrasive asperities having a height from 0.5 to 0.005 micrometers is preferred and an abrasive finishing element having abrasive asperities having a height from 0.3 to 0.005 micrometers is more preferred and an abrasive finishing element having abrasive asperities having a height from 0.1 to 0.01 micrometers is even more preferred and an abrasive finishing element having abrasive asperities having a height from 0.05 to 0.005 micrometers is more particularly preferred. the asperities are preferably firmly attached to the finishing element finishing surface and asperities which are an integral part of the finishing element finishing surface are more preferred. An abrasive finishing element having small asperities can finish a workpiece surface to fine tolerances.

Workpiece

A workpiece needing finishing is preferred. A semiconductor wafer is particularly preferred. A homogeneous surface composition is a workpiece surface having one composition throughout and is preferred for some applications. A workpiece needing polishing is preferred. A workpiece needing planarizing is especially preferred. A workpiece having a microelectronic surface is preferred. A microelectronic part is a preferred workpiece. A microelectronic component is another preferred workpiece. A workpiece surface having a heterogeneous surface composition is preferred. A heterogeneous surface composition has different regions with different compositions on the surface, further the heterogeneous composition can change with the distance from the surface. Thus finishing can be used for a single workpiece whose surface composition changes as the finishing process progresses. A semiconductor wafer surface having a heterogeneous surface composition is preferred. A heterogeneous surface composition having different regions with different compositions on the surface is a preferred heterogeneous surface. A heterogeneous surface having different local topographies such as unwanted raised regions is a preferred heterogeneous surface. An example of a heterogeneous surface is a surface having regions of high conductivity and regions of lower conductivity. A semiconductor wafer surface having a repeating pattern of reflective surfaces can be a preferred workpiece surface. A wafer die having a repeating pattern of reflective surfaces can be a preferred workpiece surface. A semiconductor wafer surface is a preferred workpiece. A heterogeneous surface uncovered during semiconductor wafer processing such as a heterogeneous interface having regions of high conductivity and lower conductivity is a preferred heterogeneous surface. A workpiece having a microelectronic surface having both conductive regions and nonconductive regions is more preferred and is an example of a preferred heterogeneous workpiece surface. Illustrative examples of conductive regions can be regions having copper or tungsten and other known conductors, especially metallic conductors. Metallic conductive regions in the workpiece surface consisting of metals selected from the group consisting of copper, aluminum, and tungsten or combinations thereof are particularly preferred. A semiconductor device is a preferred workpiece. A substrate wafer is a preferred workpiece. A semiconductor wafer having a polymeric layer requiring finishing is preferred because a lubricating aid can be particularly helpful in reducing unwanted surface damage to the softer polymeric surfaces. An example of a preferred polymer is a polyimide. Polyimide polymers are commercially available from E. I. DuPont Co. in Wilmington, Del.

This invention is particularly preferred for workpieces requiring a highly flat surface. Finishing a workpiece surface to meet the specified semiconductor industry circuit design rule is preferred and finishing a workpiece surface to meet the 0.35 micrometers feature size semiconductor design rule is more preferred and finishing a workpiece surface to meet the 0.25 micrometers feature size semiconductor design rule is even more preferred and finishing a workpiece surface to meet the 0.18 micrometers semiconductor design rule is even more particularly preferred. An electronic wafer finished to meet a required surface flatness of the wafer device rule in to be used in the manufacture of ULSIs (Ultra Large Scale Integrated Circuits) is a particularly preferred workpiece made with a method according to preferred embodiments of this invention. The design rules for semiconductors are generally known to those skilled in the art. Guidance can also be found in the "The National Technology Roadmap for Semiconductors" published by SEMATECH in Austin, Tex.

A semiconductor wafer having a diameter of at least 200 mm is preferred and a semiconductor wafer having a diameter of at least 300 mm is more preferred. As the semiconductor wafer become larger, it becomes more valuable which makes higher yields very desirable.

Supplying an aqueous lubricating composition to a semiconductor wafer having a diameter of at least 200 mm is preferred and supplying an aqueous lubricating composition to a semiconductor wafer having a diameter of at least 300 mm is more preferred. Supplying an aqueous lubricating composition having a lubricant to a semiconductor wafer having a diameter of at least 200 mm is even more preferred and supplying aqueous lubricating having a lubricant to a semiconductor wafer having a diameter of at least 300 mm is more preferred. Large semiconductor wafers can generally be finished more effectively with an aqueous lubricating composition, particularly one having lubricant. Friction, heat generation, manufacturing costs can be more effectively controlled with the sensors and methods disclosed herein.

Using cost of manufacture parameters to improve control of the planarizing of a semiconductor wafer having a low-k layer is preferred and of a semiconductor wafer having a multiplicity of low-k layers is more preferred. For finishing of semiconductor wafers having low-k dielectric layers (low dielectric constant layers), finishing aids, more preferably lubricating aids, are preferred. Illustrative nonlimiting examples of low-k dielectrics are low-k polymeric materials, low-k porous materials, and low-k foam materials. As used herein, a low-k dielectric has at most a k range of less than 3.5 and more preferably less than 3.0 and even more preferably less than 2.5 and even more especially preferred is less than 2.0. Illustrative examples include doped oxides, organic polymers, highly fluorinated organic polymers, and porous materials. Low-k dielectric materials are generally known to those skilled in the semiconductor wafer arts. Abrasive organic synthetic resin particles can be effective to finishing low-dielectric materials. Abrasive organic synthetic resin asperities can be effective to finishing low-dielectric materials. Multilevel semiconductor wafers such as those having low-k dielectric layers and multilevel metal layers are generally known by those skilled in the semiconductor arts and U.S. Pat. No. 6,153,833 to Dawson et al. is included herein by reference for general non-limiting guidance for those skilled in the art. Since low-k dielectric layers generally have lower mechanical strength, the lower coefficient of friction that is offered by organic lubricating boundary layers is particularly preferred. A semiconductor wafer having a plurality of low-k dielectric layers is a preferred workpiece and a semiconductor wafer having at least 3 of low-k dielectric layers is a more preferred workpiece and a semiconductor wafer having at least 5 of low-k dielectric layers is an even more preferred workpiece. Supplying a lubricant to a plurality of low-k dielectric layers during finishing of the same semiconductor wafer is preferred and supplying a lubricant to at least 3 of low-k dielectric layers during finishing of the same semiconductor wafer is more preferred and supplying a lubricant to at least 5 of low-k dielectric layers during finishing of the same semiconductor wafer is even more preferred. A semiconductor wafer having at most 10 low-k dielectric layers is currently preferred but in the future this can increase. Semiconductor wafers for logic integrated circuits are particularly preferred. Defects caused during finishing can be reduced by supplying a lubricant.

A semiconductor wafer having a plurality of metal layers is a preferred workpiece and a semiconductor wafer having at least 3 of metal layers is a more preferred workpiece and a semiconductor wafer having at least 5 of metal layers is an even more preferred workpiece. A semiconductor wafer having at most 10 metal layers is currently preferred but in the future this will increase. A semiconductor wafer having logic chips or logic die is particularly preferred because they can have multiple metal layers for supplying lubricants such as preferred lubricants during finishing. Supplying a lubricant to a plurality of finishing layers of the same semiconductor wafer is preferred and supplying a lubricant to at least 3 of finishing layers of the same semiconductor wafer is more preferred and supplying a lubricant to at least 5 of finishing layers of the same semiconductor wafer is more preferred. Defects caused during finishing can be reduced by supplying a lubricant. Further, defects in the first finished layer can cause defects in the second finished layer (and so on). Thus by supplying a lubricant during finishing, one can improve yields by minimizing unwanted defects in both the current and subsequent layers.

A method which updates the cost of manufacture control parameters, look-up tables, algorithms, or control logic consistent with the current manufacturing step is preferred. The semiconductor wafer can be tracked for each finishing step during processing with a tracking means such as tracking code. As an illustrative example, a semiconductor wafer can be assigned with a trackable UPC code. U.S. Pat. No. 5,537,325 issued to Iwakiri, et al., on Jul. 16, 1997 teaches a method to mark and track semiconductor wafers sliced from an ingot through the manufacturing process and is included for by reference in its entirety for general guidance and appropriate modification by those skilled in the art. Further nonlimiting examples of bar and/or tracking codes are found in U.S. Pat. No. 5,567,927 to Kahn et al., and U.S. Pat. No. 5,883,374 to Mathews and are included herein in there entirety for general guidance and appropriate modification by those skilled in the art. As a further nonlimiting example, Cognex Corporation in Natick, Mass. markets commercial tacking means for tracking semiconductor wafers. As further illustration of preferred tracking codes include 2D matrix (such as SEMI 2D matrix), alphanumeric, and bar codes. Processes, performance, and preferred refining conditions and information can be tracked and stored by wafer (and/or wafer batches) with this technology when used with the new disclosures herein.

A semiconductor wafer having logic chips is preferred. A semiconductor wafer having memory chips is preferred. A DRAM is a preferred memory chip. An SRAM is a preferred memory chip. A digital signal processor (DSP) is a preferred semiconductor chip. A microprocessor is a preferred semiconductor chip. Telecommunications chips are a preferred semiconductor chip. A semiconductor chip having a plurality of metal layers is a preferred semiconductor chip. An optoelectronic chip is a preferred semiconductor chip. An SOC (System On a Chip) is a preferred semiconductor chip. A semiconductor wafer planarized in a foundry having manufacturing multiple types of semiconductor wafers is also preferred. Semiconductor chips are generally known to those skilled in the art. As non-limiting example U.S. Pat. No. 6,150,190 to Stankus is included herein by reference in its entirety along with other planarizing references for guidance and modification by those skilled in the art. These Boundaries generally have complex product lines and improvements to the cost of manufacture is very helpful in getting and/or retaining customers. Each of these semiconductor chips have multiple processing steps including various planarizing steps during manufacture and generally reducing the cost of manufacture and/or improving performance at the same cost will are expected to enhance profits for the manufacturer.

A workpiece which is manufactured in a multiplicity of separate manufacturing steps is preferred. A workpiece which is manufactured in a multiplicity of separate and distinct manufacturing steps is more preferred. A workpiece which is manufactured in at least 10 separate manufacturing steps is preferred. A workpiece which is manufactured in at least 10 separate and distinct manufacturing steps is more preferred. A workpiece which is manufactured in at least 25 separate manufacturing steps is preferred. A workpiece which is manufactured in at least 25 separate and distinct manufacturing steps is more preferred. A workpiece manufactured in steps which comprise preferred non-equilibrium process control is preferred. A workpiece manufactured in steps which include a finishing step comprising non-equilibrium process control is preferred. A workpiece manufactured in steps which include a plurality of finishing steps comprising non-equilibrium process control is more preferred. A workpiece manufactured in steps which include at least three of finishing steps comprising non-equilibrium process control is more preferred. A workpiece manufactured in steps which include a finishing step having a portion of the step in non-steady state is preferred. A workpiece manufactured in steps which include a plurality of finishing steps having a portion of the step in non-steady state is more preferred. A workpiece manufactured in steps which include at least three of finishing steps having a portion of the step in non-steady state is more preferred. Determining a change for a process control parameter with progress of finishing information and changing a process control parameter while a process is in a non-steady state is preferred for some process control operations. Determining a change for a process control parameter with progress of finishing information and changing a process control parameter while a process is in a non-equilibrium time period of change is preferred for some process control operations. An illustrative example of non-steady state processing time period is the partial clearing of a conductive layer from a nonconductive layer. During this period of clearing the surface composition (refining) of the workpiece generally has a surface composition changing during a non-steady time period. During this period of clearing the surface composition (refining) of the workpiece can have frictional and/or differential frictional changes during a non-steady time period.

Finishing Composition

Finishing compositions such as CMP slurries are generally known for finishing workpieces. A chemical mechanical polishing slurry is an example of a preferred finishing composition. Finishing compositions that have their pH adjusted carefully, and generally comprise other chemical additives are used to effect chemical reactions and/or other surface changes to the workpiece. A finishing composition having dissolved chemical additives is particularly preferred. Finishing compositions having small abrasive particles in a slurry are preferred for many applications. Illustrative preferred examples include dissolved chemical additives include dissolved acids, bases, buffers, oxidizing agents, reducing agents, stabilizers, and chemical reagents. A finishing composition having a chemical which substantially reacts with material from the workpiece surface being finished is particularly preferred. A finishing composition chemical which selectively chemically reacts with only a portion of the workpiece surface is particularly preferred. A finishing composition having a chemical which preferentially chemically reacts (or interacts) with only a portion of the workpiece surface is particularly preferred.

Some illustrative nonlimiting examples of polishing slurries which can be used and/or modified by those skilled in the art are now discussed. An example slurry comprises water, a solid abrasive material and a third component selected from the group consisting of $HNO_3$, $H_2SO_4$, and $AgNO_3$ or mixtures thereof. Another polishing slurry comprises water, aluminum oxide, and hydrogen peroxide mixed into a slurry. Other chemicals such as KOH or potassium hydroxide can also be added to the above polishing slurry. Still another illustrative polishing slurry comprises $H_3PO_4$ at from about 0.1% to about 20% by volume, $H_2O_2$ at from 1% to about 30% by volume, water, and solid abrasive material. Still another polishing slurry comprises an oxidizing agent such as potassium ferricyanide, and an abrasive such as silica, and has a pH of between 2 and 4. Still another polishing slurry comprises high purity fine metal oxide particles uniformly dispersed in a stable aqueous medium. Still another polishing slurry comprises a colloidal suspension of $SiO_2$ particles having an average particle size of between 20 and 50 nanometers in alkali solution, demineralized water, and a chemical activator. U.S. Pat. No. 5,209,816 to Yu et. al. issued in 1993, U.S. Pat. No. 5,354,490 to Yu et. al. issued in 1994, U.S. Pat. No. 5,5408,810 to Sandhu et. al. issued in 1996, U.S. Pat. No. 5,516,346 to Cadien et. al. issued in 1996, U.S. Pat. No. 5,527,423 to Neville et. al. issued in 1996, U.S. Pat. No. 5,622,525 to Haisma et. al. issued in 1997, and U.S. Pat. No. 5,645,736 to Allman issued in 1997 comprise illustrative nonlimiting examples of slurries contained herein for further general guidance and modification by those skilled in the arts. Commercial CMP polishing slurries are also available from Rodel Manufacturing Company in Newark, Del. Finishing compositions free of abrasives are also generally known to those skilled in the CMP arts.

Finishing Aid

Supplying an effective amount of finishing aid, more preferably a lubricating aid, which reduces the coefficient of friction between the finishing element finishing surface and the workpiece surface being finished is preferred. Supplying an effective amount of finishing aid, more preferably a lubricating aid, which reduces the unwanted surface damage to the surface of the workpiece being finished during finishing is preferred. Supplying an effective amount of finishing aid, more preferably a lubricating aid, which differentially lubricates different regions of the workpiece and reduces the unwanted surface damage to at least a portion of the surface of the workpiece being finished during finishing is preferred.

The finishing aid, more preferably a lubricating aid, can help reduce the formation of surface defects for high precision part finishing. Fluid based finishing aid, more preferably a lubricating aid, can be incorporated in the finishing element finishing surface. A method of finishing which adds an effective amount of fluid based finishing aid, more preferably a lubricating aid, to the interface between the finishing element finishing surface and workpiece surface being finished is preferred. A preferred effective amount of fluid based finishing aid, more preferably a lubricating aid, reduces the occurrence of unwanted surface defects. A preferred effective amount of fluid based finishing aid, more preferably a lubricating aid, reduces the coefficient of friction between the work piece surface being finished and the finishing element finishing surface.

A lubricating aid which is water soluble is preferred for many applications. An organic boundary layer lubricant which comprises a water soluble organic boundary layer lubricant is preferred and which consists essentially of a water soluble organic boundary layer lubricant is more preferred and which consists of a water soluble organic boundary layer lubricant is even more preferred. A lubricating aid which has a different solubility in water at different temperatures is more preferred. A degradable finishing aid, more preferably a lubricating aid, is also preferred and a biodegradable finishing aid, more preferably a lubricating aid, is even more preferred. An environmentally friendly finishing aid, more preferably a lubricating aid, is particularly preferred.

Certain particularly important workpieces in the semiconductor industry have regions of high conductivity and regions of low conductivity. The higher conductivity regions are often comprised of metallic materials such as tungsten, copper, aluminum, and the like. An illustrative example of a common lower conductivity region is silicon or silicon oxide. A lubricant which differentially lubricates the two regions is preferred and a lubricant which substantially lubricates two regions is more preferred. An example of a differential lubricant is if the coefficient of friction is changed by different amounts in one region versus the other region during finishing. For instance one region can have the coefficient of friction reduced by 20% and the other region reduced by 40%. This differential change in lubrication can be used to help in differential finishing of the two regions. An example of differential finishing is a differential finishing rate between the two regions. For example, a first region can have a finishing rate of "X" angstroms/minute and a second region can have a finishing rate of "Y" angstroms per minute before lubrication and after differential lubrication, the first region can have a finishing rate of 80% of "X" and the second region can have a finishing rate of 60% of "Y". Different regions can have different lubricating boundary layer (or lubricating film) thicknesses. An example of where this will occur is when the lubricant tends to adhere to one region because of physical or chemical surface interactions (such as a metallic conductive region) and adhere or not adhere as tightly to the an other region (such as a non metallic, non conductive region). Changing the finishing control parameters to change the differential lubrication during finishing of the workpiece is a preferred method of finishing. Changing the finishing control parameters to change the differential lubrication during finishing of the workpiece which in turn changes the regional finishing rates in the workpiece is a more preferred method of finishing. Changing the finishing control parameters with in situ process control to change the differential lubrication during finishing of the workpiece which in turn changes the region finishing rates in the workpiece is an even more preferred method of finishing. The friction sensor probes play an important role in detecting and controlling differential lubrication in the workpieces having heterogeneous surface compositions needing finishing.

Changing the lubrication at least once during the finishing cycle time to change the coefficient of friction between the finishing element finishing surface and the workpiece surface being finished is preferred. Changing the lubrication a plurality of times during the finishing cycle time to change the coefficient of friction between the finishing element finishing surface and the workpiece surface being finished a plurality of times during the finishing cycle time is more preferred. Changing the amount of lubricant at the operative finishing interface is a preferred method to change the lubrication. Changing the composition of the lubricant at the operative finishing interface is a preferred method to change the lubrication. Changing the number of lubricants in the operative finishing interface is a preferred method to change the lubrication. Changing the number of organic lubricating boundary layers in the operative finishing interface is a preferred method to change the lubrication. Changing the composition of organic lubricating boundary layer(s) at the operative finishing interface is a preferred method to change the lubrication. Changing the number of organic lubricating films in the operative finishing interface is a preferred method to change the lubrication. Changing the composition of organic lubricating film(s) in the operative finishing interface is a preferred method to change the lubrication. Changing the form of the organic lubricating boundary layer(s) is a preferred method to change the lubrication. Changing the form of the organic lubricating film(s) is a preferred method to change the lubrication. Supplying an effective amount of lubricant which reduces the unwanted surface damage to the surface of the workpiece being finished during finishing is preferred. Changing the lubrication during the finishing cycle time can improve finishing control and improve finishing performance, particularly where using in situ control as discussed elsewhere herein Changing lubrication in situ with a control subsystem is particularly preferred. Changing the coefficient of friction in a uniform region of the workpiece is preferred and changing the coefficient of friction in a plurality of uniform regions of the workpiece is more preferred.

A plurality of operative sensors, preferably friction sensors, can aid in an important way in detecting and controlling differential lubrication in the workpieces having heterogeneous surface compositions needing finishing. Differential lubrication with a plurality of lubricants can be preferred because it can improve lubrication and coefficient of friction control. Differential lubrication with a plurality of organic lubricating films can be more preferred because it can further improve lubrication and coefficient of friction control. Differential lubrication with a plurality of organic lubricating boundary layers can be even more preferred because it can further improve lubrication and coefficient of friction control.

An organic lubricating film which interacts with the semiconductor wafer surface is preferred. An organic lubricating film which adheres to the semiconductor wafer surface is preferred. An organic lubricating film which interacts with and adheres to the semiconductor wafer surface is more preferred. An organic lubricating film which interacts with the uniform region of the semiconductor wafer surface is preferred. An organic lubricating film which adheres to the uniform region of the semiconductor wafer surface is preferred. An organic lubricating film which interacts with and adheres to the uniform region of the semiconductor wafer surface is more preferred. A uniform functional region is a preferred uniform region. A conductive region is a preferred uniform functional region. A nonconductive region is a preferred uniform functional region. By having the organic lubricating film interact with and adhere to a uniform region of the semiconductor wafer surface, localized finishing control can be improved and unwanted surface defects can generally be reduced using the teaching and guidance herein.

A lubricant comprising a reactive lubricant is preferred. A reactive organic lubricant is preferred. A reactive organic lubricating film is more preferred. A lubricant comprising a boundary lubricant is also preferred. A reactive lubricant is a lubricant which chemically reacts with the workpiece surface being finished. A lubricant free of sodium is a preferred lubricant.

An organic lubricant is a preferred lubricant. A lubricant which forms a thin lubricant film on the metal conductor portion of a workpiece surface being finished is particularly preferred. A nonlimiting preferred group of example organic boundary layer lubricants include at least one lubricant selected from the group consisting of fats, fatty acids, esters, and soaps. A phosphorous containing compound can be an effective preferred boundary lubricant. A phosphate ester is an example of a preferred phosphorous containing compound which can be an effective boundary lubricant. A chlorine containing compound can be an effective preferred boundary lubricant. A sulfur containing compound can be an effective preferred boundary lubricant. A nitrogen containing compound can be an effective preferred boundary lubricant. An amine derivative of a polyglycol can be a preferred boundary lubricant. A diglycol amine is a preferred amine derivative of a polyglycol. A compound containing atoms selected from the group consisting of at least one of the following elements oxygen, fluorine, nitrogen, or chlorine can be a preferred lubricant. A compound containing atoms selected from the group consisting of at least two of the following elements oxygen, fluorine, nitrogen, or chlorine can be a more preferred lubricant. A synthetic organic polymer containing atoms selected from the group consisting of at least one of the following elements oxygen, fluorine, nitrogen, or chlorine can be a preferred an organic boundary layer lubricant. A synthetic organic polymer containing atoms selected from the group consisting of at least two of the following elements oxygen, fluorine, nitrogen, or chlorine can be a more preferred an effective organic boundary layer lubricant. A synthetic organic polymer containing atoms selected from the group consisting of at least two of the following elements oxygen, fluorine, nitrogen, or chlorine can be a preferred organic boundary layer lubricant. A sulfated vegetable oil and sulfurized fatty acid soaps are preferred examples of a sulfur containing compound can be preferred organic boundary layer lubricants. Organic boundary layer lubricant and lubricant chemistries are discussed further herein below. A lubricant which reacts physically with at least a portion of the workpiece surface being finished is a preferred lubricant. A lubricant which reacts chemically with at least a portion of the workpiece surface being finished is often a more preferred lubricant because it is often a more effective lubricant and can also aid at times directly in the finishing. A lubricant which reacts chemically with at least a portion of the workpiece surface being finished and which is non-staining is a particularly preferred lubricant because it is often a more effective lubricant, is generally easily cleaned from the workpiece, and can also aid directly in the finishing as discussed herein.

Lubricants which are polymeric can be very effective lubricants. Supplying a lubricant to the interface of the workpiece surface being finished and the finishing element finishing surface wherein the lubricant is from 0.1 to 15% by weight of the total fluid between the interface is preferred and from 0.2 to 12% by weight of the total fluid between the interface is more preferred and from 0.3 to 12% by weight of the total fluid between the interface is even more preferred and from 0.3 to 9% by weight of the total fluid between the interface is even more particularly preferred. These preferred ranges are given for general guidance and help to those skilled in the art. Lubricants outside this range are currently believed to be useful but not as economical to use.

A lubricant having functional groups containing elements selected from the group consisting of chlorine, sulfur, and phosphorous is preferred and a boundary lubricant having functional groups containing elements selected from the group consisting of chlorine, sulfur, and phosphorous is more preferred. A lubricant comprising a fatty acid substance is a preferred lubricant. A preferred example of a fatty substance is a fatty acid ester or salt. Fatty acid salts of plant origin can be particularly preferred. A lubricant comprising a synthetic polymer is preferred and a lubricant comprising a boundary lubricant synthetic polymer is more preferred and a lubricant comprising a boundary lubricant synthetic polymer and wherein the synthetic polymer is water soluble is even more preferred. A polymer having a number average molecular weight from 400 to 150,000 is preferred and one having a number average molecular weight from 1,000 to 100,000 is more preferred and one having a number average molecular weight from 1,000 to 50,000 is even more preferred.

A lubricant comprising a polyalkylene glycol polymer is a preferred composition. A polymer of polyoxyalkylene glycol monoacrylate or polyoxyalkylene glycol monomethacrylate is very useful as a base of lubricant. A polyethylene glycol having a molecular weight of 400 to 1000 is preferred. Polyglycols selected from the group polymers consisting of ethylene oxide, propylene oxide, and butylene oxide and mixtures thereof are particularly preferred. A fatty acid ester can be an effective lubricant.

A polyglycol is an example of a preferred finishing aid. Preferred polyglycols include glycols selected from the group consisting of polyethylene glycol, an ethylene oxide-propylene butyl ethers, a diethylene glycol butyl ethers, ethylene oxide-propylene oxide polyglycol, a propylene glycol butyl ether, and polyol esters. A mixture of polyglycols is a preferred finishing aid. Alkoxy ethers of polyalkyl glycols are preferred finishing aids. An ultra high molecular weight polyethylene, particularly in particulate form, is an example of preferred finishing aid. A fluorocarbon resin is an example of a preferred lubricating agent. Fluorocarbons selected from the group consisting of polytetrafluoroethylene (PTFE), ethylene tetrafluoride/propylene hexafluoride copolymer resin (FEP), an ethylene tetrafluoride/perfluoroalkoxyethylene copolymer resin (PFA), an ethylene tetra fluoride/ethylene copolymer resin, a trifluorochloroethylene copolymer resin (PCTFE), and a vinylidene fluoride resin are examples of preferred fluorocarbon resin finishing aids. A polyphenylene sulfide polymer is a preferred polymeric lubricating aid. Polytetrafluoroethylene is a preferred finishing aid. Polytetrafluoroethylene in particulate form is a more preferred finishing aid and polytetrafluoroethylene in particulate form which resists reaggolmeration is a even more preferred finishing aid. A silicone oil is a preferred finishing aid. A polypropylene is a preferred finishing aid, particularly when blended with polyamide and more preferably a nylon 66. A lubricating oil is a preferred finishing aid. A polyolefin polymer can be a preferred effective lubricating aid, particularly when incorporated into polyamide resins and elastomers. A high density polyethylene polymer is a preferred polyolefin resin. A polyolefin/polytetrafluoroethylene blend is also a preferred lubricating aid. Low density polyethylene can be a preferred lubricating aid. A fatty acid substance can be a preferred lubricating aid. An examples of a preferred fatty acid substance is a fatty ester derived from a fatty acid and a polyhydric alcohol.

Examples fatty acids used to make the fatty ester are lauric acid, tridecylic acid, myristic acid, pentadecylic acid, palmitic acid, margaric acid, stearic acid, nonadecylic acid, arachidic acid, oleic acid, elaidic acid and other related naturally occurring fatty acids and mixtures thereof. Examples of preferred polyhydric alcohols include ethylene glycol, propylene glycol, homopolymers of ethylene glycol and propylene glycol or polymers and copolymers thereof and mixtures thereof.

Illustrative, nonlimiting examples of useful lubricants and systems for use in lubricated finishing element finishing surface systems and general useful related technology are given in the U.S. Pat. No. 3,287,288 to Reilling, U.S. Pat. No. 3,458,596 to Eaigle, U.S. Pat. No. 4,877,813 to Jimo et. al., U.S. Pat. No. 5,079,287 to Takeshi et. al., U.S. Pat. No. 5,110,685 to Cross et. al., U.S. Pat. No. 5,216,079 to Crosby et. al., U.S. Pat. No. 5,523,352 to Janssen, and U.S. Pat. No. 5,591,808 to Jamison and are included herein by reference in their entirety for guidance and modification as appropriate by those skilled in the art. Further illustrative, non limiting examples of useful lubricants and fluid delivery systems and general useful related technology are given in U.S. Pat. No. 4,332,689 to Tanizaki, U.S. Pat. No. 4,522,733 to Jonnes, U.S. Pat. No. 4,544,377 to Schwen, U.S. Pat. No. 4,636,321 to Kipp et. al., U.S. Pat. No. 4,767,554 to Malito et. al., U.S. Pat. No. 4,950,415 to Malito, U.S. Pat. No. 5,225,249 to Biresaw, U.S. Pat. No. 5,368,757 to King, U.S. Pat. No. 5,401,428 to Kalota, U.S. Pat. No. 5,433,873 to Camenzind, U.S. Pat. No. 5,496,479 to Videau et. al., and U.S. Pat. No. 5,614,482 to Baker et. al. are included for guidance and modification by those skilled in the art and are included by reference in their entirety herein. It is also understood that the lubricants and lubricant systems can be combined in many different ways in this invention to produce useful finishing results given the new guidance herein.

Some preferred suppliers of lubricants include Dow Chemical, Huntsman Corporation, and Chevron Corporation. An organic boundary layer lubricant consisting essentially of carbon, hydrogen, and oxygen is a particularly preferred lubricant. Organic boundary layer lubricants which are water soluble are also preferred and organic boundary layer lubricants free of mineral oils and vegetable oils can be preferred for applications where long term stability is especially preferred such as in slurry recycle applications.

Marginal Lubrication

Figure 6:
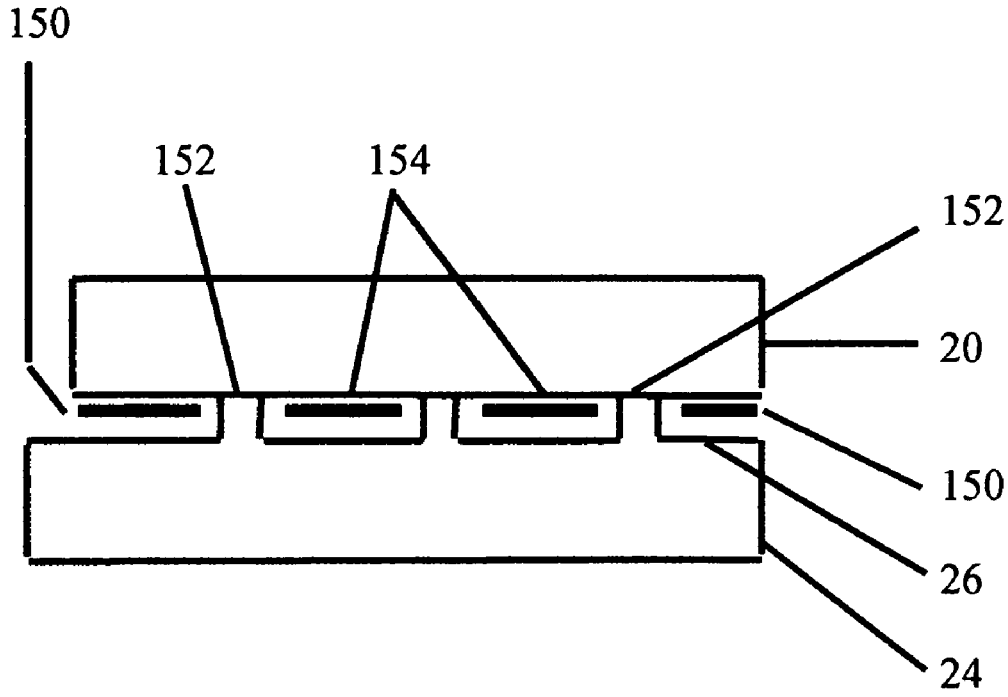
FIG. 6 is an artist's representation of a micro-region of the operative finishing interface showing some of the regions having an effective organic boundary layer lubrication and some of the regions being free of organic boundary lubrication

FIG. 6 is an artist's representation of a micro-region of the operative finishing interface showing some of the regions having an effective organic boundary layer lubrication and some of the regions being free of the organic boundary lubrication. Reference Numeral 20 represents the workpiece being finished. Reference Numeral 24 represents the finishing element. Reference Numeral 26 represents the finishing element finishing surface. Reference Numeral 150 represents the effective organic boundary layer lubrication during finishing. The organic boundary layer lubrication does not effectively lubricate the entire workpiece surface being finished in this invention. Reference Numeral 152 represents regions where the workpiece surface is free of the organic boundary layer lubrication. Reference Numeral 154 represents regions where the workpiece surface is effectively lubricated with organic boundary layer lubrication. It is useful to understand that organic boundary layer lubricated regions can be very small and the preferred organic boundary layer lubricant can be very thin, such as a boundary layer from one to a few molecular layers of an organic boundary lubricating layer. The regions and thickness of the organic boundary layer lubrication are not drawn to scale in FIG. 6 in order to better illustrate particularly preferred aspects of the organic boundary layer lubrication when finishing workpieces according to this invention.

As used herein, the coefficient of friction is defined in the normal manner, that is the coefficient of friction (COF) is equal to the friction force (ff) divided by the load (L). As used in this specification a marginal organic boundary lubrication layer is a term used to describe a surface which effectively has at least one region which has an effective boundary lubrication layer and at least one region which is effectively free of a boundary lubrication layer. An Effective Coefficient of Friction (ECOF) is a term used herein to help define and control marginal lubrication. Equation ECOF_A1 will now be given which defines Effective Coefficient of Friction as used herein.

$$ECOF=(COF_LF)(FFOBL)+(1-FFOBL)\ (COF_L)$$

where:

ECOF=Effective Coefficient of Friction

FFOBL=surface area Fraction Free of Organic Boundary Layer lubrication

COF_LF=coefficient of friction for surface lubricant free (free of organic boundary layer lubricant)

COF_L=coefficient of friction for surface with lubricant (having an organic boundary layer lubricant)

Figure 7:
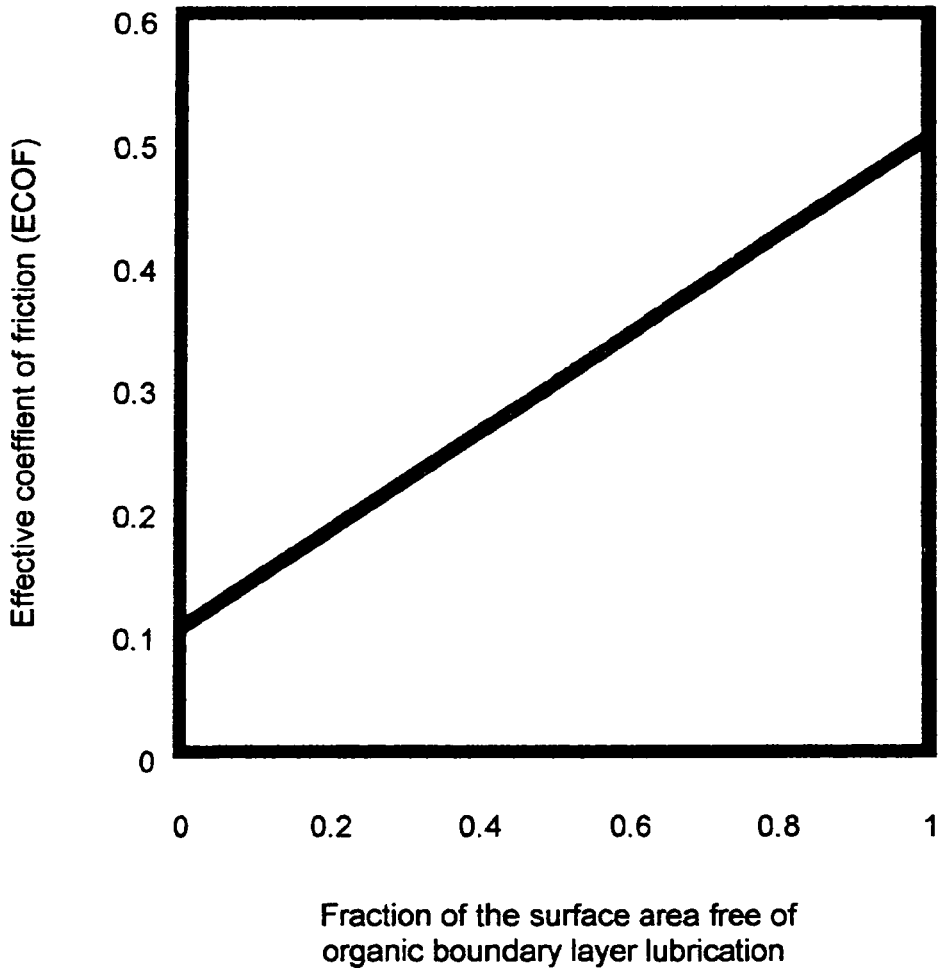
FIG. 7 is a graph of the effective COF vs the fraction of the surface area free of organic boundary lubricant layer

To further illustrate, an example will now be given. In the example an organic boundary lubricant layer free region has a COF_LF of 0.5 and an FFOBL (surface area Fraction Free of Organic Boundary Layer lubrication) of 0.15. In the example a organic boundary lubricant layer region has a COF_L of 0.1 and looking to the equation above, the organic boundary layer lubricant covers a surface area fraction of 0.85. Further, the ECOF is calculated to be 0.16. Thus the ECOF with changes in COF_LF, COF_L, and FFOBL. FIG. 7 is a calculated graph of the change of the Effective Coefficient of Friction versus the fraction of the operative finishing surface interface which is free of an organic boundary lubricant wherein the coefficient of friction for the organic boundary layer lubricated semiconductor wafer surface is 0.1 and the coefficient of friction for the semiconductor wafer surface free of organic boundary lubricant is 0.5. If a heterogeneous semiconductor wafer surface is being finished, the terms for each of the uniform regions on the surface can be defined and can be used by those skilled in the art. A friction sensing method along with appropriate calculations from a processor can be used to advantage to selectively control the ECOF in a designated region or type of region as will be discussed herein below. Finishing in preferred value ranges of the effective coefficient of friction is an useful aspect of this invention. Using the effective coefficient of friction to manage, control, and improve finishing results by reducing unwanted surface defects and improving semiconductor wafer processing costs is an useful preferred embodiment of this invention. Using the effective coefficient of friction to control in situ, real time finishing is particularly preferred.

Figure 8:
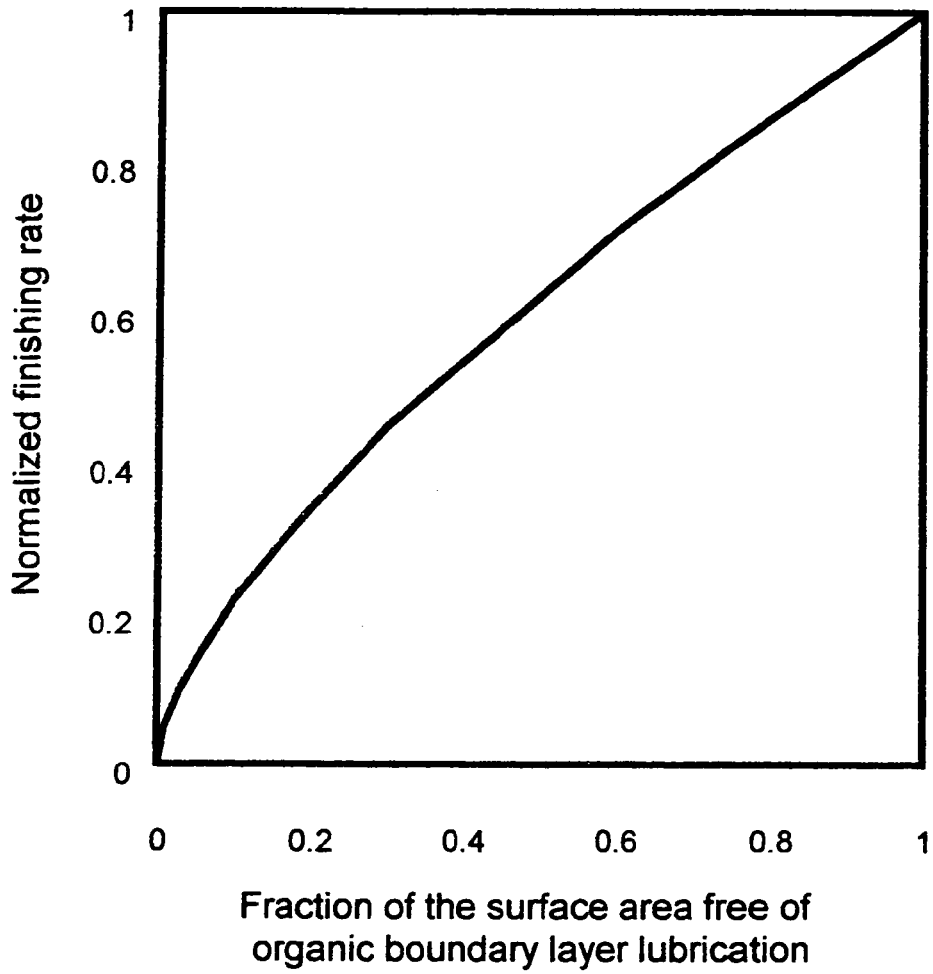
FIG. 8 is a plot of the normalized finishing rate as a function of surface area free of organic boundary layer lubrication
Figure 9:
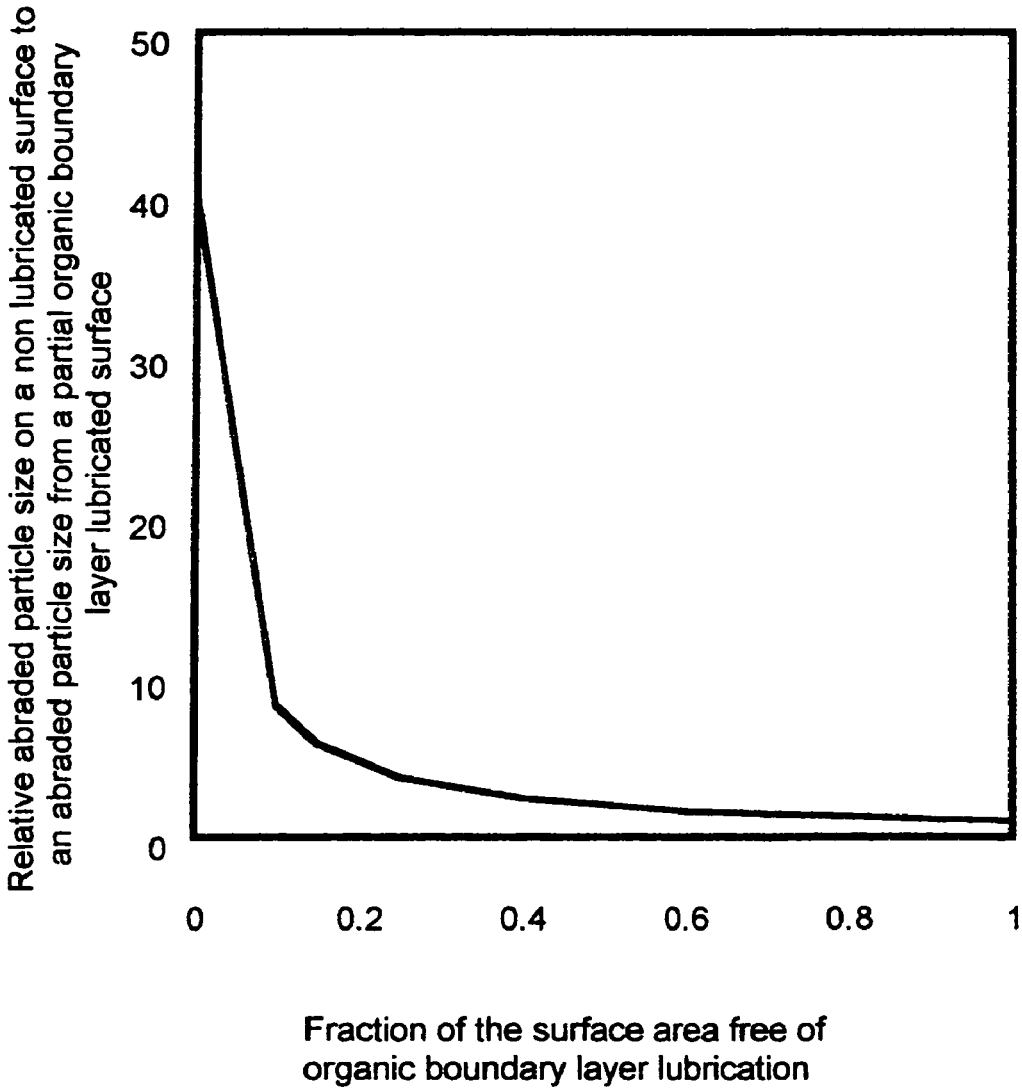
FIG. 9 is a plot of relative abraded particle size on a non lubricated surface to the abraded particle size on an organic boundary layer lubricated surface vs. fraction of the surface area free of organic boundary layer lubrication

Adjusting the Effective Coefficient of Friction is a particularly preferred calculated control parameter to optimize both quality of the semiconductor surface being finished and the finishing rate as well as the cost of ownership to finish the semiconductor wafer surface. The finishing rate can be calculated to show an expected normalized finishing rate as a function of the change in this calculated Effective Coefficient of Friction. The results of these calculations are shown in FIG. 8. It is useful to note that the finishing rate is non linear. There is a surprising increase in finishing rate where the workpiece surface area fraction free of organic boundary layer lubrication is from about 0.001 to 0.25. It is further important to note ECOF can be used as shown in FIG. 7 (and the equation above) to adjustably control the work piece surface area free of the organic boundary layer lubrication in FIG. 8. Another useful consideration is the quality of the semiconductor surface being finished. Large workpiece particles removed during the operative finishing motion can scratch, gouge, or otherwise damage the workpiece surface during finishing. Therefore, it is useful to reduce the size the workpiece particles removed during the operative finishing motion. Further, the quality of the surface finish is generally related to the size of the workpiece particles removed during the operative finishing motion; as the size of the workpiece particles decreases the quality of the surface finish generally improves. The predicted relative abraded particle size on a non lubricated surface to the abraded particle size on an organic boundary lubricated surface as a function of the fraction of the surface area free of organic boundary layer lubrication is shown in FIG. 9. As can be seen in FIG. 9, the ratio of the non lubricated abraded workpiece particle size (average mean diameter) to the abraded workpiece particle size (average mean diameter) from a partial organic boundary lubricated surface varies with the fraction of surface area free of boundary lubrication. The average mean workpiece particle diameter size removed during finishing increases surprisingly rapidly as the fraction of the semiconductor wafer surface free of organic boundary layer lubrication increases. It is further useful to note that ECOF can be used as shown in FIG. 7 (and the equation above) to adjustably control the work piece surface area free of organic boundary layer lubrication in FIG. 9. Thus the ECOF can be used to adjustably control finishing rate and the average mean workpiece particle size removed during finishing. As the average mean workpiece particle size decreases, the workpiece surface generally improves in finish and the tendency for unwanted surface scratching or gouging on the workpiece surface is reduced.

Control of the Effective Coefficient of Friction is preferred for finishing, and more preferably for fixed abrasive finishing. As used herein, partial organic boundary lubrication is where a workpiece surface has an area(s) which has an organic boundary layer lubrication and where that same surface has an area(s) which is free of organic boundary layer lubrication. FIG. 6 is an artist's representation of a partial organic boundary layer lubrication. A careful review of FIGS. 6, 7, 8 and 9 shows an unexpected and preferred range of Effective Coefficient of Friction in the operative finishing interface for semiconductor wafers. To optimize, for instance, finishing rate and semiconductor surface quality, different values are preferred. An operative finishing interface having a Effective Coefficient of Friction within a value determined by the equation ECOF_A1 wherein from 0.001 to 0.25 surface area fraction of the workpiece surface being finished is free of organic boundary layer lubrication is preferred and having surface area fraction of the workpiece surface being finished is free of organic boundary layer lubrication from 0.001 to 0.25 is more preferred and one having a surface area fraction of the workpiece surface being finished is free of organic boundary layer lubrication from 0.01 to 0.15 is even more preferred and one having a surface area fraction of the workpiece surface being finished is free of organic boundary layer lubrication from 0.02 to 0.15 is even more particularly preferred. Control of the Effective Coefficient of Friction in preferred value ranges for at least a portion of the finishing cycle is preferred. These unexpected ranges help reduce unwanted surface defects. Guidance on helpful parameters for adjusting the Effective Coefficient of Friction are discussed herein.

Control of finishing control parameters to finish semiconductor wafers within preferred ranges of effective coefficient of friction values for a substantial amount of the finishing cycle time is preferred and control of finishing control parameters to finish semiconductor wafers within these preferred ranges of Effective Coefficient of Friction values for from 20% to 100% of the finishing cycle time is more preferred and control of finishing control parameters to finish semiconductor wafers within these preferred ranges of Effective Coefficient of Friction values for from 40 to 100% of the finishing cycle time is even more preferred Controlling with in situ process control the finishing control parameters to finish semiconductor wafers within preferred ranges of Effective Coefficient of Friction values for a substantial amount of the finishing cycle time is preferred and for from 20% to 100% of the finishing cycle time is more preferred and for from 40 to 100% of the finishing cycle time is even more preferred. Use of in situ process control with in situ friction sensing methods to control the finishing control parameters to finish semiconductor wafers within these preferred Effective Coefficient of Friction for a substantial amount of the finishing cycle time is preferred and for from 20% to 100% of the finishing cycle time is more preferred and for from 40 to 100% of the finishing cycle time is even more preferred. Use of in situ process control with in situ friction sensing methods operatively connected to a processor which at least in part calculates a term related to the effective coefficient of friction to aid control of the finishing control parameters to finish semiconductor wafers within these preferred surface area fraction free of organic boundary layer lubrication values for a substantial amount of the finishing cycle time is preferred and for from 20% to 100% of the finishing cycle time is more preferred and for from 40 to 100% of the finishing cycle time is even more preferred. Use of in situ process control with in situ sensors operatively connected to a processor which at least in part calculates a effective coefficient of friction to aid control of the finishing control parameters to finish semiconductor wafers within these preferred surface area fractions free of organic boundary layer lubrication values for a substantial amount of the finishing cycle time is preferred and for from 20% to 100% of the finishing cycle time is more preferred and for from 40 to 100% of the finishing cycle time is even more preferred. Where high finishing rates (such as high initial cut rates) are preferred (such as high initial finishing rates), a range of from 5 to 95% of the finishing cycle time is preferred and a range of from 10 to 90% is more preferred for preferred control as discussed herein. Use of at least one friction sensing detector for control is preferred and use of at least two friction sensing detectors for control is more preferred and use of at least three friction detectors for control is even more preferred. By controlling the finishing process within preferred effective coefficient of friction levels and finishing times with rapid real-time control using processors, surfaces can be improved and unwanted surface defects can be reduced.

Figure 14A:
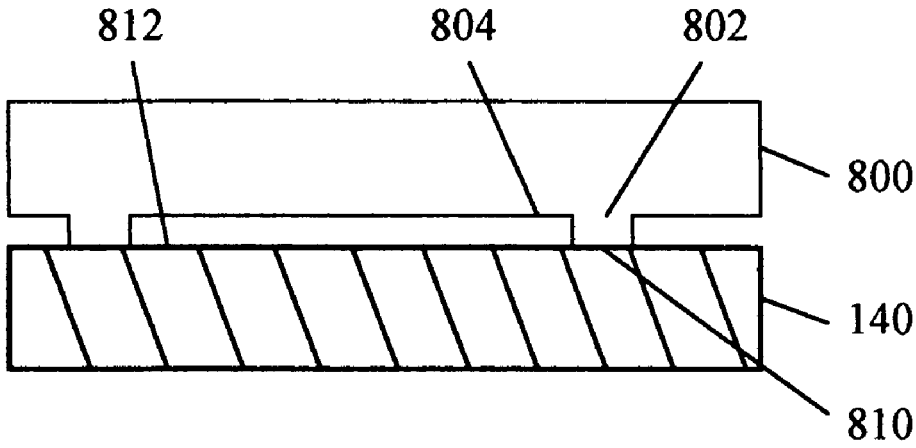
FIG. 14 is an artist's representation of finishing some unwanted raised regions and some regions below the unwanted raised regions with differential boundary lubrication.
Figure 14B:
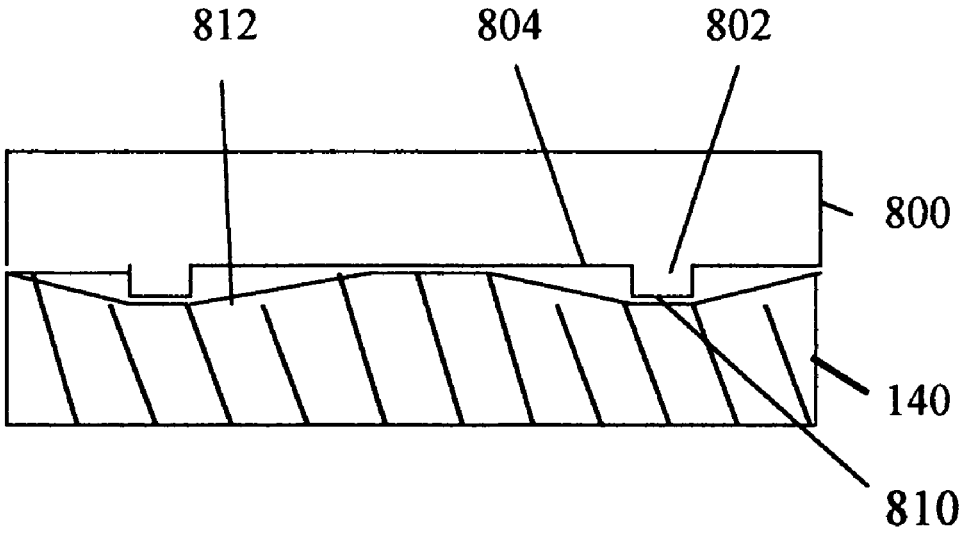

FIG. 14 is an artist's representation of finishing some unwanted raised regions and some regions below the unwanted raised regions. Reference Numeral 800 represents a portion of a semiconductor wafer surface having two unwanted raised regions. Reference Numeral 802 represents unwanted raised regions on the semiconductor surface being finished. Reference Numeral 804 represents lower local regions on the semiconductor surface being finished proximate to the unwanted raised regions. Reference Numeral 140 represents a small cross-section of the finishing element. Reference Numeral 810 represents the finishing element finishing surface in local contact with the unwanted raised regions (Reference Numeral 802). Reference Numeral 812 represents the finishing element surface local region displaced from but proximate to and lower than the unwanted raised local regions. As shown the finishing element finishing surface can reduce pressure and/or lose actual contact with the lower local regions on the semiconductor proximate to the unwanted raised local regions. This leads to unwanted raised regions having higher pressure which in turn can reduce the lubricating boundary layer thickness in the unwanted raised regions. Reducing the boundary layer thickness generally increases local tangential friction forces, raises the finishing rate measured in angstroms per minute on the unwanted raised regions. Also the pressure in lower regions proximate to the unwanted raised regions have is lower pressure applied which in turn can increase lubricating boundary layer thickness in these lower regions. Increasing the lubricating boundary layer thickness generally decreases local tangential forces, lowering the finishing rate measured in angstroms per minute in these lower regions proximate to the unwanted raised regions. By increasing finishing rate in the unwanted raised regions and lowering the finishing rate in the proximate lower regions the planarity of the semiconductor is generally improved. This generally helps the unwanted raised regions to have higher finishing rates when measured in angstroms per minute and improves within die nonuniformity. As shown in the FIG. 6, the region of contact with the unwanted raised region is small which in turn raises the finishing pressure applied by the finishing elements having a higher flexural modulus and this increased pressure increases the finishing rate measured in angstroms per minute at the unwanted raised region. This higher pressure on the unwanted raised region also increases frictional heat which can further increase finishing rate measured in angstroms per minute in the unwanted raised region. Boundary lubrication on the unwanted raised region can be reduced due to the higher temperature and/or pressure which further increases friction and finishing rate measured in angstroms per minute. Higher stiffness finishing element finishing surfaces apply higher pressures to the unwanted raised local regions which can further improve planarization, finishing rates, and within die nonuniformity. Finishing wherein the unwanted raised regions have a finishing rate measured in angstroms per minute of at least 1.6 times faster than in the proximate low local region measured in angstroms per minute is preferred and finishing wherein the unwanted raised regions have a finishing rate of at least 2 times faster than in the proximate low local region is more preferred and finishing wherein the unwanted raised regions have a finishing rate of at least 4 times faster than in the proximate low local region is even more preferred. Where there is no contact with the proximate low local region, the finishing rate in the low local region can be very small and thus the ratio between the finishing rate in the unwanted raised region to finishing rate in the low local region can be large. Finishing wherein the unwanted raised regions have a finishing rate measured in angstroms per minute of from 1.6 to 500 times faster than in the proximate low local region measured in angstroms per minute is preferred and finishing wherein the unwanted raised regions have a finishing rate of from 2 to 300 times faster than in the proximate low local region is more preferred and finishing wherein the unwanted raised regions have a finishing rate of from 2 to 200 times faster than in the proximate low local region is even more preferred and finishing wherein the unwanted raised regions have a finishing rate of from 4 to 200 times faster than in the proximate low local region is even more preferred and wherein the unwanted raised regions have a finishing rate of from 8 to 200 times faster than in the proximate low local region is even more particularly preferred. By finishing the unwanted raised regions at a faster rate, planarizing is improved.

Figure 15:
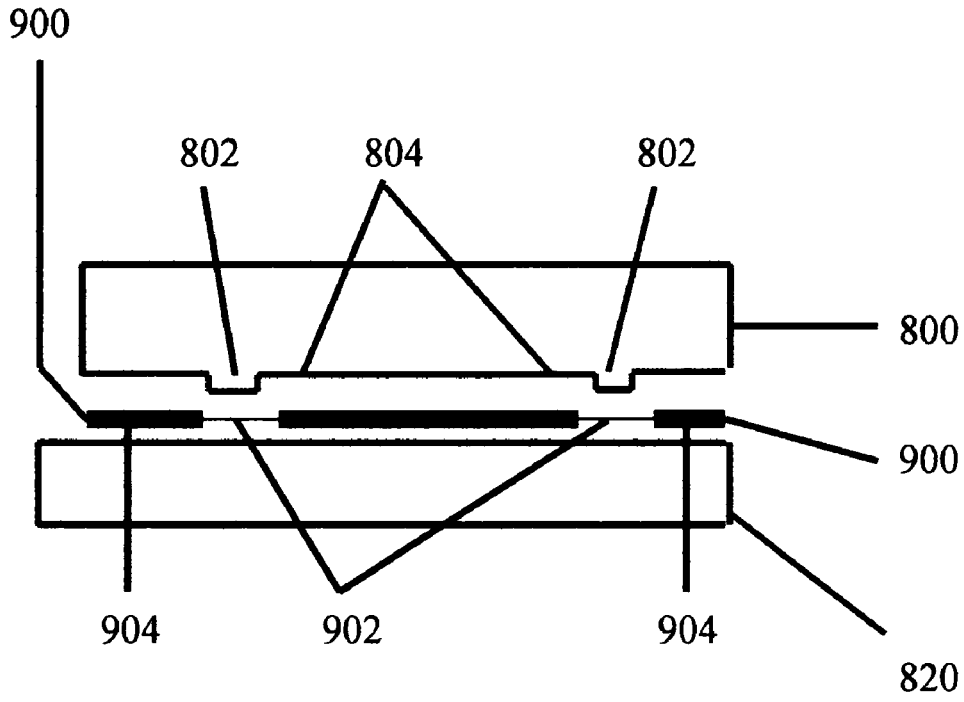
FIG. 15 is an artist's representation of an example of the effects on the boundary layer lubrication

FIG. 15 is an artist's representation of an example of the effects on an organic lubricating film and/or the organic boundary layer lubrication discussed herein above. As discussed herein, it is not drawn to scale so the boundary layer thickness can be illustrated in simple fashion for helpful guidance. As discussed herein, it is not drawn to scale so the boundary layer thickness can be illustrated in simple fashion for helpful guidance. Reference Numeral 800 represents a cross-sectional view of a semiconductor wafer having two unwanted raised regions (Reference Numeral 802). Reference Numeral 804 represents a cross-sectional view of a semiconductor wafer having lower regions proximate to the two unwanted raised regions (Reference Numeral 802). Reference Numeral 900 represents the lubricating boundary layer. Reference Numeral 902 represents regions of partial or no local boundary layer lubrication (and generally with a higher coefficient of friction). In other words, Reference Number 902 represents regions having higher coefficients of friction and/or partial lubrication. Note that the regions of partial or no local organic boundary lubricating boundary layer can occur proximate to the unwanted raised regions on the semiconductor wafer surface being finished. Reference Numeral 904 represents a thicker region of lubricating boundary layer (and generally with lower coefficient of friction) which can generally occur in regions proximate to and below the unwanted raised regions and generally have lower coefficients of friction. Reference Numeral 810 represents a small cross-section of finishing element. The different local regions having different lubricating boundary layers and lubricating properties are referred to herein as differential boundary lubrication. Differential boundary lubrication can improve planarization for some semiconductor wafers (particularly at the die level). A uniform portion of the heterogeneous surface area which is effectively free of organic boundary layer lubrication has a higher effective coefficient of friction than the surface area having a more effective organic boundary lubrication is preferred. A uniform portion of the heterogeneous surface area which is effectively free of organic boundary layer lubrication has a higher temperature than the surface area having a more effective organic boundary lubrication is more preferred. A uniform portion of the heterogeneous surface area which is effectively free of organic boundary layer lubrication has a higher effective coefficient of friction and a higher temperature than the surface area having a more effective organic boundary lubrication is more preferred By varying the temperature and/or coefficient of friction selectively, finishing rates can be influenced to improve selective finishing of different local regions on the workpiece. Differential lubricating films, preferably lubricating boundary layers, can improve planarization for some semiconductor wafers (particularly at the die level). An organic lubricating boundary layer is a preferred lubricating film.

Finishing a semiconductor wafer in an operative finishing interface having a percentage of the surface effectively free of organic boundary lubrication is new and unique to this invention. This method of finishing can improve the balance of finishing rate and surface quality in unexpected ways.

Operative Finishing Motion

Chemical mechanical finishing during operation has the finishing element in operative finishing motion with the surface of the workpiece being finished. A relative lateral parallel motion of the finishing element to the surface of the workpiece being finished is an operative finishing motion. Lateral parallel motion can be over very short distances or macro-distances. A parallel circular motion of the finishing element finishing surface relative to the workpiece surface being finished can be effective. A tangential finishing motion can also be preferred. U.S. Pat. No. 5,177,908 to Tuttle issued in 1993, U.S. Pat. No. 5,234,867 to Schultz et. al. issued in 1993, U.S. Pat. No. 5,522,965 to Chisholm et. al. issued in 1996, U.S. Pat. No. 5,735,731 to Lee in 1998, and U.S. Pat. No. 5,962,947 to Talieh issued in 1997 comprise illustrative nonlimiting examples of the operative finishing motion contained herein for further general guidance of those skilled in the arts.

Some illustrative nonlimiting examples of preferred operative finishing motions for use in the invention are also discussed. This invention has some particularly preferred operative finishing motions of the workpiece surface being finished and the finishing element finishing surface. Moving the finishing element finishing surface in an operative finishing motion to the workpiece surface being finished is a preferred example of an operative finishing motion. Moving the workpiece surface being finished in an operative finishing motion to the finishing element finishing surface is a preferred example of an operative finishing motion. Moving the finishing element finishing surface in a parallel circular motion to the workpiece surface being finished is a preferred example of an operative finishing motion. Moving the workpiece surface being finished in a parallel circular motion to the finishing element finishing surface is a preferred example of an operative parallel. Moving the finishing element finishing surface in a parallel linear motion to the workpiece surface being finished is a preferred example of an operative finishing motion. Moving the workpiece surface being finished in a parallel linear motion to the finishing element finishing surface is a preferred example of an operative parallel motion. The operative finishing motion performs a significant amount of the polishing and planarizing in this invention.

High speed finishing of the workpiece surface with fixed abrasive finishing elements can cause surface defects in the workpiece surface being finished at higher than desirable rates because of the higher forces generated. As used herein, high speed finishing involves relative operative motion having an equivalent linear velocity of greater than 300 feet per minute and low speed finishing involves relative operative motion having an equivalent linear velocity of at most 300 feet per minute. High speed finishing having a relative operative motion from 300 to 1500 feet per minute is preferred and from 350 to 1000 feet per minute is more preferred. An operative finishing motion having a velocity of greater than 300 feet per minute is preferred for high speed finishing. An operative finishing motion having a velocity of at most 300 feet per minute is preferred for low speed finishing. The relative operative speed is measured between the finishing element finishing surface and the workpiece surface being finished. Supplying a lubricating aid between the interface of finishing element finishing surface and the workpiece surface being finished when high speed finishing is preferred to reduce the level of surface defects. Supplying a lubricating aid between the interface of a cylindrical finishing element and a workpiece surface being finished is a preferred example of high speed finishing. Supplying a lubricating aid between the interface of a belt finishing element and a workpiece surface being finished is a preferred example of high speed finishing. An operative finishing motion which maintains substantially different instantaneous relative velocity between the finishing element and some points on the semiconductor wafer is preferred for some finishing equipment. Nonlimiting illustrative examples of some different finishing elements and a cylindrical finishing element are found in patents U.S. Pat. No. 5,735,731 to Lee, U.S. Pat. No. 5,762,536 to Pant, and U.S. Pat. No. 5,759,918 to Hoshizaki et al. and which can be modified by those skilled in the art as appropriate. U.S. Pat. No. 5,735,731 to Lee, U.S. Pat. No. 5,762,536 to Pant, and U.S. Pat. No. 5,759,918 to Hoshizaki et al. are included herein by reference in their entirety.

Friction Sensor Probe

A friction sensor probe to facilitate measurement and control of finishing in this is preferred. A friction sensor probe comprises a probe that can sense friction at the interface between a material which is separated from and unconnected to the workpiece surface being finished and the finishing element finishing surface. A friction sensor probe having a friction sensor surface in operative friction motion with the finishing element finishing surface is particularly preferred. Friction sensor surface comprising a material which comprises the same material contained in the workpiece is preferred and which comprises the same material selected from the proximate surface of the workpiece is more preferred and one which comprises a material selected from the surface of the workpiece is even more preferred. Friction sensor surface comprising a material which reacts (or interacts) in a similar manner with the lubricating aid as a material contained in the workpiece is preferred and one which interacts in a similar manner with the lubricating aid as a material selected the same a material proximate to the surface of the workpiece is more preferred and one which interacts in a similar manner with the lubricating aid as a material selected from the surface of the workpiece is even more preferred.

Sensing the change in friction of the friction sensor probe can be accomplished using technology disclosed herein. An optical friction sensor is a preferred friction sensor. Nonlimiting preferred examples of the optical friction sensors is an infrared thermal sensing unit such as a infrared camera and a laser adjusted to read minute changes of movement friction sensor probe to a perturbation. A non-optical sensing friction sensor is a preferred friction sensor. Non-limiting preferred examples of non-optical friction sensors include thermistors, thermocouples, diodes, thin conducting films, and thin metallic conducting films. Electrical performance versus temperature such as conductivity, voltage, and resistance is measured. Those skilled in the thermal measurement arts are generally familiar with non-optical thermal sensors and their use. A change in friction can be detected by rotating the friction sensor probe in operative friction contact with the finishing element finishing surface with electric motors and measuring current changes on one or both motors. The current changes related to friction changes can then be used to produce a signal to operate the friction sensor subsystem. A change in friction can be detected by rotating the friction sensor probe in operative friction contact with the finishing element finishing surface with electric motors and measuring power changes on one or both motors. The power changes related to friction changes can then be used to produce a signal to operate the finishing control subsystem. Optionally one can integrate the total energy used by one or both motors over known time periods to monitor friction changes. One can monitor the temperature of the friction sensor surface with a friction sensor to develop a signal related to the friction at the interface between the friction sensor surface and the finishing element finishing surface. A sensor can also be used to detect imparted translational motion which corresponds to changes in friction. Using this information, integration coefficients can be developed to predict finishing effectiveness. An infrared camera or another type infrared temperature measuring device can be used for detecting and mapping of a temperature of the friction sensor surface which is predictive of the friction at the interface of the friction sensor surface and the finishing element finishing surface. The thermal image can then be analyzed and used to control the operational parameters of finishing. Methods to measure friction are generally well known to those skilled in the art. Non limiting examples of methods to measure friction are described in the following U.S. Pat. No. 5,069,002 to Sandhu et. al., U.S. Pat. No. 5,196,353 to Sandhu, U.S. Pat. No. 5,308,438 to Cote et. al., U.S. Pat. No. 5,595,562 to Yau et. al., U.S. Pat. No. 5,597,442 to Chen, U.S. Pat. No. 5,643,050 to Chen, and U.S. Pat. No. 5,738,562 to Doan et. al. and are included by reference herein in their entirety for guidance. Those skilled in the art can modify this information using the confidential information disclosed herein for use in the friction sensor probes of this invention.

By having at least one friction sensor probe to detect and output signals in real time on changes in friction due to operating parameter changes in lubrication and finishing can be more effectively controlled. By having two friction sensor probes, differential changes in friction can be monitored and used to even more effectively control finishing. Differential changes in friction can be monitored that are due to differential reaction (and/or interaction) and lubrication of different materials on two different friction sensor probe friction sensor surfaces which in turn can be used to better control finishing of the workpiece surface having these two materials. Further the differential lubrication can be related to such finishing control parameters as operative finishing motion speed, type of motion such as continuous or vibrating motions, applied pressure, temperature of finishing, etc. By having at least one friction sensor probe, more preferably two friction sensor probes, which have been calibrated over time, such changes can be recognized and adjusted by those generally skilled in the art with mathematical equations and modeling within the capability of current processor devices such as computers.

By having one friction probe friction sensor surface comprising at least one material selected from the proximate surface of the workpiece surface being finished, control of the active lubrication at the interface between the workpiece being finished and the finishing element finishing surface can be controlled more effectively. By having two friction sensor probe friction sensor surfaces, each comprising at least one material selected from the proximate surface of the workpiece surface being finished, control of the active lubrication at the interface between the workpiece being finished and the finishing element finishing surface can be adjusted and controlled to improve the boundary layer lubrication in the operative finishing interface. One is that active lubrication can vary from bulk lubrication because selective reactions (and/or interactions) with the materials on the workpiece surface being finished. A heterogeneous workpiece surface being finished can have variations from bulk lubrication due to different selective reactions (or interactions) with the lubricant and different materials on the workpiece surface being finished. By having the friction sensor probes, one can control lubrication by the intended result (effect on friction) rather than by concentrations or feed rates. For boundary lubrication with a reactive lubricant, less lubricant is needed once the desired level of boundary lubrication is established. Using friction sensor probes, desired lubrication can be more effectively controlled. Using friction sensor probes, marginal lubrication can be more effectively controlled.

A friction sensor probe of this invention has at least one friction sensor and a friction sensor probe with at least two friction sensors is preferred. A friction sensor probe of this invention has at least one friction sensor surface and a friction sensor probe having at least two friction sensor surfaces is more preferred for some applications. By having more than one friction sensor (such as two thermocouples or one optical temperature sensor and one non-optical friction sensor) a more precise friction can often be obtained. With very expensive workpieces such as semiconductor wafers the additional cost can be justified. By having more than one friction sensor surface, multiple friction readings can be obtained without the additional expense of having two friction probe bodies. Two separate friction sensor probes have additional degrees of freedom in their measurement and freedom of movement so they can often be cost justified. A friction sensor surface generates friction while contacting the surface of the finishing element finishing surface which produces heat. A thermal measurement of the finishing element finishing surface immediately after it departs from the area of friction with the friction sensor probe can also be made with an infrared camera or other optical friction sensor. An operative secondary friction sensor is preferred. A plurality of operative friction sensors is more preferred. Applicant currently particularly prefers to measure the friction at a point where the friction sensor surface is still in contact with the finishing element finishing surface (as would occur in use with the friction sensor probe in FIG. 4). Sensing the temperature of the friction sensor surface is very preferred and sensing changes in the temperature of the friction sensor surface is even more preferred. Sensing changes in temperature of the friction sensor surface by sensing changes in temperature of the friction sensing element is also more preferred and sensing changes in temperature of the friction sensor surface by sensing changes in temperature of the friction sensing element is also even more preferred. Applicant recommends having a low thermal mass in the friction sensor surface to increase response time to friction generated heat when a thermal sensor is employed.

A friction sensor subsystem as used herein is the combination of the friction sensor probe operatively connected to a processor and a controller which is capable of controlling the finishing control parameters and the friction sensing control parameters. Non-limiting friction control parameters include the operative friction motion, temperature, and finishing composition type and feed rate. Non-limiting preferred operative friction sensor motions include relative motion between the finishing element finishing surface and the friction sensor surface including velocity, continuous or periodic, and applied pressure. Still further examples of friction sensor motions include circular, tangential, linear, orbital, repetitive, and intermittent motions. A vibrating friction sensor motion is a preferred friction sensor motion for some applications. Mechanical mechanisms which deliver these operative friction sensor motions are well understood by those skilled in the art and are not repeated herein. Electric motors and electric stepper motors are generally known in the industry for driving a mechanical mechanism. Guidance can also be found in mechanical mechanisms used for the carrier motions known in the general CMP industry and adapted for use with a friction sensor probe(s).

A friction sensor subsystem which uses a processor which uses at least in part a mathematical equation to aid control is preferred. A friction sensor subsystem having at least two friction sensor probes and which uses a processor which uses at least in part a mathematical equation to extrapolate from the information from the two probes is also more preferred. A friction sensor subsystem having at least two friction sensor probes and which uses a processor which uses at least in part a mathematical equation to interpolate between the range of information derived from the two probes during the finishing cycle time is more preferred. A friction sensor subsystem having at least two friction sensor probes and which uses a processor which uses at least in part a mathematical equation to interpolate between the information from the two probes at a particular time during the cycle time is more particularly preferred. Controlling finishing with current information from the friction sensor probes for interpolations is often more effective and precise than historical predictions, particularly when the finishing element finishing surface changes with time. Controlling finishing with current information from the friction sensor probes for extrapolations is often more effective and precise than historical predictions, particularly when the finishing element finishing surface changes with time. A friction sensor probe is a preferred example of a friction sensing method.

A friction sensor probe having a surface which is similar to the workpiece surface being finished is preferred and a secondary friction sensor essentially free of abrasive dressing action on the finishing element finishing surface is more preferred and a secondary friction sensor free of abrasive dressing action on the finishing element finishing surface is more preferred (because this can reduce the useful life of the finishing element).

Workpiece Finishing Sensor

A workpiece finishing sensor is a sensor which senses the finishing progress to the workpiece in real time so that an in situ signal can be generated. A workpiece finishing sensor is preferred. A workpiece finishing sensor probe which facilitates measurement and control of finishing in this invention is preferred. A workpiece finishing sensor probe which generates a signal which can be used cooperatively with the friction sensor signal to improve finishing is more preferred. As used herein, a finishing sensor probe is a sensor probe which senses parameters either directly or indirectly related to finishing of the workpiece in the operative finishing interface. A friction sensor probe is an example of a preferred finishing sensor. A workpiece finishing sensor probe is a preferred finishing sensor.

The change in friction during finishing can be accomplished using technology generally familiar to those skilled in the art. A change in friction can be detected by rotating the workpiece being finished and the finishing element finishing surface with electric motors and measuring current changes on one or both motors. The current changes related to friction changes can then be used to produce a signal to operate the finishing control subsystem. A change in friction can be detected by rotating the workpiece finishing surface with the finishing element finishing surface with electric motors and measuring power changes on one or both motors. Changes in friction can also be measured with thermal sensors. A thermistor is a non-limiting example of preferred non-optical thermal sensor. A thermal couple is another preferred non-optical thermal sensor. An optical thermal sensor is a preferred thermal sensor. A infrared thermal sensor is a preferred thermal sensor. Sensors to measure friction in workpieces being finished are generally known to those skilled in the art. Non limiting examples of methods to measure friction in friction sensor probes are described in the following U.S. Pat. No. 5,069,002 to Sandhu et. al., U.S. Pat. No. 5,196,353 to Sandhu, U.S. Pat. No. 5,308,438 to Cote et. al., U.S. Pat. No. 5,595,562 to Yau et. al., U.S. Pat. No. 5,597,442 to Chen, U.S. Pat. No. 5,643,050 to Chen, and U.S. Pat. No. 5,738,562 to Doan et. al. and are included by reference herein in their entirety for guidance and can be advantageously modified by those skilled in the art for use in this invention. Thermal sensors are available commercially from Terra Universal, Inc. in Anaheim, Calif. and Hart Scientific in American Fork, Utah. Measuring the changes in friction at the interface between the workpiece being finished and the finishing element finishing surface to generate an in situ signal for control is particularly preferred because it can be effectively combined with at least one friction sensor probes to this invention to improve finishing control. Measuring the changes in friction at the interface between the workpiece being finished and the finishing element finishing surface is a useful friction sensing method.

A workpiece finishing sensor for the workpiece being finished is preferred. A sensor for the workpiece being finished selected from the group consisting of friction sensors, thermal sensors, optical sensors, acoustical sensors, and electrical sensor is a preferred sensor for the workpiece being finished in this invention. Workpiece thermal sensors and workpiece friction sensors are non-limiting examples of preferred workpiece friction sensors. As used herein, a workpiece friction sensor can sense the friction between the interface of the workpiece being finished and the finishing element finishing surface during operative finishing motion.

Additional non-limiting preferred examples of workpiece sensors will now be discussed. Preferred optical workpiece sensors are discussed. Preferred non-optical workpiece sensors are also discussed. The endpoint for planarization can be effected by monitoring the ratio of the rate of insulator material removed over a particular pattern feature to the rate of insulator material removal over an area devoid of an underlying pattern. The endpoint can detected by impinging a laser light onto the workpiece being polished and measuring the reflected light versus the expected reflected light as an measure of the planarization process. A system which includes a device for measuring the electrochemical potential of the slurry during processing which is electrically connected to the slurry, and a device for detecting the endpoint of the process, based on upon the electrochemical potential of the slurry, which is responsive to the electrochemical potential measuring device can be used. Endpoint detection can be determined by an apparatus using an interferometer measuring device directed at an unpatterned die on the exposed surface of the wafer to detect oxide thickness at that point. A semiconductor substrate and a block of optical quartz are simultaneously polished and an interferometer, in conjunction with a data processing system is then used to monitor the thickness and the polishing rate of the optical block to develop an endpoint detection method. A layer over a patterned semiconductor is polished and analyzed using optical methods to determine the end point. An energy means for supplying prescribed energy to the semiconductor wafer is used to develop a detecting means for detecting a polishing end point to the polishing of film by detecting a variation of the energy supplied tot the semiconductor wafer. The use of sound waves can be used during chemical mechanical polishing by measuring sound waves emanating from the chemical mechanical polishing action of the substrate against the finishing element. A control subsystem can maintain a wafer count, corresponding to how many wafers are finished and the control subsystem regulates the backside pressure applied to each wafer in accordance with a predetermined function such that the backside pressure increases monotonically as the wafer count increases. The above methods are generally known to those skilled in the art. U.S. Pat. No. 5,081,796 to Schultz, U.S. Pat. No. 5,439,551 to Meikle et al., U.S. Pat. No. 5,461,007 to Kobayashi, U.S. Pat. No. 5,413,941 to Koos et. al., U.S. Pat. No. 5,637,185 Murarka et al., U.S. Pat. No. 5,643,046 Katakabe et al., U.S. Pat. No. 5,643,060 to Sandhu et al., U.S. Pat. No. 5,653,622 to Drill et al., and U.S. Pat. No. 5,705,435 to Chen. are included by reference in their entirety and included herein for general guidance and modification by those skilled in the art.

Changes in lubrication, particularly active lubrication, at the operative finishing interface can significantly affect finishing rates and finishing performance in ways that current workpiece sensors cannot handle as effectively as a remote friction sensor probe (secondary friction sensor probe). For instance, current workpiece sensors can be used in new, surprising manner to aid in the control of the marginal boundary lubrication as discussed herein. Continued operation in the older manner renders some prior art workpiece finishing sensors less effective than desirable for controlling during finishing and stopping finishing where friction is adjusted or changed in real time. Friction sensor probe subsystems as indicated above can help to improve real time control wherein the lubrication is changed during the finishing cycle time. Preferred secondary friction sensors include optical friction sensors and non-optical friction sensors. An optical friction sensor is a preferred friction sensor. Non-limiting preferred examples of optical friction sensors is an infrared thermal sensing unit such as a infrared camera and a laser adjusted to read minute changes of movement friction sensor probe to a perturbation. A non-optical sensing friction sensor is a preferred friction sensor. Non-limiting preferred examples of non-optical friction sensors include thermistors, thermocouples, diodes, thin conducting films, and thin metallic conducting films. Electrical performance versus temperature such as conductivity, voltage, and resistance is measured. Those skilled in the thermal measurement arts are generally familiar with non-optical thermal sensors and their use. A change in friction can be detected by rotating the friction sensor probe in operative friction contact with the finishing element finishing surface with electric motors and measuring current changes on one or both motors. Where the material changes with depth during the finishing of workpiece being finished, one can monitor friction changes with the friction sensor probe surfaces (secondary friction sensor surfaces) having dissimilar materials even with changing organic boundary layer lubrication and therefore readily detect the end point and also perform in situ adjustments to finishing control parameters to optimize finishing with marginal lubrication.

As a preferred example, the pressure can be changed during finishing. With a friction sensor, a processor can rapidly calculate whether the effective coefficient of friction has changed. If the entire semiconductor wafer surface is covered with organic boundary layer lubrication, the effective coefficient of friction will remain very stable. If the semiconductor wafer surface has some regions free from organic boundary layer lubrication, the effective coefficient of friction will change if the percentage of surface area covered by the organic boundary layer lubrication changes with the change in pressure. FIG. 7 discussed herein above shows a representative change in the effective coefficient of friction as the area fraction free from organic boundary lubrication changes. In this manner, a pressure change to the secondary friction sensor probe can be used for in situ process control of marginal lubrication. In this manner, a pressure change in the operative finishing interface can also be used for in situ process control of marginal lubrication. Changing the applied pressure to a friction sensor is a preferred method of in situ control for marginal lubrication and reducing the applied pressure to a friction sensor is a more preferred method of in situ control. Using a reducing pressure change is normally preferred because this minimizes the abraded particles from the semiconductor wafer surface which helps to reduce unwanted semiconductor wafer surface damage. An example of a reducing pressure change is if the normal pressure during finishing is 6 psi, then a reducing pressure change is to reduce the pressure to 5 or 4 psi.

Platen

The platen is generally a stiff support structure for the finishing element. Other types of platen(s) are generally known in the industry and are functional. The platen surface facing the workpiece surface being finished is parallel to the workpiece surface being planarized and is flat and generally made of metal. The platen reduces flexing of the finishing element by supporting the finishing element; optionally a pressure distributive element can also be used. The platen surface during polishing is in operative finishing motion to the workpiece surface being finished. The platen surface can be static while the workpiece surface being finished is moved in an operative finishing motion. The platen surface can be moved in a parallel motion fashion while the workpiece surface being finished is static. Optionally, both the platen surface and the workpiece being finished can be in motion in a way that creates an operative finishing motion between the workpiece and the finishing element.

Base Support Structure

The base support structure forms structure which can indirectly aid in applying pressure to the workpiece surface being finished. It generally forms a support surface for those members attached to it directly or operatively connected to the base support structure. Other types of base support structure are generally known in the industry and are functional.

Finishing Element Conditioning

A finishing element can be conditioned before use or between the finishing of workpieces. Conditioning a finishing element is generally known in the CMP field and generally comprises changing the finishing element finishing surface in a way to improve the finishing of the workpiece. As an example of conditioning, a finishing element having no basic ability or inadequate ability to absorb or transport a finishing composition can be modified with an abrasive finishing element conditioner to have a new texture and/or surface topography to absorb and transport the finishing composition. As a non-limiting preferred example, an abrasive finishing element conditioner having a mechanical mechanism to create a finishing element finishing surface which more effectively transports the finishing composition is preferred.

Nonlimiting examples of textures and topographies useful for improving transport and absorption of the finishing composition and/or finishing element conditioners and general use are given in U.S. Pat. No. 5,216,843 to Breivogel, U.S. Pat. No. 5,209,760 to Wiand, U.S. Pat. No. 5,489,233 to Cook et. al., U.S. Pat. No. 5,664,987 to Renteln, U.S. Pat. No. 5,655,951 to Meikle et. al., U.S. Pat. No. 5,665,201 to Sahota, and U.S. Pat. No. 5,782,675 to Southwick and are included herein by reference in their entirety for general background and guidance and modification by those skilled in the art.

Cleaning Composition

After finishing the workpiece such as an electronic wafer, the workpiece is generally carefully cleaned before the next manufacturing process step. A lubricating aid or abrasive particles remaining on the finished workpiece can cause quality problems later on and yield losses.

A finishing aid which can be removed from the finished workpiece surface by supplying a water composition to the finished workpiece is preferred and a finishing aid which can be removed from the finished workpiece surface by supplying a hot water composition to the finished workpiece is also preferred. An example of a water composition for cleaning is a water solution comprising water soluble surfactants. An effective amount of lubricating aid which lowers the surface tension of water to help clean abrasive and other adventitious material from the workpiece surface after finishing is particularly preferred.

A lubricating aid which can be removed from the finished workpiece surface by supplying pure water to the finished workpiece to substantially remove all of the lubricating aid is preferred and a lubricating aid which can be removed from the finished workpiece surface by supplying hot pure water to the finished workpiece to substantially remove all of the lubricating aid is also preferred. A lubricating aid which can be removed from the finished workpiece surface by supplying pure water to the finished workpiece to completely remove the lubricating aid is more preferred and a lubricating aid which can be removed from the finished workpiece surface by supplying hot pure water to the finished workpiece to completely remove the lubricating aid is also more preferred. A preferred form of pure water is deionized water. Supplying a cleaning composition having a surfactant which removes lubricating aid from the workpiece surface just polished is a preferred cleaning step. A lubricating aid which lowers the surface tension of the water and thus helps remove any particles from the finished workpiece surface is preferred.

By using water to remove lubricating aid, the cleaning steps are lower cost and generally less apt to contaminate other areas of the manufacturing steps. A water cleaning based process is generally compatible with many electronic wafer cleaning process and thus is easier to implement on a commercial scale.

Process Control Parameters

Preferred process control parameters include those control parameters which can be changed during processing and affect workpiece finishing. Control of the operative finishing motion is a preferred process control parameter. Examples of preferred operative finishing motions include relative velocity, pressure, and type of motion. Examples of preferred types of operative finishing motions include tangential motion, planar finishing motion, linear motion, vibrating motion, oscillating motion, and orbital motion. Finishing temperature is a preferred process control parameter. Finishing temperature can be controlled by changing the heat supplied to the platen or heat supplied to the finishing composition. Alternately, friction can also change the finishing temperature and can be controlled by changes in lubrication, applied pressure during finishing, and relative operative finishing motion velocity. Changes in lubricant can be effected by changing finishing composition(s) and/or feed rate(s). A preferred group of process control parameters consists of parameters selected from the group consisting of operative finishing interface relative velocity, platen velocity, polishing pattern, finishing temperature, force exerted on the operative finishing interface, finishing composition, finishing composition feed rate, and finishing pad conditioning. Process control parameters for frictional planarizing are generally known in the industry and functional.

Processor

A processor is preferred to help evaluate the friction sensor probe information. A processor can be a microprocessor, an ASIC, or some other processing means. A processor preferably has computational and digital capabilities. Non limiting preferred examples of processing information include use of various mathematical equations, calculating specific parameters, memory look-up tables or databases for generating certain parameters such as historical performance or preferred parameters or constants, neural networks, fuzzy logic techniques for systematically computing or obtaining preferred parameter values. Input parameter(s) can include information on current wafers being polished such as uniformity, expected polish rates, preferred lubricants(s), preferred lubricant concentrations, entering film thickness and uniformity, workpiece pattern. Further preferred non-limiting processor capabilities including adding, subtracting, multiplying, dividing, use functions, look-up tables, noise subtraction techniques, comparing signals, and adjusting signals in real time from various inputs and combinations thereof.

Memory look-up tables and databases are generally made accessible through memory devices. The memory devices can be integral with the process or operatively connected to the processor. A plurality of processors can be used. As a non-limiting example, the memory look-tables can reside on a remote processor or computer. For instance, the remote processor can be on a local area network or in an even more remote location. The desired remote look-tables can be accessed as needed remotely and/or the remote look-tables can be temporarily downloaded to the processor (and/microcomputer) needing access them.

For multi-layer semiconductors, this information can change from layer to layer. A method which updates the cost of manufacture control parameters, look-up tables, algorithms, or control logic consistent with the current manufacturing step is preferred. The semiconductor wafer tracked for each finishing step during processing with a tracking means such as tracking code is preferred. Updating the processing information with each layer is preferred. Updating the input parameters with each layer is also preferred. Updating for new dielectric layers and metal layers is preferred. A control subsystem capable of updating the input parameters for the particular a particular layer during finishing is preferred. A control subsystem capable of updating the process information for the particular a particular layer during finishing is preferred. By updating the control information, generally more effective finishing can be accomplished.

Cost of Manufacture Information

Figure 10:
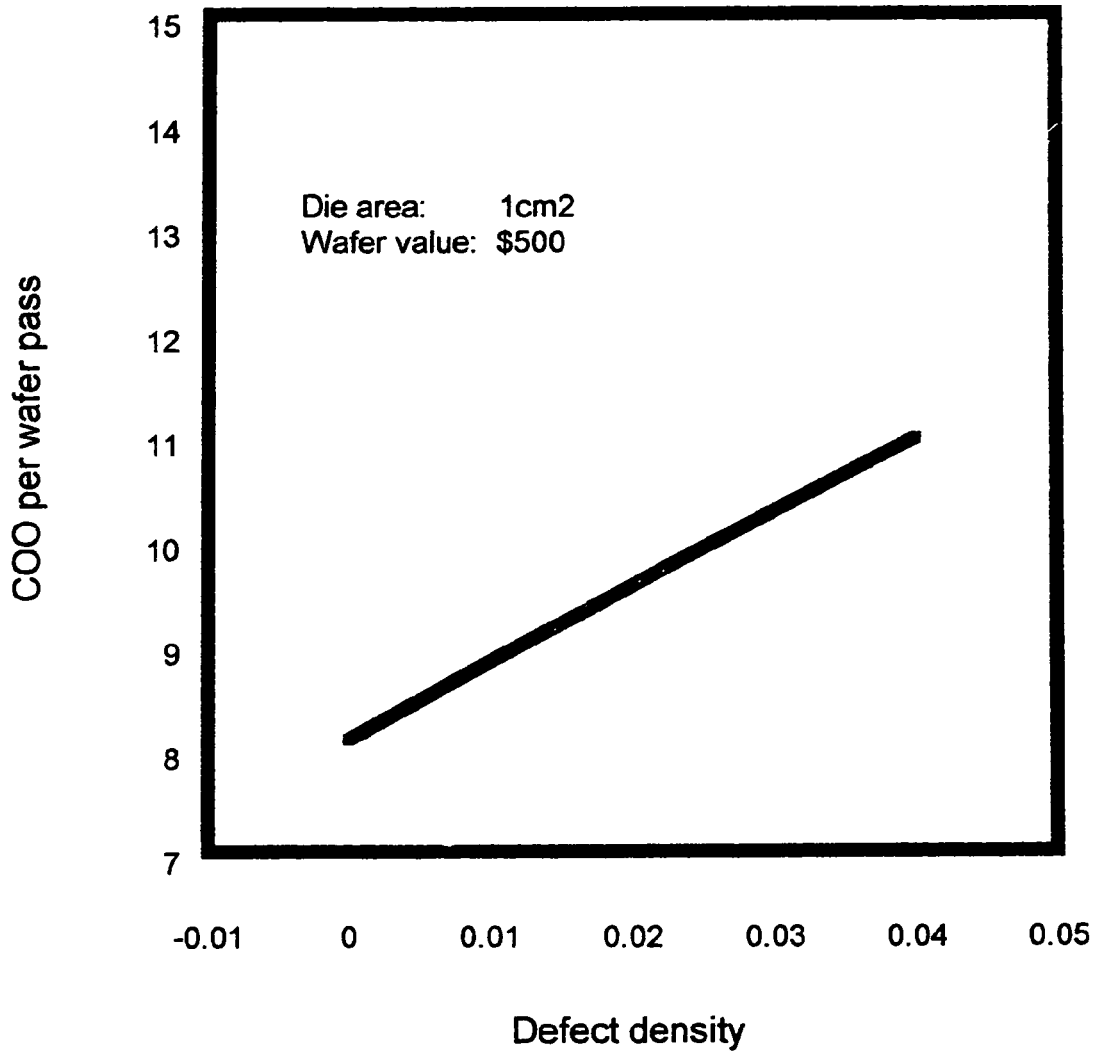
FIG. 10 is a plot of cost of ownership vs defect density
Figure 11:
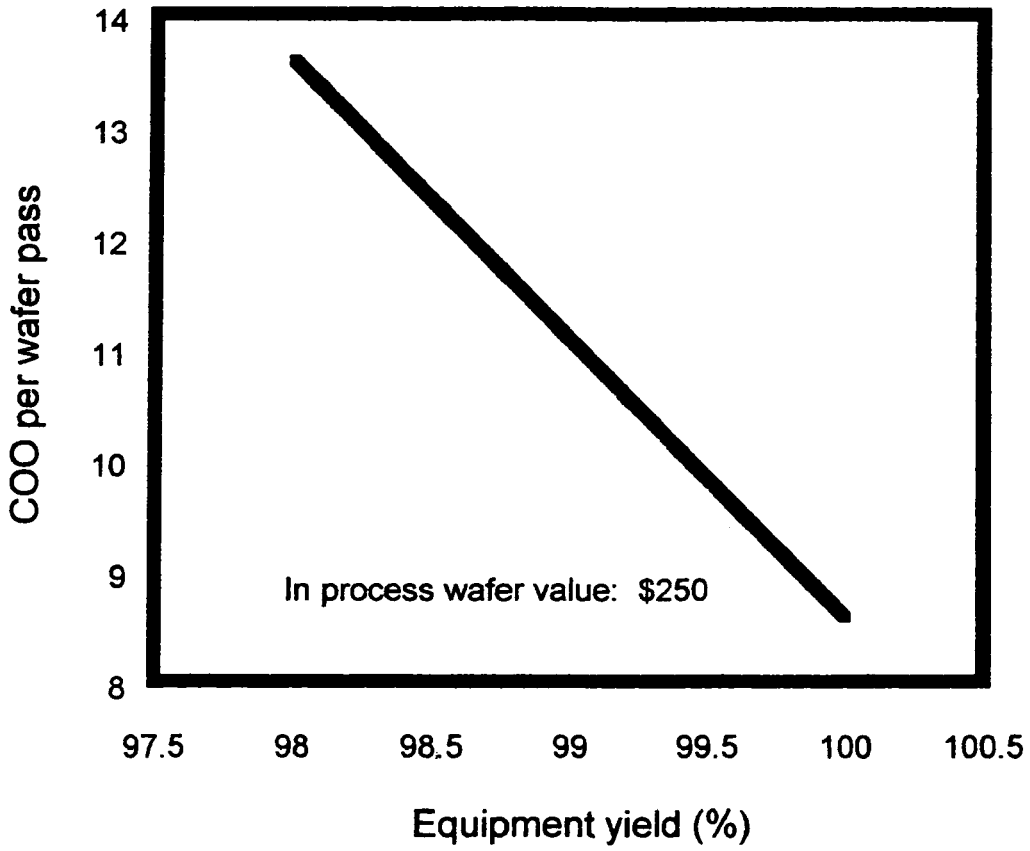
FIG. 11 is a plot of cost of ownership vs equipment yield
Figure 12:
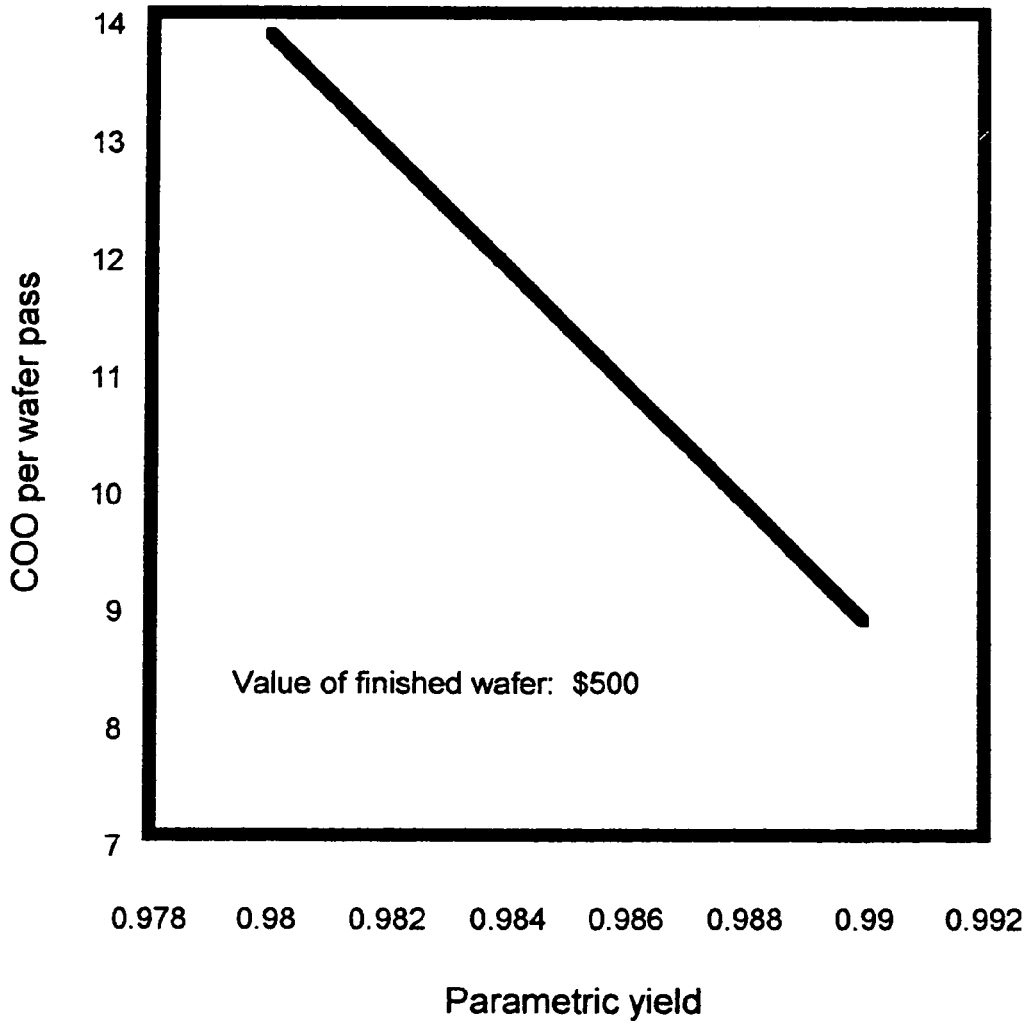
FIG. 12 is a plot of cost of ownership vs parametric yield loss
Figure 13:
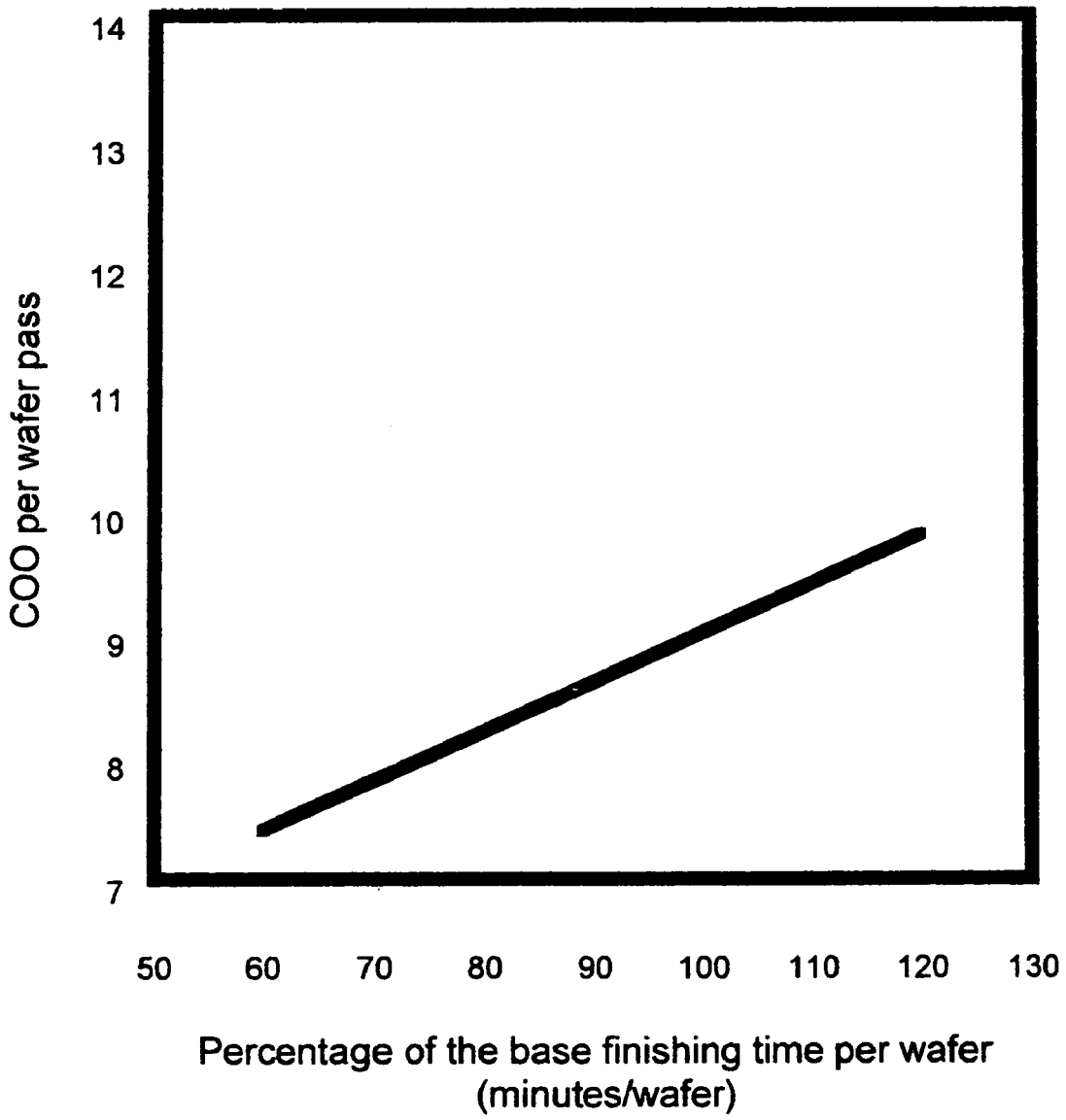
FIG. 13 is a plot of finishing rate effect on cost of ownership

Cost of manufacture parameters for chemical mechanical finishing are very complex. To applicant's knowledge, because of their complexity they have not been used for in situ process improvement. Applicant has now found unexpectedly that cost of manufacture parameters can be used to advantage to improve both finishing control and cost of manufacture during real-time finishing. Particular cost of manufacture parameters are preferred because they have a large impact on efficiency and effectiveness of chemical mechanical finishing as well as the proper selection of improved process control parameters and their selected values. A preferred cost of manufacture parameter is the defect density. FIG. 10 illustrates the effect of defect density on the cost of manufacture for a particular semiconductor wafer (finished wafer valued of $500). Note that an increase of defect density from 0.01 to 0.03 can increase the cost of manufacture for finishing by about $1.50. Another preferred cost of manufacture parameter is equipment yield. FIG. 11 illustrates the effect of a decrease of 1% in equipment yield can increase the cost of manufacture by $2.50 (in process wafer valued of $250). Another preferred cost of manufacture parameter for in situ process control is the parametric yield. FIG. 12 illustrates the effect of a decrease of 1% in parametric yield which can increase the cost of manufacture by $5.00 (finished wafer valued of $500). Another preferred cost of manufacture parameter for in situ process control is the finishing rate. FIG. 13 illustrates the effect of a finishing rate improvement on the cost of manufacture. FIGS. 10–13 represent illustrative non-limiting graphs and equations which can be used to improve finishing with tracked information such as cost of manufacture parameters. Tracked information for specific workpieces and/workpiece batches can generally improve in situ finishing control by, for example, improving cost information. It is also generally useful to note that depending on the particular finishing conditions, an increase in finishing rate can have a lowering effect on cost of manufacture due to an increase in throughput and can simultaneously increase the cost of manufacture by increasing the yield loss due to increased defect density. By using a processor, appropriate calculations and/or algorithms can be used in situ to change and/or improve cost of manufacture in real-time. Without the processor and the ready access to preferred cost of manufacture parameters, it is difficult to properly improve the process control parameters during real-time finishing. Cost of manufacture parameters and Cost of Ownership metrics are generally known by those skilled in the semiconductor arts. SEMATECH has published generally widely accepted cost of manufacture parameters and Cost of Ownership metrics which are included herein by reference in their entirety for guidance and use of those skilled in the semiconductor art. Further, Wright Williams and Kelly of Dublin, Calif. have published a manual entitled "Understanding and Using Cost of Ownership" (rev. 0595-1) containing cost of manufacture parameters and equations for cost of manufacture calculation which is also included herein by reference in its entirety for guidance and use of those skilled in the semiconductor arts. Where specific reference is made herein to a specific definition of a particular cost of manufacture metric, applicant will use for instance the Wright Williams and Kelly parametric yield or the SEMATECH equipment yield naming for additional specificity. As illustrated in FIGS. 10–13, cost of manufacture information and cost of manufacture parameters are preferably used in or converted to common form of monetary value. The denomination of monetary value can be varied to the needs such as US dollars, Japanese yen, Euros, and the like. Use cost of manufacture parameter in a monetary value in the evaluations and/or determinations is preferred. Use cost of manufacture information in a monetary value in the evaluations and/or determinations is preferred. Conversion to a monetary value and/or between monetary values is generally known to those skilled in the art. Use of cost of manufacture parameters and cost of manufacture information in a common monetary denomination value is generally known to those skilled in the accounting arts.

Non limiting example of methods to make available preferred cost of manufacture information include use of various mathematical equations, calculating specific parameters, memory look-up tables or databases for generating certain parameters such as historical performance or preferred parameters or constants, neural networks, fuzzy logic techniques for systematically computing or obtaining preferred parameter values. It is also to be understood that often a single semiconductor wafer can undergo multiple wafer finishing steps. Each time the semiconductor wafer is finished in a wafer pass, the value of the semiconductor wafer increases due to multiple processing steps and thus the value of the equipment yield changes. A method which updates the cost of manufacture parameters consistent with the current manufacturing step is preferred. Those skilled in the arts of activity based accounting can generally setup appropriate look-up tables containing appropriate cost of manufacture parameters to use for in situ process control given the teachings and guidance herein. The semiconductor wafer can be tracked during processing with a tracking code. As an illustrative example, a semiconductor wafer can be assigned with a trackable UPC code. A method to mark and track semiconductor wafers sliced from an ingot through the manufacturing process are generally known. Activity based accounting and tracking code guidance can be found in U.S. Pat. No. 5,537,325 to Iwakiri and U.S. Pat. No. 5,732,401 to Conway and are included for by reference in their entirety for general background, guidance, and appropriate modification by those skilled in the art using the teachings and disclosures herein. Process and cost of manufacture information can be tracked and stored by wafer with this technology when used with the new disclosures herein.

A method of finishing of a semiconductor wafer surface being finished wherein a mathematical formula is used to calculate in situ at least one improved process control parameter value based at least in part upon at least one cost of manufacture parameter selected from the group consisting of parametric yield, equipment yield, defect density, and finishing rate and then adjusting in situ at least one improved process control parameter is preferred. A method of finishing of a semiconductor wafer surface being finished wherein a mathematical formula is used to calculate in situ at least one improved process control parameter value based at least in part upon at least two cost of manufacture parameters selected from the group consisting of parametric yield, equipment yield, defect density, and finishing rate and then adjusting in situ at least one improved process control parameter is more preferred. A method of finishing of a semiconductor wafer surface being finished wherein a mathematical formula is used to calculate in situ at least one improved process control parameter value based at least in part upon at least three cost of manufacture parameters selected from the group consisting of parametric yield, equipment yield, defect density, and finishing rate and then adjusting in situ at least one improved process control parameter is even more preferred. A method of finishing of a semiconductor wafer surface being finished wherein a mathematical formula is used to calculate in situ at least two improved process control parameter values based at least in part upon at least two cost of manufacture parameters selected from the group consisting of parametric yield, equipment yield, defect density, and finishing rate and then adjusting in situ at least those two improved process control parameters is even more particularly preferred. These preferred cost of manufacture parameters are relatively difficult to improve during in situ processing because of their complexity and because they can have opposite effects on the cost of manufacture and thus a processor is quite effective for these calculations. Preferably, the calculations can be completed at least 4 times during the finishing cycle time and more preferably the calculations can be completed at least 6 times during the finishing cycle time and even more preferably the calculations can be completed at least 10 times during the finishing cycle time and even more particularly preferably the calculations can be completed at least 20 times during the finishing cycle time. Preferably, the calculation to improve finishing using the in situ process information and the tracked information can be completed at least 4 times during the finishing cycle time and more preferably the calculations can be completed at least 6 times during the finishing cycle time and even more preferably the calculations can be completed at least 10 times during the finishing cycle time and even more particularly preferably the calculations can be completed at least 20 times during the finishing cycle time. Preferably, the in situ process control parameter value can be adjusted at least 4 times during the finishing cycle time and more preferably at least 6 times during the finishing cycle time and even more preferably at least 10 times during the finishing cycle time and even more particularly preferably at least 20 times during the finishing cycle time. Currently, a finishing cycle time of at most 6 minutes is preferred and of at most 4 minutes is more preferred and of at most 3 minutes is even more preferred. Generally shorter cycle times are preferred because this generally increases throughput and reduces costs. Currently, a finishing cycle time of at least one half minute is preferred. Finishing cycle time is a preferred cost of manufacture parameter for optimization. Evaluating in situ by adjusting at least 4 times during the finishing cycle time a finishing control parameter to change (more preferably to improve) the cost of manufacture of the semiconductor wafer surface being finished is preferred. Adjusting in situ by adjusting at least 4 times during the finishing cycle time a finishing control parameter to change (more preferably to improve) the cost of manufacture of the semiconductor wafer surface being finished is preferred. Controlling in situ by adjusting at least 4 times during the finishing cycle time a finishing control parameter to change (more preferably to improve) the cost of manufacture of the semiconductor wafer surface being finished is preferred. By repeatedly calculating and adjusting the process control parameter(s) value(s), better process control and improved cost of manufacture can be effected. By repeatedly calculating and adjusting the process control parameter(s) value(s) using in situ process information and tracked information, better process control, improved finishing, and improved cost of manufacture can generally be effected. Generally, a maximum of one hundred calculations and process control parameter adjustments during a finishing cycle time are preferred although more can be used for particularly critical semiconductor wafer finishing. A process control parameter which changes the friction during finishing is a preferred process control parameter and a process control parameter which changes the coefficient of friction is a more preferred process control parameter.

A processor can evaluate input signals rapidly with the cost of manufacture parameters with algorithms, look-up tables, fuzzy logic, iterative calculation methods, and/or solving multiple simultaneous equations to develop an improved output control signal from the controller and/or subsystem controller.

A process control parameter which changes the tangential force of friction during finishing is a preferred process control parameter and a process control parameter which changes the coefficient of friction is a more preferred process control parameter. A process control parameter which changes the tangential force of friction an appreciable amount during finishing is a preferred process control parameter and a process control parameter which changes the coefficient of friction an appreciable amount is a more preferred process control parameter. A change in the operative finishing motion is a preferred change and a change in the operative finishing motion relative velocity between the finishing surface and the workpiece surface measured in feet per minute is another preferred change.

A processor can evaluate input signals rapidly with the cost of manufacture parameters with algorithms, look-up tables, fuzzy logic, iterative calculation methods, and/or solving multiple simultaneous equations to develop an improved output control signal from the controller and/or subsystem controller.

The semiconductor industry is in a relentless journey to increase computing power and decrease costs. Using a cost of manufacture parameters for control of finishing is preferred and control of finishing during non-steady state process periods is even more preferred. Finishing of a semiconductor wafer using in situ calculations of cost of manufacture parameters to improve control finishing parameters can help simultaneously to decrease cost and reduce unwanted defects. Using current cost of manufacture parameters along with a friction sensing method to evaluate and adjust the boundary layer lubrication in a manner that adjustably controls the coefficient of friction in the operative finishing interface can be particularly effective at reducing unwanted surface defects such as microscratches and microchatter. This system is preferred for finishing with fixed abrasive finishing elements. In addition generally helping to improve such parameters as equipment yield, parametric yield, and defect density, the "cuttability" or cut rate of the fixed abrasive finishing element can generally be extended which improves uptime or equipment utilization. The coefficient of friction in the operative finishing interface can change any number of times during a relatively short finishing cycle time making manual calculations ineffective. Further, the semiconductor wafer cost of manufacture parameters are relatively complex to calculate and the finishing process is relatively short thus manual calculations for equipment adjustment and control are even more difficult and ineffective. Rapid, multiple adjustments of process control parameters using process sensors operatively connected to a processor with access to cost of manufacture parameters are particularly preferred for the rapid in situ process control which helps to increase computing power in the finished semiconductor wafer and decrease manufacturing costs. Thus one can more effectively control, preferably in situ, finishing during changes in lubricating aid changes (like composition, concentration, or operating condition changes) and as applied pressure or operative finishing motion changes by using the systems taught herein. Optimizing the cost of manufacture during real time with preferred operative friction sensor(s) information and useful cost of manufacture information such as current cost of manufacture information, preferably derived from individual and/or semiconductor wafer cost tracking information during manufacture, can aid in reducing costs on this relentless journey. Control of the coefficient of friction in the operative finishing interface is particularly useful and effective to help reduce unwanted surface defects, preferably when combined with real time cost of manufacture information, information processing capability, and real time finishing control capability. Tracked information such as cost of manufacture information can aid in improved effectiveness of in situ control of lubrication in the operative finishing interface.

Cost of manufacture parameters can be helpful in improving yields and reducing costs during planarizing of a semiconductor wafer(s). A recurring cost is a preferred cost of manufacture parameter. A material cost is a preferred recurring cost. A consumable cost is a preferred recurring cost. A maintenance cost is a preferred recurring cost. A labor cost is a preferred recurring cost. A utility or utilities are a preferred recurring cost. Supplies are a preferred recurring cost. A support cost is a preferred recurring cost. A personnel cost is a preferred recurring cost. A support services cost is a preferred recurring cost. Test wafers are a preferred cost of manufacture parameter. Fill wafers is a preferred cost of manufacture parameter. A fixed cost is a preferred cost of manufacture parameter. Depreciation is a preferred fixed cost parameter. Qualification cost is a preferred fixed cost parameter. Depreciation is a preferred fixed cost parameter. Installation is a preferred fixed cost parameter. Training is a preferred fixed cost parameter. Floor space is a preferred fixed cost parameter. Utilization is a preferred cost of manufacture parameter. Scheduled maintenance is a preferred utilization cost. Unscheduled maintenance is a preferred utilization cost. Assist time is a preferred utilization cost. Standby time is a preferred utilization cost. Production qualification time is a preferred utilization cost. Scheduled maintenance is a preferred utilization cost. Process engineering time is a preferred utilization cost. Mean time between failure is a preferred cost of manufacture parameter. Mean time to repair is a preferred cost of manufacture parameter. Mean time to test is a preferred cost of manufacture parameter. Change-out cost is a preferred cost of manufacture parameter. The change-out costs for changing from one polishing pad to another is a non-limiting example of a change-out cost. First pass first quality yield is a preferred cost of manufacture parameter. First pass first quality yield of semiconductor wafer batch is a preferred example of a preferred first pass first quality yield. First pass first quality yield die within a semiconductor wafer is a preferred example of a preferred first pass first quality yield. As discussed elsewhere herein, improving the cost of manufacture and yield for planarizing a semiconductor wafer and/or semiconductor die is generally useful and complex. As another instance, changing selected a control parameter(s) can shorten the life of a consumable such as a polishing pad (which raises costs) but can also enhances throughput, reduce needed floor space over time, and improve utilization. Commercial wafer fabs can produce in a general range of 20,000 to 35,000 semiconductor wafers a month, thus developing with tracked information, generally useful memory-lookup tables, databases, and improving algorithms to improve real time process control to improve yields and lower costs. Solving of simultaneous equations in situ using selected cost of manufacture parameters along with finishing progress information can also be used to improve yields and/or lower costs. Solving of simultaneous equations ex situ using selected cost of manufacture parameters along with finishing progress information can also be used develop memory look-up tables, databases, and/or to improve equations for use in situ (real time) to improve yields and/or lower costs.

Algorithms, memory look-up tables, databases, and methods to solve equations simultaneously are generally known. Statistical methods to monitor manufacturing yields are generally known. FIGS. 10–13 represent some general costs, graphs, and equations for some cost of manufacture parameters for a given set of input data and can generally be modified by those skilled in the art for new, specific manufacturing conditions for specific semiconductor wafers having die. Methods for predictive control are known in the control arts. Methods for adaptive control are known in the control arts. Methods using statistical procedures for non-constant mean variable control are generally known in the control arts. Modeling process methods to aid control are also known. Each of these can be preferred for specific applications. Predictive control, adaptive control, and dynamic process optimization have in used in the control arts. U.S. Pat. No. 5,661,669 to Mozumder, U.S. Pat. No. 5,740,033 to Wassick et al., U.S. Pat. No. 5,774,633 to BaBa et al., U.S. Pat. No. 5,987,398 to Halverson et al., U.S. Pat. No. 6,167,360 to Erickson et al., U.S. Pat. No. 6,249,712 to Boiquaye, and U.S. Pat. No. 6,289,508 to Erickson et al. give general examples process optimization and are included in their entirety for general guidance and appropriate modification by those skilled in the art.

In process costs tracked with an activity based cost model can be preferred. Activity based cost can measure a cost (or costs) by following activities along with their associated costs (resources used) during manufacture. Activity costs comprise resource related costs including labor, material, consumable, and equipment related activities which consume the costs. As a nonlimiting example, a resource can be refining equipment useful for planarizing, polishing, and buffing activities. The refining equipment cost can be related to the cost drivers of planarizing, polishing, and buffing activities by an output quantity (for example hours) consumed in each of planarizing, polishing, and buffing by cost driver per unit cost rate (for instance, $/hour of refining equipment used). In a similar manner, labor costs, material costs, and consumable costs can be assigned to activities using an appropriate cost driver(s) and output quantities. The activity costs can then be further related to the style, type, or intermediate stage of manufacture of a workpiece. Different types and/or different stages of manufacture of a semiconductor wafer use different amounts of different cost drivers (such as differences in planarizing, polishing, and buffing drivers). An activity based cost model having a multiple of different level of activity costs and a multiple of different cost drivers in each of the multiple of different levels of activity costs is preferred for semiconductor wafer refining process control. An activity cost is a preferred cost of manufacture parameter for process control. An activity cost and/or cost driver which is a mathematical composite derived from refining a multiplicity of workpieces are preferred. A mode, median or mean value of an activity cost and/or cost driver is a preferred example of a mathematical composite derived from refining a multiplicity of workpieces (or more preferably, workpiece batches). A multi-point moving mathematical composite (for instance a five point or ten point moving average) is a preferred example mathematical composite derived from refining a multiplicity of workpieces (or more preferably, workpiece batches). A preferred mathematical composite is derived, at least in part, mathematical expressions. Using a mathematical composite can facilitate process control using statistical methods to reduce short term noise which can adversely affect process control. An activity cost of the incremental costs associated with the specific step for instance, ILD planarizing is a preferred activity cost for process control. An activity cost of the cumulative costs associated up to and/or up to and including the specific step for instance, ILD planarizing is a preferred activity cost for process control. Each can give useful information for controlling the process control parameters. A multistage activity cost model is preferred for refining control during semiconductor wafer manufacture. An activity cost model based at least in part on the manufacturing sequential process activities is very preferred because this can aid in further evaluating the change(s) to a process control parameter when evaluating an activity based cost of manufacture parameter. Historical information including activity cost information is preferred stored in look-up tables. Cost drivers, activity functions, activity costs, and different activity cost models represent nonlimiting preferred historical information relating to activity costs for storing in a look-up table. An activity cost model based at least in part on the manufacturing process activities occurring chronologically in time is very preferred because this facilitates time sensitive process control with chronological activity costs. An activity cost model based at least in part on the manufacturing process activities occurring chronologically in time and further having a yield model is very preferred because this facilitates time sensitive process control with chronological activity costs including considerations of product yields.

Storing historical information including at least at least one cost of manufacture parameter in at least one lookup-table is preferred and storing historical information including at least at least two cost of manufacture parameters in at least one lookup-table is more preferred and storing historical information including at least at least five cost of manufacture parameters in at least one lookup-table is even more preferred and storing historical information including at least a majority of cost of manufacture parameters in at least one lookup-table is even more particularly preferred. Storing historical information including at least one process control parameter in at least one lookup-table is preferred and storing historical information including at least one process control parameters in at least one lookup-table is more preferred and storing historical information including at least five process control parameters in at least one lookup-table is even more preferred and storing historical information including a majority of the process control parameters in at least one lookup-table is even more particularly preferred. Historical information stored with tracking information related to individual workpieces is preferred and historical information stored with tracking information related to semiconductor wafer batches can also be preferred. Data mining can be accomplished on information used previously for process control. This reduces the cost of creating a new table or database for data mining. Further, the data mining results can be more readily applied to new, advanced process control algorithms. A cost of manufacture forecasting model can be accomplished on information used previously for process control. By having the cost of manufacture parameters stored in this manner, an improved cost of manufacture forecasting model can be developed and implemented. The new cost of manufacture models can be used when transitioning from a ramp-up phase of development to a commercial phase of development. New process control algorithms can be developed by evaluating ramp-up historical information including process control parameters and cost of manufacture parameters and then applying the new process control algorithm for commercial manufacture. New process control algorithms can be developed by evaluating previous historical information including process control parameters and cost of manufacture parameters and then applying the new process control algorithm for future commercial manufacture. Thus the historical information which is stored in a look-table is preferably used for a plurality of purposes to reduce the cost of manufacture and/or improved the enterprise profitability. By using the historical information used for initial process control multiple times, additional costs to collect information for data mining, cost of manufacture modeling, and process control algorithm improvement is accomplished in a new, more effective manner to give a new lower cost result.

Use of Information for Feedback, Feedforward, and Controller

Controllers to control the finishing of workpieces are generally known in the art. Controllers generally use information at least partially derived from the processor to make changes to the process control parameters. A processor is preferably operatively connected to a sensor to gain current information about the process and the processor is also operatively connected to a controller which preferably controls the finishing control parameters. As used herein, a control subsystem is a combination of an operative sensor operatively connected to a processor which is operatively connected to a controller which in turn can change finishing control parameters. Preferably, the control subsystem has real time access to tracked information on the workpiece being finished to improve control of finishing control parameters in real time (in situ) during the finishing cycle time (or a portion of the finishing cycle time). A friction sensor is a preferred operative sensor. A workpiece sensor is a preferred operative sensor. A secondary friction sensor is another example of a preferred operative sensor. A control subsystem having a plurality of operative sensors is preferred and a control subsystem having a plurality of friction sensors is more preferred and a control subsystem having a plurality of friction sensors and workpiece sensor is even more preferred. These control subsystems can better improve control of finishing particularly where heterogeneous lubrication and/or in situ changes to lubrication are made during the finishing cycle time.

An advantage of a preferred embodiment is the additional degree of control it gives to the operator performing planarization and/or polishing. To better utilize this control, the use of feedback information to control the finishing control parameters is preferred and in situ control is more preferred. Controlling the finishing control parameters selected from the group consisting of alternate finishing composition feed rates, alternate finishing composition concentration, operative finishing motion, and operative finishing pressure is preferred to improve control of the finishing of the workpiece surface being finished and in situ control is more particularly preferred. Another preferred example of a finishing control parameter is to use a different finishing element for a different portion of the finishing cycle time such as one finishing element for the planarizing cycle time and a different finishing element for the polishing cycle time. Workpiece film thickness, measuring apparatus, and control methods are preferred methods of control. Mathematical equations including those developed based on process results can be used. Mathematical algorithms for control based on process performance results can be preferred. Finishing uniformity parameters selected from the group consisting of Total Thickness Variation (TTV), Focal plane deviation (FPD), Within-Wafer Non-Uniformity (WIW NU), and surface quality are preferred. Average cut rate is a preferred finishing rate control parameter. Average finishing rate is a preferred finishing rate control parameter. A preferred average cut rate can be the average cut rate across the surface of a semiconductor wafer at a particular time. A preferred average cut rate can be the average cut rate across the uniform region of the surface of a semiconductor wafer at a particular time (for example a uniform compositional region). Controlling finishing for at least a portion of the finishing cycle time with a finishing sensor subsystem to adjust in situ at least one finishing control parameter that affects finishing results is a preferred method of control finishing. Information feedback subsystems are generally known to those skilled in the art. Illustrative non limiting examples of wafer process control methods include U.S. Pat. No. 5,483,129 to Sandhu issued in 1996, U.S. Pat. No. 5,483,568 to Yano issued in 1996, U.S. Pat. No. 5,627,123 to Mogi issued in 1997, U.S. Pat. No. 5,653,622 to Drill issued in 1997, U.S. Pat. No. 5,657,123 to Mogi issued in 1997, U.S. Pat. No. 5,667,629 to Pan issued in 1997, and U.S. Pat. No. 5,695,601 to Kodera issued in 1997 and are included herein by reference in their entirety for guidance and modification by those skilled in the art and are included herein by reference in their entirety.

Using an aqueous lubricating composition having at least one boundary lubricant to form a partial lubricating boundary layer between two surfaces when the surfaces are in operative friction contact is preferred. Lubricating boundary layers can be controlled by changing the boundary layer control parameters. A preferred group of aqueous lubricating composition control parameters consists of parameters selected from the group consisting of operative finishing motion, aqueous lubricating composition, aqueous lubricating composition feed rate, and temperature. Another preferred group of operative finishing motions consists of motions selected from the group consisting of continuous motion, discontinuous motion, pressure, and velocity of the motion. A preferred group of operative finishing motions consists of motions selected from the group consisting of continuous motion, intermittent motion, and velocity of the motion. Vibrating motion, linear motion, and circular motion are preferred motions for changing or controlling the lubricating boundary layer performance. Changing the pressure at the operative finishing interface can change the organic boundary layer lubricating performance and this is a preferred control parameter as discussed herein above. Changing the motion for example, with the speed or type of motion can change the organic boundary layer lubricating performance. Changing the feed rate of the lubricant can change the performance. Changing the pressure applied in the operative finishing interface, either total pressure or regional pressure, can change the lubricating boundary layer performance. Changing the temperature in the operative finishing interface, either average or regional temperatures, can change the lubricating boundary layer performance. Changing the chemistry of the aqueous lubricating composition can change the performance. Changing the pressure at the operative finishing interface can change the performance. The above parameters are preferred aqueous lubricating composition control parameters and can be used to effect changes in the finishing of the workpiece surface being finished. Changing an aqueous lubricating composition control parameter to change the effective coefficient of friction at the operative finishing interface is preferred and changing an aqueous lubricating composition control parameter to change the effective coefficient of friction at a region in the operative finishing interface is more preferred and changing an aqueous lubricating composition control parameter to change the effective coefficient of friction in at least in two regions of the operative finishing interface is even more preferred. Changing a control parameter to change the tangential force of friction at the operative finishing interface is preferred and changing a control parameter to change the tangential force of friction at a region in the operative finishing interface is more preferred and changing a control parameter to change the tangential force of friction in at least two regions of the operative finishing interface is even more preferred. Controlling at least one control parameter in situ is preferred and controlling at least one control parameter in situ with a subsystem controller is more preferred and controlling at least one control parameter in situ with a controller based on a secondary friction sensor signal is even more preferred.

Controlling at least one of the finishing control parameters using secondary friction sensor information combined with workpiece sensor information is preferred and controlling at least two of the finishing control parameters using secondary friction sensor information combined with workpiece sensor information is more preferred. Using an electronic finishing sensor subsystem to control the finishing control parameters is preferred. Feedback information selected from the group consisting of finishing rate information and product quality information such as surface quality information is preferred. Non-limiting preferred examples of process rate information include polishing rate, planarizing rate, and workpiece finished per unit of time. Non-limiting preferred examples of quality information include first pass first quality yields, focal plane deviation, total thickness variation, measures of non uniformity. Non-limiting examples particularly preferred for electronics parts include Total Thickness Variation (TTV), Focal plane deviation (FPD), Within-Wafer Non-Uniformity (WIW NU), and surface quality.

In situ process control systems relying on workpiece finishing sensors are generally known to those skilled in the CMP industry. Commercial CMP equipment advertised by Applied Materials and IPEC reference some of this equipment.

The use of aqueous lubricating compositions in finishing, particularly those having boundary lubricants, in a preferred embodiment including secondary friction sensor(s), friction sensor controllers, and friction sensor subsystems are unknown in the industry. Supplying a marginal organic boundary layer lubrication with in situ process control to control the fraction of semiconductor wafer surface area free of organic boundary layer lubrication is preferred and unknown in the industry.

Cost of manufacture information is also preferred information for control. Cost of manufacture information comprises preferred information for tracking. Finishing uniformity parameters selected from the group consisting of Total Thickness Variation (TTV), Focal plane deviation (FPD), Within-Wafer Non-Uniformity (WIW NU), and surface quality can be information for tracking. Total Thickness Variation (TTV), Focal plane deviation (FPD), Within-Wafer Non-Uniformity (WIW NU), and surface quality are illustrative preferred data types for tracking, particularly for multi-level semiconductor wafers where one levels data can be helpful for in situ control while finishing a different level. Types of cost of manufacture information can be preferred data types. Semiconductor wafer film or layer thickness is another illustrative example of data type of tracked information for in situ control since this can also help optimizing the in situ adjustment of finishing control parameters which change the local and/or macro coefficient of friction can generally aid finishing control.

A friction sensor subsystem which uses a processor which uses at least in part a mathematical equation to aid control is preferred. A mathematical equation developed from laboratory experience, semiworks experience, test wafer experience, and/or actual production can be preferred. Curve fitting to determine mathematical equations based on laboratory experience, semiworks experience, test wafer experience, and/or actual production are generally known to those skilled in the semiconductor arts. Mathematical equations can be used also generally for interpolation and extrapolation. Multiple mathematical equations with multiple unknowns can be solved or resolved in real time for improved process control with a processor. Differential information from multiple workpiece sensors and/or friction sensors can generally be used to improve real time (in situ) control with a processor. A lubrication control subsystem, a friction sensor subsystem, a finishing control subsystem, and a control subsystem can generally use mathematical equations to aid control. A friction sensor subsystem having at least one friction sensors is preferred and having at least two friction sensors is more preferred. A friction sensor subsystem having at least one friction sensor probe is preferred and having at least two friction sensor probes is more preferred.

A model to aid process control can be preferred which uses cost of manufacture parameters for process control. A process model is a preferred example of a model, which can be used in some embodiments for a process control and a process model which includes differential lubrication is a more preferred example of a model, each of which can be used in some embodiments for process control. A cost model is a preferred example of a model which can be used in some embodiments for a process control. A business model which determines profit using costs and revenue is a preferred example of a model which can be used in some embodiments for a process control. A business model costs and revenue is a preferred example of a model which can be used in some embodiments for a process control. A business model using activity based accounting which determines profit using costs and revenue is a more preferred example of a model which can be used in some embodiments for a process control. A business model having access to a cost model and a sales model is a preferred example of a model which can be used in some embodiments for a process control. A business model having access to at least one cost of manufacture parameter, a cost model, and a sales model is a preferred example of a model which can be used in some embodiments for a process control. A business model having access to at least three cost of manufacture parameters, a cost model, and a sales model is a more preferred example of a model which can be used in some embodiments for a process control. A cost model using activity accounting is a preferred example of a model which can be used in some embodiments for process control. An activity based cost model is a preferred example of a model which can be used in some embodiments for a process control. A cost of manufacture model is a preferred example of a cost model which can be used in some embodiments for a process control. A cost of manufacture model using activity accounting is a preferred example of a cost model, which can be used in some embodiments for a process control. An activity based cost of manufacture model is a preferred example of a cost model which can be used in some embodiments for a process control. A sales model is a preferred example of a cost model which can be used in some embodiments for a process control. An activity based cost of sales model is a preferred example of a cost model which can be used in some embodiments for process control. An activity based cost of sales model which assigns activity costs by customer is a more preferred example of a cost model which can be used in some embodiments for process control. An activity based cost of sales model which assigns activity costs by customer and order is an even more preferred example of a cost model which can be used in some embodiments for process control. An empirically-based model can be preferred. An empirically-based model developed at least in part on stored historical performance is preferred. Process models are generally known to those skilled in the semiconductor wafer manufacturing arts. Determining a change for at least one process control parameter using at least one model disclosed herein for changing and/or controlling the method of making a workpiece is preferred. Cost models can, given the guidance and teachings herein, cost models can generally be developed by those generally skilled in the art and used for process control as used herein. Additional general helpful guidance on business, cost, and profit models can be found in the books *Principles of Corporate Finance* by Richard A. Bealey and Stewart C. Myers, McGraw-Hill Companies, 1996, *Activity-based Cost Management Making* Work by Gary Cokins, McGraw-Hill Companies, 1996 and *Pricing for Profitability* by John L. Daly, John Wiley & Sons, Inc., 2002 and are included herein in their entirety for general guidance and modification by those skilled in the arts.

An empirically-based process model can be preferred. An empirically based process model developed in least in part on historical performance is preferred. A mathematical equation and/or formula developed from laboratory experience, semiworks experience, test wafer experience, and/or actual production can be preferred. Curve fitting to determine a mathematical equation and/or formula based on laboratory experience, semiworks experience, test wafer experience, and/or actual production is generally known to those skilled in the semiconductor arts. Curve fitting to determine mathematical formulas using historical performance can be preferred. Mathematical equations generally can be used also for interpolation and extrapolation. Multiple mathematical equations with multiple unknowns can be solved or resolved in real time for improved process control with a processor. A first principles-based process model can also be used for control. Using at least in part a first principles process model and at least in part an empirically based process model can be preferred for process control. A yield model can also be preferred for process control. A yield model based at least in part on historical performance is currently preferred. A recipe for finishing a semiconductor wafer can also be used. A recipes can be developed and/or modified based on historical performance. Multiple recipes stored in the look-up tables is preferred. A process model, more preferably multiple process models can be stored in the look-up tables. A processor having access to the look-up tables is preferred. Yield models are generally known to those skilled in the semiconductor wafer manufacturing arts. Process models are generally known to those skilled in the semiconductor wafer manufacturing arts.

Connecting this process control technology, especially non-steady state process to control, in a networking fashion to other equipment in a factory can be preferred. Information on layer thickness, processing times, uniformity, and the like can be shared between equipment to further change and/or improve cost of manufacture. Connecting this process control technology, especially non-steady state process to control, in a networking fashion to other equipment in a factory can be preferred. Information on layer thickness, processing times, uniformity, and the like can be shared between equipment to further change and/or improve business performance and/or profits. For instance, if the layer added is thicker or thinner than target processing conditions for that station, the next station of finishing can be adjusted accordingly to change the finishing recipe and/or conditions. For instance, if the layer is too thick, the next station (if removing material) can be adjusted to remove material more aggressively or for a longer processing period. An apparatus for finishing connected to a multiplicity of other workpiece fabrication machinery, and information derived therefrom in an operative computerized network, the control subsystem having access to at least a portion of the other workpiece fabrication machinery, metrology equipment, and information derived therefrom is preferred. An apparatus for finishing connected to a multiplicity of other workpiece fabrication machinery, and information derived therefrom in an operative computerized network, the control subsystem having access to the other workpiece fabrication machinery, metrology equipment, and information derived therefrom for feedforward and feedback control while applying the finishing energy to the workpiece is also preferred. A process model is preferred for improved process control. A cost of manufacture model is preferred for improved process cost awareness and control thereof. An activity based cost of manufacture model is more preferred for improved process cost awareness and control thereof.

Storing information for later use including information selected from the group consisting of a sales cost, revenue, a customer, customer order, and a model along with a cost of manufacture parameter in a processor readable memory device is preferred. Storing information including information selected from the group consisting of a sales cost, revenue, a customer, customer order, and a model along with a cost of manufacture parameter and a workpiece tracking code in a processor readable memory device for later use is preferred. Storing information for later use including information selected from the group consisting of a sales cost, revenue, a customer, customer order, and a model along with cost of manufacture information including at least a cost of manufacture parameter in a processor readable memory device is preferred. Storing information for later use including information selected from the group consisting of a sales cost, revenue, a customer, customer order, and a model along with cost of manufacture information including at least a cost of manufacture parameter and a workpiece tracking code in a processor readable memory device is preferred. Storing information for later use including information selected from the group consisting of a sales cost, revenue, a customer, customer order, and a model along with cost of manufacture information including at least a cost of manufacture parameter and a workpiece tracked information in a processor readable memory device is preferred. Storing information for later use including information selected from the group consisting of a sales cost, revenue, a customer, customer order, and a model along with cost of manufacture information including at least three cost of manufacture parameters and workpiece tracking code in a processor readable memory device is preferred. Storing information for later use including information selected from the group consisting of a sales cost, revenue, a customer, customer order, and a model along with cost of manufacture information including at least three cost of manufacture parameters and workpiece tracked information in a processor readable memory device is preferred. Determining a change for a model with the stored information is preferred. Determining a change for a process model with the stored information is preferred. Determining a change for a cost model with the stored information is preferred. Determining a change for a cost of manufacture model with the stored information is preferred. Determining for a change a business model with the stored information is preferred. Changing a model after determining a change is preferred. Using the changed model for feedforward control is preferred. Using the changed model for feedback control is preferred. Using the changed model for real time control is more preferred. Determining a change for a process control parameter with the stored information is preferred. Changing a process control parameter after determining a change is preferred.

Reducing the processor readable storage space used for the stored information is preferred. Reducing the computer readable storage space used for the stored information is preferred. Reducing the stored information using a computer algorithm is preferred. Reducing the stored information using a computer algorithm is preferred. Reducing the stored information using at least one mathematical algorithm is preferred. By reducing the stored information, the costs can be reduced. Determining a change for a model with the reduced stored information is preferred. Determining a change for a process model with the reduced stored information is preferred. Determining a change for a cost model with the reduced stored information is preferred. Determining a change for a cost of manufacture model with the reduced stored information is preferred. Determining for a change a business model with the reduced stored information is preferred. Changing a model after determining a change is preferred. Using the changed model for feedforward control is preferred. The storage space is preferably processor readable. The storage space is preferably computer readable. Using the changed model for feedback control is preferred. Using the changed model for real time control is more preferred. Determining a change for a process control parameter with the reduced stored information is preferred. Changing a process control parameter after determining a change is preferred.

A run to run, batch to batch, and in situ process control method having the features and benefits of the preferred embodiment of this invention are new and useful. The feedforward and feedback process control method having features and benefits of the preferred embodiments of this invention are new and useful. The networking of process equipment and methods of control have features and benefits of the preferred embodiments of this invention are new and useful.

Further Comments on Method of Operation

Some particularly preferred embodiments directed at the method of finishing are now discussed.

Controlling the thickness of a lubricating film by changing at least one lubrication control parameter in a manner that changes the coefficient of friction in at least two different regions in the operative finishing interface in response to an in situ control signal is preferred. Controlling the thickness of the lubricating film by changing at least two process control parameters in situ based on feed back information from a lubrication control subsystem having a friction sensor is also preferred. Controlling at least once the thickness of the lubricating film which changes the coefficient of friction in the operative finishing interface by changing at least one process control parameter in situ based on feed back information from a control subsystem during the finishing cycle time is preferred. A semiconductor wafer surface having at least a first region wherein the lubricating film is at most one half the molecular layer thickness compared to the lubricating film thickness on a second, different region is preferred and a semiconductor wafer surface having at least a first region wherein the lubricating film thickness is at most one third the molecular layer thickness compared to the lubricating film on a second, different region is more preferred when controlling the coefficient of friction, particularly when controlling the changes in the coefficient of friction. Controlling the thickness of the lubricating film by changing at least one process control parameter in situ based on feed back information from a control subsystem during the finishing cycle time and wherein the control subsystem tracks and updates the feed back information for finishing a plurality of the metal layers is even more preferred for semiconductor wafers having multiple functional levels. An organic lubricating film is preferred.

A finishing aid selected from the group consisting of a lubricating aid and chemically reactive aid is preferred. A finishing aid which reacts with the workpiece surface being finished is preferred and which reacts with a portion of the workpiece surface being finished is more preferred and which differentially reacts with heterogeneous portions of a workpiece surface being finished is even more preferred. By reacting with the workpiece surface, control of finishing rates can be improved and some surface defects minimized or eliminated. A finishing aid which reacts chemically with the workpiece surface is preferred. A finishing aid which reduces friction during finishing is also preferred because surface defects can be minimized.

Supplying an effective amount of finishing aid, more preferably a lubricating aid, which reduces the coefficient of friction between the finishing element finishing surface and the workpiece surface being finished is preferred. Supplying an effective amount of finishing aid, more preferably a lubricating aid, which reduces the unwanted surface damage to the surface of the workpiece being finished during finishing is preferred. Supplying an effective amount of finishing aid, more preferably a lubricating aid, which differentially lubricates different regions of the work piece and reduces the unwanted surface damage to at least a portion of the surface of the workpiece being finished during finishing is preferred. Sensing the change in friction with the operative process sensors can be accomplished using technology disclosed herein. At least one processor sensor is preferred and at least two processor sensors are more preferred and at least three process sensors are even more preferred and at least five process sensors is even more preferred for control finishing. A preferred operative process sensor is an operative friction sensor. A preferred operative process sensor is an operative workpiece sensor. Sensing a change in friction of an operative process sensor is preferred and sensing a change in friction with a plurality of operative process sensors is more preferred. Sending the information sensed from an operative process sensor about finishing to a processor having access to cost of manufacture parameters is preferred and sending the information sensed from a plurality of operative process sensors about finishing to a processor having access to cost of manufacture parameters is more preferred. Sensing a change in friction of an operative friction sensor is preferred and sensing a change in friction with a plurality of operative friction sensors is more preferred. Sending the information sensed from an operative process sensor about finishing to a processor having access to tracked information is preferred and sending the information sensed from a plurality of operative process sensors about finishing to a processor having access to tracked information is more preferred and sending the information sensed from at least three operative process sensors about finishing to a processor having access to tracked information is more preferred. Sending the information sensed from an operative friction sensor about finishing to a processor having access to cost of manufacture parameters is preferred and sending the information sensed from a plurality of operative friction sensors about finishing to a processor having access to cost of manufacture parameters is more preferred. An optical friction sensor is a preferred friction sensor. Non-limiting preferred examples of optical friction sensors is an infrared thermal sensing unit such as a infrared camera and a laser adjusted to read minute changes of movement friction sensor probe to a perturbation A non-optical sensing friction sensor is a preferred friction sensor. Non-limiting preferred examples of non-optical friction sensors include thermistors, thermocouples, diodes, thin conducting films, and thin metallic conducting films. Changing a control parameter to change the tangential force of friction in the operative finishing interface is preferred and changing a control parameter to change the tangential force of friction at a region in the operative finishing interface is more preferred and changing a control parameter to change the tangential force of friction in at least two regions of the operative finishing interface is even more preferred. Control of the tangential force of friction and/or the coefficient of friction in the operative finishing interface is particularly useful and effective to help reduce unwanted surface defects.

A preferred friction sensor subsystem has access to cost of manufacture parameters, preferably useful cost of manufacture parameters, and even more preferably trackable and useful cost of manufacture parameters. A preferred example of generally useful cost of manufacture information is current cost of manufacture information which has been tracked and more preferably updated using generally known activity based accounting techniques. Another preferred example of useful cost of manufacture parameters is the cost of manufacture of manufacturing steps which preceded the current finishing step such as prior finishing steps, metallization steps, or interlayer dielectric steps. Another preferred example of useful cost of manufacture parameters is the cost of manufacturing steps which occur after the current finishing step such as later finishing steps, metallization steps, or interlayer dielectric steps. The current finishing step can affect the cost of manufacture of a later step because some defects such generally poor planarity can adversely impact latter manufacturing step costs such as by negativity impacting latter step yields. A finishing control subsystem and/or a friction sensor subsystem having access to cost of manufacture parameters is preferred and having access to current cost of manufacture parameters is more preferred and having trackable information is even more preferred.

Evaluating finishing control parameters in situ for improved adjustment using finishing control is preferred and using the finishing control parameters in situ at least in part for this improved adjustment of finishing control is more preferred. Evaluating finishing control parameters in situ with tracked information for improved adjustment of finishing control is preferred and using the finishing control parameters in situ at least in part for this improved adjustment of finishing control is more preferred. Cost of manufacture information is an example of preferred tracked information. Prior steps such as metallizing steps, annealing steps, insulating layers steps represent non-limiting examples of preferred tracked information. Prior steps can impact the preferred in situ control of finishing control parameters such as, but not limited to, lubricating changes to the operative finishing interface, preferred pressures, and preferred coefficient of friction (either regional or across the operative finishing interface). For instance, if the metal layer has larger crystals due to the type of annealing which are subject to "pickout defects", lower a lower coefficient of friction in the conductive region (such as copper or copper alloy) can be preferred. In another application, the semiconductor can have multiple layers of porous low-k insulating layers which have lower tensile strengths and can form unwanted defects if subjected to high forces of friction during finishing. Changing the lubricating, downward pressure, and/or tangential friction of the operative finishing interface can reduce unwanted damage to the porous low-k layers. In another application, the interface between a conductive layer and a nonconductive layer can be of lower strength and thus again high forces of friction and/or applying unnecessary stress on the semiconductor wafer surface during planarizing can form unwanted defects which can cause unwanted yield losses during manufacture. Changing the finishing control parameters to reduce the coefficient of friction and/or reducing the unnecessary stresses in situ can aid in reducing unwanted yield losses. Thus tracked information can be used in situ to improve process control during finishing with a finishing control subsystem. Providing a finishing control subsystem having at least two operative process sensors for sensing in situ process information and having access to the tracking information is preferred and providing a finishing control subsystem having at least three operative process sensors for sensing in situ process information and having access to the tracking information is more preferred and providing a finishing control subsystem having at least five operative process sensors for sensing in situ process information and having access to the tracking information is even more preferred. Changing a control parameter in response to the in situ process information and tracking information which changes the coefficient of friction and/or stresses during at least a portion of the planarizing cycle time is preferred and which changes the coefficient of friction and/tangential force of friction in a uniform region of the workpiece surface is more preferred and which changes the coefficient of friction and/tangential force of friction in a plurality uniform regions of the workpiece surface is even more preferred.

A method which updates the cost of manufacture control parameters, look-up tables, algorithms, or control logic consistent with the current manufacturing step is preferred. A method which updates the tracked information such as the cost of manufacture control parameters, look-up tables, algorithms, or control logic consistent with the current manufacturing step while evaluating prior manufacturing steps (such as completed manufacturing steps) is more preferred. A method which updates with tracked information such as the cost of manufacture control parameters, look-up tables, algorithms, or control logic consistent with the current manufacturing step while evaluating future manufacturing steps is even more preferred. A method which updates with tracked and/or trackable information (such as projectable information) such as the cost of manufacture control parameters, look-up tables, algorithms, or control logic consistent with the current manufacturing step while evaluating both prior and future manufacturing steps is even more preferred. Memory look-up tables and databases can have preferred data types. A tracking code is a preferred method to aid evaluation of prior, current, and future manufacture steps. The tracking code can be related to individual semiconductor wafer and/or a semiconductor wafer batch. This can facilitate low cost manufacture and improved in situ control of planarizing. This is preferred for multi-level semiconductor wafer processing because one level finishing can affect the next level finishing. This is because a defect formed on one layer can generally affect (usually adversely) the next level(s). Further, the type and composition of each layer can impact the improved real time control of finishing such as where a particular layer has a reduced strength due to porosity.

An operative process sensor is preferred and at least two operative process sensors is more preferred and at least three operative sensors is even more preferred and at least five operative sensors is even more particularly preferred. Evaluating the in situ process information obtained from at least two operative sensors is a preferred and evaluating the in situ process information obtained from at least three of the operative sensors is more preferred and evaluating the in situ process information obtained from at least four of the operative sensors is even more preferred and evaluating the in situ process information obtained from at least five of the operative sensors is even more particularly preferred. By having multiple operative sensor information compared, preferably with mathematical expressions, algorithms, memory look-up tables and/or with data bases, differential localized lubrication such as on uniform regions in the operative finishing interface can better be detected, quantified, and controlled by controlling the finishing control parameters in real time. Preferred control of the finishing control parameters by evaluating process information with cost of manufacture parameters can increase manufacturing yields and reduce cost.

Providing a finishing element finishing surface for finishing is preferred and providing a finishing element finishing surface having finishing aids for finishing is also preferred and providing a finishing element having a finishing element finishing surface having finishing aids dispersed therein for finishing is also preferred. Providing the workpiece surface being finished proximate to the finishing surface is preferred and positioning the workpiece surface being finished proximate to the finishing element finishing surface is more preferred.

Supplying a planarizing aid to the workpiece surface being finished which changes the rate of a chemical reaction (planarizing chemical energy) is preferred. Supplying a planarizing aid to the workpiece surface being finished which changes the a coefficient of friction (planarizing frictional energy) is preferred. Supplying and controlling a planarizing aid to the workpiece surface being finished having a property selected from the group consisting of changing the workpiece surface coefficient of friction, changing workpiece surface average cut rate, and changing the cut rate of a specific material of the workpiece surface being finished is particularly preferred.

A semiconductor wafer surface having at least a first region wherein the lubricating film is at most one half the molecular layer thickness compared to the lubricating film thickness on a second, different region is preferred and a semiconductor wafer surface having at least a first region wherein the lubricating film thickness is at most one third the molecular layer thickness compared to the lubricating film on a second, different region is more preferred when controlling the coefficient of friction, particularly when controlling the changes in the coefficient of friction. Controlling the thickness of the lubricating film by changing at least one process control parameter in situ based on feed back information from a control subsystem during the finishing cycle time and wherein the control subsystem tracks and updates the feed back information for finishing a plurality of the metal layers is even more preferred for semiconductor wafers having multiple functional levels. An organic lubricating film is preferred.

Supplying an operative finishing motion between the workpiece surface being finished and the finishing element finishing surface is preferred and applying an operative finishing motion between the workpiece surface being finished and the finishing element finishing surface is more preferred. The operative finishing motion creates the movement and pressure at the operative finishing interface which supplies the finishing action such as chemical reactions, tribochemical reactions and/or abrasive wear generally caused by the abrasive particles. Applying an operative finishing motion that transfers the finishing aid to the interface between the finishing surface and the workpiece surface being finished is preferred and applying an operative finishing motion that transfers the finishing aid forming a marginally effective lubricating layer in the operative finishing interface is more preferred and applying an operative finishing motion that transfers the finishing aid, forming a marginally effective lubricating boundary layer in the operative finishing interface is even more preferred. The lubrication at the interface reduces the occurrence of high friction, facilitates reductions in finishing energy, and can help reduce related workpiece surface damage. Applying an operative finishing motion that transfers the finishing aid, forming a lubricating boundary layer between at least a portion of the finishing surface and the semiconductor wafer surface being finished is preferred and applying an operative finishing motion that transfers the finishing aid, forming a marginally effective lubricating layer between at least a portion of the finishing surface and the semiconductor wafer surface being finished in order to control abrasive wear occurring to the semiconductor wafer surface being finished is more preferred and applying an operative finishing motion that transfers the finishing aid, forming a marginally effective lubricating boundary layer between at least a portion of the finishing surface and the semiconductor wafer surface being finished in a manner that tribochemical wear occurs to the semiconductor wafer surface being finished is even more preferred and applying an operative finishing motion that transfers the finishing aid, differentially lubricating different regions of the heterogeneous semiconductor wafer surface being finished is even more particularly preferred. With heterogeneous workpiece surfaces, the potential to differentially lubricate and finish a workpiece surface has high value where the differential lubrication is understood and controlled.

A finishing aid selected from the group consisting of a lubricating aid and chemically reactive aid is preferred. A finishing aid which reacts with the workpiece surface being finished is preferred and one which reacts with a portion of the workpiece surface being finished is more preferred and one which differentially reacts with heterogeneous portions of a workpiece surface being finished is even more preferred. By reacting with the workpiece surface, control of finishing rates can be improved and some surface defects minimized or eliminated. For instance, a preferred organic lubricating boundary layer can react with the workpiece surface. A finishing aid which reduces friction during finishing is also preferred because surface defects can be minimized.

Cleaning the workpiece surface reduces defects in the semiconductor later on in wafer processing.

Supplying a finishing aid to the workpiece surface being finished which changes the rate of a chemical reaction is preferred. Supplying and controlling a finishing aid to the workpiece surface being finished having a property selected from the group consisting of changing the workpiece surface coefficient of friction, changing workpiece surface average cut rate, and changing the cut rate of a specific material of the workpiece surface being finished is particularly preferred.

Providing at least one friction sensor having a friction sensing surface proximate to the finishing element finishing surface and free of contact with the semiconductor wafer surface is preferred and providing at least two friction sensors having friction sensing surfaces proximate to the finishing element finishing surface and free of contact with the semiconductor wafer surface is more preferred. Applying an operative friction sensor motion between the friction sensor surface and the finishing element finishing surface is preferred and applying an operative friction sensor motion between at least two friction sensor surfaces and the finishing element finishing surface is more preferred. Applying at least two separate and independent operative friction sensor motions between at least two friction sensor surfaces and the finishing element finishing surface is even more preferred in complex finishing situations. A friction sensor, preferably a plurality of friction sensors, can better detect changes in and control of finishing in many finishing situations and especially when lubricating aids are added to the operative finishing interface. Controlling in situ a finishing control parameter with a friction sensor subsystem is preferred and controlling in situ a finishing control parameter with a finishing sensor subsystem is more preferred. As used herein, a friction sensor subsystem includes the friction sensor probe, the processor, and the controller along with the operative connections needed therefore. As used herein, a finishing sensor subsystem includes the friction sensor probe, workpiece sensor (if available), a processor, and a controller along with the operative connections needed therefore. As used herein, a finishing sensor subsystem always has at least one friction sensor probe and a finishing sensor subsystem having at least two friction sensor probes is more preferred and a finishing sensor subsystem having at least one friction sensor probe and at least one workpiece sensor is also more preferred and a finishing sensor subsystem having at least two friction sensor probes and at least one workpiece sensor is particularly preferred for controlling finishing of semiconductor wafers.

Controlling in real time with a control subsystem a finishing property selected from the group consisting of workpiece surface coefficient of friction, workpiece finish rate, and workpiece surface chemical reaction is preferred. Controlling in real time with a control subsystem at least two finishing properties selected from the group consisting of workpiece surface coefficient of friction, workpiece finish rate, and workpiece surface chemical reaction is more preferred. Controlling in real time with a control subsystem at least three finishing properties selected from the group consisting of workpiece surface coefficient of friction, workpiece finish rate, and workpiece surface chemical reaction is even more preferred. Controlling in real time with a control subsystem a regional finishing property of a workpiece selected from the group consisting of workpiece surface coefficient of friction, workpiece finish rate, and workpiece surface chemical reaction is preferred. Controlling in real time with a control subsystem at least two regional finishing properties of a workpiece selected from the group consisting of workpiece surface coefficient of friction, workpiece finish rate, and workpiece surface chemical reaction is more preferred. Controlling in real time with a control subsystem at least three regional finishing properties of a workpiece selected from the group consisting of workpiece surface coefficient of friction, workpiece finish rate, and workpiece surface chemical reaction is even more preferred. A preferred regional finishing property is the finishing rate on a conductive region of a semiconductor wafer surface having both conductive and nonconductive regions. Another preferred regional finishing property is the chemical reaction rate on an unwanted raised region of a semiconductor wafer surface having both unwanted raised regions and lower regions proximate to the unwanted raised regions. Controlling an organic lubricating film is a preferred method to control the coefficient of friction. Controlling an organic lubricating boundary layer is a preferred method to control the coefficient of friction.

Using the method of this invention to finish a workpiece, especially a semiconductor wafer, by controlling finishing for a period of time with an operative measurement and control subsystem operatively connected to the finishing equipment control mechanism to adjust in situ at least one finishing control parameter that affect finishing selected from the group consisting of the finishing rate and the finishing uniformity is preferred. Operative connections are generally known to those skilled in the art. Optical fiber connection are an example of a preferred operative connection.

Sensing the friction between the friction sensor surface and the finishing element finishing surface with at least one friction sensor subsystem is preferred. Sensing the friction between the friction sensor surface and the finishing element finishing surface with at least one finishing sensor subsystem is more preferred, particularly if a workpiece sensor is operable.

Using the method of this invention to finish a workpiece, especially a semiconductor wafer, by controlling finishing for a period of time with a friction sensor subsystem to adjust in situ at least one finishing control parameter that affects finishing selected from the group consisting of the finishing rate and the finishing uniformity is preferred. A finishing control parameter selected from the group consisting of the finishing composition, finishing composition feed rate, finishing temperature, finishing pressure, operative finishing motion velocity and type, and finishing element type and condition change is preferred. A preferred friction sensor subsystem and a preferred finishing sensor subsystem is operatively connected electrically to the lubrication control mechanism(s). A preferred method to measure finishing rate is to measure the change in the amount of material removed in angstroms per unit time in minutes (.ANG./min). Guidance on the measurement and calculation for polishing rate for semiconductor parts is found in U.S. Pat. No. 5,695,601 to Kodera et. al. issued in 1997 and which are included herein in entirety for illustrative guidance. Methods to measure and monitor finishing rate in angstroms per minute is generally known to those skilled in the relevant art.

An average finishing rate range is preferred, particularly for workpieces requiring very high precision finishing such as in process electronic wafers. Average cut rate is used as a preferred metric to describe preferred finishing rates. Average cut rate is metric and is generally known to those skilled in the art. For electronic workpieces, such as wafers, a cut rate of from 100 to 25,000 Angstroms per minute on at least a portion of the workpiece is preferred and a cut rate of from 200 to 15,000 Angstroms per minute on at least a portion of the workpiece is more preferred and a cut rate of from 500 to 10,000 Angstroms per minute on at least a portion of the workpiece is even more preferred and a cut rate of from 500 to 7,000 Angstroms per minute on at least a portion of the workpiece is even more particularly preferred and a cut rate of from 1,000 to 5,000 Angstroms per minute on at least a portion of the workpiece is most preferred. A finishing rate of at least 100 Angstroms per minute for at least one of the regions on the surface of the workpiece being finished is preferred and a finishing rate of at least 200 Angstroms per minute for at least one of the materials on the surface of the workpiece being finished is preferred and a finishing rate of at least 500 Angstroms per minute for at least one of the regions on the surface of the workpiece being finished is more preferred and a finishing rate of at least 1000 Angstroms per minute for at least one of the regions on the surface of the workpiece being finished is even more preferred where significant removal of a surface region is desired. During finishing there are often regions where the operator desires that the finishing stop when the target is reached such when removing a conductive region (such as a metallic region) over a non conductive region (such as a silicon dioxide region). For regions where it is desirable to stop finishing (such as the silicon dioxide region example above), a finishing rate of at most 1000 Angstroms per minute for at least one of the regions on the surface of the workpiece being finished is preferred and a finishing rate of at least 500 Angstroms per minute for at least one of the materials on the surface of the workpiece being finished is preferred and a finishing rate of at least 200 Angstroms per minute for at least one of the regions on the surface of the workpiece being finished is more preferred and a finishing rate of at least 100 Angstroms per minute for at least one of the regions on the surface of the workpiece being finished is even more preferred. When a low cut rate is desired (for example final finishing, polishing or buffing), a finishing cut rate of at least 10 Angstroms per minute is preferred. The finishing rate can be controlled with organic boundary lubricants and with the process control parameters discussed herein.

Using finishing of this invention to remove raised surface perturbations and/or surface imperfections on the workpiece surface being finished is preferred. Using the method of this invention to finish a workpiece, especially a semiconductor wafer, at a planarizing rate and/or planarizing uniformity according to a controllable set of finishing control parameters that upon variation change the planarizing rate and/or planarizing uniformity and wherein the finishing parameters consist of at least two finishing control parameters is more preferred. Using the method of this invention to polish a workpiece, especially a semiconductor wafer, wherein a finishing sensor subsystem changes an operative finishing composition feed mechanism in situ is preferred. The finishing sensor subsystem and/or friction sensor subsystem is preferably operatively connected electrically to the operative lubrication feed mechanism.

Using the method of this invention to polish or planarize a workpiece, especially a semiconductor wafer, supplying lubricant moderated by a finishing element having at least two layers is preferred. A finishing element having at least two layers wherein the finishing surface layer has a higher hardness than the subsurface layer is more preferred, particularly for planarizing. A finishing element having at least two layers wherein a finishing surface layer has a lower hardness than the subsurface layer is also preferred, particularly for polishing.

Changes in lubricant, particularly active lubrication, at the operative finishing interface can significantly affect finishing rates and finishing performance in ways that current workpiece sensors cannot handle as effectively as desired. For instance, current workpiece sensors cannot effectively monitor and control multiple real time changes in boundary lubricant, particularly active lubrication, and changes in finishing such as finishing rates. This renders prior art workpiece sensors less effective for controlling and stopping finishing where friction is adjusted or changed in real time. Friction sensor subsystems having friction sensors remote from and unconnected to the workpiece can help to improve real time control wherein the boundary lubrication is changed during the finishing cycle time. Preferred friction sensors include optical friction sensors and non-optical friction sensors. An optical friction sensor is a preferred friction sensor. Non-limiting preferred examples of optical friction sensors are an infrared thermal sensing unit such as an infrared camera and a laser adjusted to read minute changes of movement of the friction sensor probe to a perturbation. A non-optical sensing friction sensor is a preferred friction sensor. Non-limiting preferred examples of non-optical friction sensors include thermistors, thermocouples, diodes, thin conducting films, and thin metallic conducting films. Electrical performance versus temperature such as conductivity, voltage, and resistance is measured. Those skilled in the thermal measurement arts are generally familiar with non-optical thermal sensors and their use. A change in friction can be detected by rotating the friction sensor in operative friction contact with the finishing element finishing surface with electric motors and measuring current changes on one or both motors. The current changes related to friction changes can then be used to produce a signal to operate the friction sensor subsystem. Where the material changes with depth during the finishing of a workpiece being finished, one can monitor friction changes with the friction sensor probe(s) having dissimilar materials even with active lubrication and therefore readily detect the end point. As an additional example, the finishing rate can be correlated with the instantaneous lubrication at the operative finishing interface, a mathematical equation can be developed to monitor finishing rate with instantaneous lubrication information from the secondary sensor and the processor then in real time calculates finishing rates and indicates the end point to the controller. The friction sensor probes of this invention are particularly effective for sensing and controlling changes in the lubricating boundary layer and resulting changes in friction therefrom. The control subsystems can readily help to make in situ process changes to improve finishing and reduce manufacturing costs.

Applying an operative finishing motion in the operative finishing interface forming an organic lubricating layer such that a tangential friction force is created in the operative finishing interface which is dependent on lubricant properties other than lubricant viscosity is preferred. Applying an operative finishing motion in the operative finishing interface forming an organic lubricating layer such that a tangential friction force is created in the operative finishing interface which depends on lubricant properties other than lubricant viscosity is preferred. Applying an operative finishing motion in the operative finishing interface forming a differential organic lubricating layer such that a plurality of different tangential friction forces are created in different regions of the operative finishing interface and wherein the plurality of the different tangential friction forces are dependent on lubricant properties other than lubricant viscosity is more preferred. Applying the greater tangential friction force in the unwanted raised region of the semiconductor wafer surface being finished and also applying the lower tangential friction force to a region below and proximate to the unwanted raised region of the semiconductor wafer surface being finished is also more preferred. By creating this type of lubricating layer, finishing of the semiconductor wafer can be accomplished with good finishing rates and reduced unwanted surface defects. Planarization can be improved. Within die nonuniformity can be improved.

Given the guidance and disclosure herein, one skilled in the art can easily see that the friction sensor subsystems and finishing sensor subsystems can easily be used to detect changes to the finishing element finishing surface by monitoring real time changes in friction whether or not changes in lubrication are made and this information can be used by the subsystem to determine advantageous timing for finishing element finishing conditioning and thus improve finishing to a workpiece surface. Given the guidance and disclosure herein, one skilled in the art can easily see that the friction sensor subsystems and finishing sensor subsystems can easily be used to detect changes in friction to the finishing element finishing surface by monitoring real time changes in friction, whether or not changes in lubrication are made. Friction sensor surface can be surfaces similar to the workpiece, surfaces essentially identical to those contained in the workpiece, a standard surface to compare surface friction against, or even an identical finishing element finishing surface. By measuring the change in friction with time or number of wafers processed, improved and cost effective finishing element conditioning can be accomplished. At least two friction sensor probes are preferred when lubricants are used to help different changes in friction due to finishing element finishing surface wear and changes due to lubricant additions and/or changes. The friction sensor probes can be used for finishing element finishing surfaces having a fixed abrasive. The friction sensor probes can give a real time read-out on changes to the "cut-ability" of the fixed abrasive finishing element finishing surfaces and they can also be used to adjust finishing control parameters appropriately to these changes to effect improved finishing of the workpiece surface.

Common semiconductor wafer finishing involves the removal of one layer comprised predominantly of a conductive material such as copper during finishing in order to change to a predominantly non-conductive material. Changes in friction measured by the friction sensor probes, with or without the addition of lubricant, along with knowledge of finishing performance as a function of this measure of friction, and particularly when integrated with a workpiece sensor, can deliver good finishing control and ability to stop finishing when desired. End points can be detected by detecting a changed level of friction at the operative finishing interface by using the friction sensor probes to detect and develop information to correct in real time to changing finishing control parameters including, but not limited to, changes in lubrication and changes in finishing element finishing surface changes with time.

Supplying an organic lubricant for a portion of finishing cycle time is preferred. Supplying an organic lubricant for a secondary finishing step after a first finishing step free of lubricant, can be preferred. Using two finishing steps, one with lubricant and one free of lubricant can reduce unwanted surface damage when finishing a semiconductor wafer. Using two finishing steps can also increase the finishing rate.

Using at least one cost of manufacture parameter to determine improved process control parameter(s) is preferred and using at least two cost of manufacture parameters to determine improved process control parameter(s) is more preferred and using at least five cost of manufacture parameters to determine improved process control parameter(s) is even more preferred and using at least ten cost of manufacture parameters to determine improved process control parameter(s) is even more particularly preferred. Cost of manufacture parameters which are related to the current planarizing step are preferred and cost of manufacture parameters which are derived from the current planarizing step are more preferred. Cost of manufacture parameters which are related to the current planarizing apparatus are preferred and cost of manufacture parameters which are derived from the current planarizing apparatus are even more preferred. Cost of manufacture parameters which are related to the in-use planarizing step are preferred and cost of manufacture parameters which are derived from the in-use planarizing step are more preferred. Cost of manufacture parameters which are related to the in-use planarizing apparatus are preferred and cost of manufacture parameters which are derived from the in-use planarizing apparatus are even more preferred. Cost of manufacture parameters which are current are preferred and cost of manufacture parameters which have been updated for the current manufacture step are more preferred. Cost of manufacture parameters updated to the current manufacturing step with activity based accounting is preferred Use cost of manufacture information in a common economic value during evaluation and/or determinations is preferred. Use cost of manufacture parameters of a common economic value during evaluation and/or determinations is preferred. By using actual cost of manufacture parameters for optimizing process control with planarizing progress information from operative process sensors in the multi-step semiconductor wafer, the potential to improve one quality control parameter in real time to the detriment of the total cost of manufacture is reduced. Cost of manufacture can generally be optimized more efficiently and effectively for in situ control having access to multiple real time cost of manufacture parameters. Cost of manufacture information derived from the in-use planarizing method and equipment is generally more helpful for real time control. Cost of manufacture information derived from other planarizing methods and apparatus can be used but with generally more effort and increased determination and/evaluation effort such as modeling, fuzzy logic, extrapolation, interpolations, and the like.

Providing a separate aqueous lubricating composition and a separate alternate finishing composition proximate to the workpiece heterogeneous workpiece surface being finished for use between the finishing element surface and the workpiece being finished is a preferred step in the method. Providing an effective amount of an aqueous lubricating composition between the finishing element surface and the workpiece being finished for at least a portion of the finishing time in order to reduce the effective coefficient of friction between the finishing element surface and the workpiece being finished and providing a separate alternate finishing composition between the finishing element finishing surface and the workpiece being finished for at least a portion of the finishing time is also preferred. Separate and distinct feed lines and reservoirs for the aqueous lubricating composition and the alternate finishing composition and delivery of their product by each separate system near or proximate to the point of use are preferred.

A method of finishing wherein evaluating a semiconductor wafer(s) historical performance from ramp-up manufacture and using this historical performance to change the control parameters (or evaluate the cost of manufacture) of a third semiconductor wafer post ramp-up manufacture is preferred A method of finishing wherein evaluating a semiconductor wafer(s) historical performance from pre-ramp-up manufacture and using this historical performance to change the control parameters (or evaluate the cost of manufacture) of a third semiconductor wafer ramp-up manufacture is preferred. A method of finishing wherein evaluating a semiconductor wafer(s) historical performance from ramp-up manufacture and using this historical performance to change the control parameters (or evaluate the cost of manufacture) of yet another semiconductor wafer in ramp-up manufacture is preferred. A method of finishing wherein evaluating a semiconductor wafer(s) historical performance from ramp-up manufacture and using this historical performance to change the control parameters (or evaluate the cost of manufacture) of yet another semiconductor wafer in ramp-up manufacture is preferred. A method of finishing wherein evaluating a semiconductor wafer(s) historical performance from commercial manufacture and using this historical performance to change the control parameters (or evaluate the cost of manufacture) of yet another semiconductor wafer in commercial manufacture is preferred. Those skilled in the semiconductor wafer commercial arts are generally knowledgeable about pre-ram-up, ramp-up, and commercial manufacturing stages. By using the teachings and guidance contained herein, it is believed that costs can be reduced for pre-ramp-up, ramp-up, and commercial manufacture by more quickly identifying areas of process control improvement. Further, this method is preferably free of repeatedly adding process information by humans, uses the information for near term process control, next stage process control, and data mining for long term process control improvements. For this reason, it is believed that the method has new and different steps, performs them in a new and different way to get a new and useful result. Further non-limiting preferred examples are shown herein.

A preferred embodiment of this invention is directed to a method of finishing a semiconductor wafer during a finishing cycle time comprising a step of providing a finishing element finishing surface; a step of positioning the semiconductor wafer proximate to the finishing surface and wherein the semiconductor wafer has a tracking code; a step of providing at least one finishing sensor capable of monitoring the finishing of semiconductor wafer surface being finished; a step of applying an operative finishing motion between the semiconductor wafer and the finishing surface; a step of sensing the progress of the finishing of the semiconductor wafers surface with the finishing sensor and sending the progress of the finishing to a processor having access to current cost of manufacture parameters; a step of evaluating finishing control parameters for improved adjustment using the tracking code, the current cost of manufacture parameters, and finishing control parameters to improve cost of manufacture; and a step of controlling in situ by adjusting at least 4 times during the finishing cycle time a finishing control parameter to improve the cost of manufacture of the semiconductor wafer.

A preferred embodiment of this invention is directed to a method of finishing a semiconductor wafer during a finishing cycle time comprising a step of providing a finishing element finishing surface; a step of positioning the semiconductor wafer proximate to the finishing surface and wherein the semiconductor wafer has a tracking code; a step of providing at least one finishing sensor capable of monitoring the finishing of semiconductor wafer surface being finished; a step of applying an operative finishing motion between the semiconductor wafer and the finishing surface;

a step of sensing the progress of the finishing of the semiconductor wafers surface with the finishing sensor and sending the progress of the finishing to a processor having access to current cost of manufacture parameters; a step of evaluating finishing control parameters for improved adjustment using the tracking code, the current cost of manufacture parameters, and finishing control parameters to improve cost of manufacture; a cost of manufacture model, and a step of controlling in situ by adjusting at least 4 times during the finishing cycle time a finishing control parameter to improve the cost of manufacture of the semiconductor wafer surface being finished.

A preferred embodiment of this invention is directed to a method of finishing a semiconductor wafer during a finishing cycle time comprising a step of providing a finishing element finishing surface; a step of positioning the semiconductor wafer proximate to the finishing surface and wherein the semiconductor wafer has a tracking code; a step of providing at least one finishing sensor capable of monitoring the finishing of semiconductor wafer surface being finished; a step of applying an operative finishing motion between the semiconductor wafer and the finishing surface; a step of sensing the progress of the finishing of the semiconductor wafers surface with the finishing sensor and sending the progress of the finishing to a processor having access to current cost of manufacture parameters and historical performance; a step of evaluating finishing control parameters for improved adjustment using the tracking code, the historical performance, the current cost of manufacture parameters, and finishing control parameters to improve cost of manufacture; and a step of controlling in situ by adjusting during the finishing cycle time a finishing control parameter to improve the cost of manufacture of the semiconductor wafer surface being finished.

A preferred embodiment of this invention is directed to a method of finishing a semiconductor wafer during a finishing cycle time comprising a step of providing a finishing element finishing surface; a step of positioning the semiconductor wafer proximate to the finishing surface and wherein the semiconductor wafer has a tracking code; a step of providing at least one finishing sensor probe capable of monitoring the finishing of the semiconductor wafer; a step of applying an operative finishing motion between the semiconductor wafer and the finishing surface; a step of sensing the progress of the finishing of the semiconductor wafer with the finishing sensor and sending the progress of the finishing to a processor having access to current cost of manufacture parameters and historical performance; a step of evaluating finishing control parameters for improved adjustment using a tracking code, historical performance, updated the current cost of manufacture parameters consistent with the current manufacturing step, and finishing control parameters to improve cost of manufacture; and a step of controlling in situ by adjusting during the finishing cycle time a finishing control parameter to improve the cost of manufacture of the semiconductor wafer.

A preferred embodiment of this invention is directed to a method of finishing a semiconductor wafer during a finishing cycle time comprising a step of providing a finishing element finishing surface; a step of positioning the semiconductor wafer proximate to the finishing surface and wherein the semiconductor wafer has a tracking code; a step of providing at least one finishing sensor capable of monitoring the finishing of semiconductor wafer surface being finished; a step of applying an operative finishing motion between the semiconductor wafer and the finishing surface; a step of sensing the progress of the finishing of the semiconductor wafers surface with the finishing sensor and sending the progress of the finishing to a processor having access to current cost of manufacture parameters; a step of evaluating finishing control parameters for improved adjustment using the tracking code, the current cost of manufacture parameters, and finishing control parameters to improve cost of manufacture; a cost of manufacture model, and a step of controlling in situ by adjusting during the finishing cycle time a finishing control parameter to improve the cost of manufacture of the semiconductor wafer surface being finished.

A preferred embodiment of this invention is directed to a method of finishing a semiconductor wafer during a finishing cycle time comprising a step of providing a finishing element finishing surface; a step of positioning the semiconductor wafer proximate to the finishing surface and wherein the semiconductor wafer has a tracking code; a step of providing at least one finishing sensor probe capable of monitoring the finishing of the semiconductor wafer; a step of applying an operative finishing motion between the semiconductor wafer and the finishing surface; a step of sensing the progress of the finishing of the semiconductor wafer with the finishing sensor and sending the progress of the finishing to a processor having access to current cost of manufacture parameters; a step of evaluating finishing control parameters for improved adjustment using a tracking code, updated the current cost of manufacture parameters consistent with the current manufacturing step, a cost of manufacture model, and finishing control parameters to improve cost of manufacture; and a step of controlling in situ by adjusting during the finishing cycle time a finishing control parameter to improve the cost of manufacture of the semiconductor wafer.

A preferred embodiment of this invention is directed to a method of finishing a semiconductor wafer during a finishing cycle time comprising a step of providing a finishing element finishing surface; a step of positioning the semiconductor wafer proximate to the finishing surface and wherein the semiconductor wafer has a tracking code; a step of providing at least one finishing sensor probe capable of monitoring the finishing of semiconductor wafer surface being finished; a step of applying an operative finishing motion between the semiconductor wafer and the finishing surface; a step of sensing the progress of the finishing of the semiconductor wafers surface with the finishing sensor and sending the progress of the finishing to a processor having access to current cost of manufacture parameters and historical performance; a step of evaluating finishing control parameters for improved adjustment using the tracking code, the historical performance, the current cost of manufacture parameters, a cost of manufacture model, and finishing control parameters to change the cost of manufacture; and a step of controlling in situ by adjusting during the finishing cycle time a finishing control parameter to change the cost of manufacture of the semiconductor wafer.

A preferred embodiment of this invention is directed to a method of finishing a semiconductor wafer during a finishing cycle time comprising a step of providing a finishing element finishing surface; a step of positioning the semiconductor wafer proximate to the finishing surface and wherein the semiconductor wafer has a tracking code; a step of providing at least one finishing sensor probe capable of monitoring the finishing of the semiconductor wafer; a step of applying an operative finishing motion between the semiconductor wafer and the finishing surface; a step of sensing the progress of the finishing of the semiconductor wafer with the finishing sensor and sending the progress of the finishing to a processor having access to current cost of manufacture parameters and historical performance; a step of evaluating finishing control parameters for improved adjustment using a tracking code, historical performance, updated the current cost of manufacture parameters consistent with the current manufacturing step, a cost of manufacture model, and finishing control parameters to change the cost of manufacture; and a step of controlling in situ by adjusting during the finishing cycle time a finishing control parameter to change the cost of manufacture of the semiconductor wafer.

A preferred embodiment of this invention is directed to a method of finishing a semiconductor wafer having a tracking code comprising a step of providing a finishing surface; a step of positioning semiconductor wafer proximate to the finishing surface; a step of providing at least one finishing sensor probe capable of monitoring the finishing of the semiconductor wafer in real time; a step of applying an operative finishing motion between the semiconductor wafer and the finishing surface; a step of sensing the progress of the finishing of the semiconductor wafer surface with the finishing sensor probe and sending the progress of the finishing to a processor having access to current cost of manufacture parameters and the tracking code; a step of evaluating finishing control parameters for improved adjustment using the current cost of manufacture parameters, the tracking code, and finishing control parameters to improve the cost of manufacture; and a step of controlling in situ a finishing control parameter to change the cost of manufacture of the semiconductor wafer.

A preferred embodiment of this invention is directed to a method of finishing of a semiconductor wafer having a tracking code comprising a step of providing a finishing element finishing surface; a step of positioning the semiconductor wafer proximate to the finishing surface; a step of providing at least one operative friction sensor capable of measuring at least one parameter related to friction during finishing of semiconductor wafer surface being finished; a step of providing at least one cost of manufacture parameter; a step of applying an operative finishing motion between the semiconductor wafer surface being finished and the finishing surface; a step of sensing at least one parameter related to friction during the finishing of the semiconductor wafers surface with the friction sensor probe and sending at least one parameter related to friction to a processor having access to at least one cost of manufacture parameter and the tracking code; a step of evaluating the finishing process parameters for improved adjustment using the current cost of manufacture parameters, the tracking code, and finishing control parameters for improving cost of manufacture; and a step of controlling in situ a finishing control parameter to change the cost of manufacture of the semiconductor wafer surface.

A preferred embodiment of this invention is directed to a method of finishing of a semiconductor wafer having a tracking code comprising a step of providing a finishing element finishing surface; a step of positioning the semiconductor wafer surface being finished proximate to the finishing element finishing surface; a step of providing at least one operative sensor capable of gaining information about the finishing; a step of applying an operative finishing motion between the semiconductor wafer surface being finished and the finishing element finishing surface forming an operative finishing interface; a step of sensing the progress of the finishing of the semiconductor wafer surface with the operative sensor and sending the information about the finishing to a processor having access to current cost of manufacture parameters and the tracking code; a step of evaluating finishing control parameters for improved adjustment using at least in part at least three cost of manufacture parameters and the tracking code; and a step of controlling at least two process control parameters to improve the cost of manufacture of the semiconductor wafer.

A preferred embodiment of this invention is directed to a method of refining a semiconductor wafer surface comprising a step of applying a finishing energy to the surface of the semiconductor; a step of sensing progress information of the finishing of the semiconductor wafer surface with an operative control subsystem having access to a cost of manufacture model; a step of determining at least one improved control parameter using at least in part at least three cost of manufacture parameters and progress information with the operative control subsystem; and a step of controlling in real time the at least one process control parameter to improve the cost of manufacture of the semiconductor wafer.

A preferred embodiment of this invention is directed to a method of finishing a semiconductor wafer surface comprising a step of applying a finishing energy to the surface of the semiconductor wafer; a step of sensing in real time progress information of the finishing of the semiconductor wafer surface with an operative control subsystem having access to a cost of manufacture model; a step of determining at least one improved control parameter using at least in part at least three cost of manufacture parameters and progress information with the operative control subsystem; and a step of controlling in real time the at least one process control parameter to improve the cost of manufacture of the semiconductor wafer.

A preferred embodiment of this invention is directed to a method of finishing a semiconductor wafer surface having a cost of manufacture comprising the a step of applying a finishing energy having at least one control parameter to the surface of a semiconductor wafer; a step of determining at least one improved control parameter using at least in part at least three cost of manufacture parameters and in situ progress information with an operative control subsystem having access to a cost of manufacture model; and a step of controlling the at least one process control parameter to change the cost of manufacture of the semiconductor wafer.

A preferred embodiment of this invention is directed to a method of finishing a semiconductor wafer surface having a cost of manufacture comprising a step of applying a finishing energy having at least one control parameter to the surface of a semiconductor wafer; a step of determining at least one improved control parameter using at least in part at least three cost of manufacture parameters and in situ progress information with an operative control subsystem having access to a cost of manufacture model; a step of controlling the at least one process control parameter to change the cost of manufacture of the semiconductor wafer; and a step of storing for future availability information from the at least one control parameter, the at least in three cost of manufacture parameters, and the change of the cost of manufacture of the semiconductor wafer.

A preferred embodiment of this invention is directed to a method of finishing a semiconductor wafer surface having a cost of manufacture comprising a step of applying a finishing energy having at least one control parameter to the surface of a semiconductor wafer; a step of determining at least one improved control parameter using at least in part at least three cost of manufacture parameters and in situ progress information with an operative control subsystem having access to a cost of manufacture model and a process model; a step of controlling the at least one process control parameter to change the cost of manufacture of the semiconductor wafer; and a step of storing for future availability stored information related to the at least one control parameter, the at least in three cost of manufacture parameters, and the change of the cost of manufacture of the semiconductor wafer.

A preferred embodiment of this invention is directed to a method of finishing of a first and a second semiconductor wafer surface having a first and a second cost of manufacture comprising a step of applying a finishing energy having at least one control parameter to the surface of a first semiconductor wafer; a step of determining at least one improved control parameter using at least in part at least one cost of manufacture parameter and in situ progress information for the first semiconductor wafer with an operative control subsystem; a step of controlling the at least one process control parameter to change the cost of manufacture of the semiconductor wafer; a step of storing for future availability stored information related to the at least one control parameter, the at least in one cost of manufacture parameter, and the change of the cost of manufacture of the semiconductor wafer; a step of applying a finishing energy having at least one control parameter to the surface of a second semiconductor wafer; a step of determining at least one improved control parameter using at least a portion of the stored information related to the one cost of manufacture parameter and the progress information for the second semiconductor wafer with the operative control subsystem; and a step of controlling the at least one process control parameter to change the cost of manufacture of the second semiconductor wafer.

A preferred embodiment of this invention is directed to a method of finishing of a first and a second semiconductor wafer surfaces having a first and a second cost of manufacture comprising a step of applying a finishing energy having at least one control parameter to the surface of a first semiconductor wafer; a step of determining at least one improved control parameter using at least in part at least three cost of manufacture parameters and in situ progress information for the first semiconductor wafer with an operative control subsystem; a step of controlling in situ the at least one process control parameter to change the cost of manufacture of the semiconductor wafer; a step of storing for future availability stored information related to the at least one control parameter, the at least in three cost of manufacture parameters, and the change of the cost of manufacture of the semiconductor wafer; a step of applying a finishing energy having at least one control parameter to the surface of a second semiconductor wafer; a step of determining at least one improved control parameter using at least a portion of the stored information related to the three cost of manufacture parameters and the progress information for the second semiconductor wafer with the operative control subsystem; and a step of controlling in situ the at least one process control parameter to change the cost of manufacture of the second semiconductor wafer.

A preferred embodiment of this invention is directed to a method of finishing a semiconductor wafer surface having a cost of manufacture comprising a step of applying a finishing energy having at least one control parameter to the surface of a semiconductor wafer having a tracking code; a step of determining at least one improved control parameter using at least in part at least three cost of manufacture parameters, the tracking code, and in situ progress information with an operative control subsystem having access to a cost of manufacture model; a step of controlling the at least one process control parameter to change the cost of manufacture of the semiconductor wafer; and a step of storing for future availability information from the at least one control parameter, the at least in three cost of manufacture parameters, and the change of the cost of manufacture of the semiconductor wafer.

A preferred embodiment of this invention is directed to a method of finishing a semiconductor wafer surface having a cost of manufacture comprising a step of applying a finishing energy having at least one control parameter to the surface of a semiconductor wafer having a tracking code; a step of determining at least one improved control parameter using at least in part at least three cost of manufacture parameters, the tracking code, and in situ progress information with an operative control subsystem having access to a cost of manufacture model; a step of controlling the at least one process control parameter to change the cost of manufacture of the semiconductor wafer; and a step of storing for future availability stored information related to the at least one control parameter, the at least in three cost of manufacture parameters, and the change of the cost of manufacture of the semiconductor wafer.

A preferred embodiment of this invention is directed to a method of finishing a semiconductor wafer surface having a cost of manufacture comprising a step of applying a finishing energy having at least two control parameters to the surface of a semiconductor wafer; a step of determining at least one improved control parameter using at least in part at least ten cost of manufacture parameters, and in situ progress information with an operative control subsystem having access to a cost of manufacture model, historical performance of the semiconductor wafer, and a process model; and a step of controlling in situ the at least the two process control parameters to change the cost of manufacture of the semiconductor wafer.

A preferred embodiment of this invention is directed to a method of finishing of a first and a second semiconductor wafer surfaces having a first and a second cost of manufacture comprising a step of applying a finishing energy having at least one control parameter to the surface of a first semiconductor wafer; a step of determining in real time at least one improved control parameter using at least in part at least ten cost of manufacture parameters, a first tracking code, and real time progress information for the first semiconductor wafer with an operative control subsystem; a step of controlling in real time the at least one process control parameter to change the cost of manufacture of the semiconductor wafer; a step of storing for future availability stored information related to the at least one control parameter, the first tracking code, and the at least in ten cost of manufacture parameters; a step of applying a finishing energy having at least one control parameter to the surface of a second semiconductor wafer having a second tracking code; a step of determining in real time at least one improved control parameter using at least a portion of the stored information related to at least three of the ten cost of manufacture parameters, the second tracking code, and the progress information for the second semiconductor wafer with the operative control subsystem; and a step of controlling in real time the at least one process control parameter to change the cost of manufacture of the second semiconductor wafer.

A preferred embodiment of this invention is directed to a method of finishing a first and a second semiconductor wafers having a first and a second cost of manufacture comprising a step of applying a finishing energy having at least one control parameter to the surface of a first semiconductor wafer; a step of determining at least one improved control parameter using at least in part at least one cost of manufacture parameter, a first tracking code, and in situ progress information for the first semiconductor wafer with an operative control subsystem; a step of controlling the at least one process control parameter to change the cost of manufacture of the semiconductor wafer; a step of storing for future availability stored information related to the at least one control parameter, the at least in one cost of manufacture parameter, the first tracking code, and the change of the cost of manufacture of the semiconductor wafer; a step of applying a finishing energy having at least one control parameter to the surface of a second semiconductor wafer having a second tracking code; a step of determining at least one improved control parameter using at least a portion of the stored information related to the one cost of manufacture parameter, the second tracking code, and the progress information for the second semiconductor wafer with the operative control subsystem; a step of controlling the at least one process control parameter to change the cost of manufacture of the second semiconductor wafer; and a step of evaluating the stored information related to at least one cost of manufacture parameter for the first and second semiconductor wafers to forecast a cost of manufacture for a third semiconductor wafer.

A preferred embodiment of this invention is directed to an apparatus for finishing a workpiece having a tracking code during a time period of non-steady state finishing, the apparatus comprising a workpiece holder; an operative control subsystem having an operative sensor, a controller, and a processor and wherein the processor has access to at least one cost of manufacture parameter, and the tracking code for the workpiece; and a finishing surface for applying a finishing energy to the workpiece held by the workpiece holder; and wherein the operative sensor is for sensing a progress of finishing information during the time period of non-steady state finishing, the processor is for determining a change for at least one improved process control parameter using the at least one cost of manufacture parameter, the tracking code, and the progress of finishing information with the operative control subsystem during the time period of non-steady state finishing, and the controller is for changing the at least one process control parameter in real time which changes the finishing during the time period of non-steady state finishing. A preferred embodiment of this invention is directed to an apparatus for finishing a workpiece having a tracking code during a time period of non-steady state finishing, the apparatus comprising a workpiece holder; an operative control subsystem having at least three operative sensors, a controller, and a processor and wherein the processor has access to at least one cost of manufacture parameter, a cost of manufacture model, a process model, and the tracking code for the workpiece; and an operative finishing surface for applying a finishing energy to the workpiece held by the workpiece holder; and wherein the at least three operative sensors are for sensing progress of finishing information during the time period of non-steady state finishing, the processor is for determining a change for at least one improved process control parameter using the at least one cost of manufacture parameter, a cost of manufacture model, a process model, and the tracking code for the workpiece, and the progress of finishing information with the operative control subsystem during the time period of non-steady state finishing, and the controller is for changing the at least one process control parameter in real time which changes the finishing during the time period of non-steady state finishing.

An activity based cost of manufacture model comprises a preferred cost of manufacture model. An activity based cost of manufacture model having a multiple of different levels of activity costs and a multiple of different cost drivers in each of the multiple of different levels of activity costs comprises a preferred cost of manufacture model. A computer-readable, program storage device encoded with instructions that, when executed by a processor, performs preferred embodiment of methods of refining and/or finishing disclosed herein is preferred. A computer-readable, program storage device encoded with instructions that, when executed by a computer, when executed by a processor, performs preferred embodiment of methods of refining and/or finishing disclosed herein is more preferred. A computer programmed to perform the preferred methods of manufacturing disclosed herein is preferred. A method for real time process control by means of a process control computer connected to wafer fabrication machinery through a network for performing the method embodiments and wherein the wafer fabrication equipment comprises at least one piece of refining equipment in the network is also preferred. A semiconductor manufacturing line comprising sufficient equipment for finishing a semiconductor wafer according to embodiments disclosed herein is preferred. A method for finishing according to embodiments herein comprising the further steps of storing information related to at least one of the cost of manufacture parameter and to at least one process control parameter; evaluating the stored information including both the at least one cost of manufacture parameter and the at least one process control parameter using data mining algorithms to determine at least one changed process control parameter value; supplying a second semiconductor wafer for finishing; controlling finishing of the second semiconductor wafer finishing to the at least one changed process control parameter value; and storing information related to at least one of the cost of manufacture parameter and to at least one process control parameter for the second semiconductor wafer is also preferred.

A workpiece manufactured in steps which include a plurality of finishing steps comprising non-equilibrium process control is preferred. A workpiece manufactured in steps which include at least three of finishing steps comprising non-equilibrium process control is more preferred. A workpiece manufactured in steps which include a finishing step having a portion of the step in non-steady state is preferred. A workpiece manufactured in steps which include a plurality of finishing steps having a portion of the step in non-steady state is more preferred. A workpiece manufactured in steps which include at least three of finishing steps having a portion of the step in non-steady state is more preferred. Determining a change for a process control parameter with progress of finishing information and changing a process control parameter while a process is in a non-steady state is preferred for some process control operations. Determining a change for a process control parameter with progress of finishing information and changing a process control parameter while a process is in a non-equilibrium time period of change is preferred for some process control operations. An illustrative example of non-steady state processing time period is the partial clearing of a conductive layer from a nonconductive layer. During this period of clearing the surface composition (refining) of the workpiece generally has a surface composition changing during a non-steady time period. During this period of clearing the surface composition (refining) of the workpiece can have frictional and/or differential frictional changes during a non-steady time period.

Determining a change for a process control parameter at least 4 times during the non-steady state process time is preferred and at least 6 times during the non-steady state process time is more preferred and at least 10 times during the non-steady state process time is even more preferred and at least 20 times during the non-steady state process time is even more particularly preferred. Determining a change for a process control parameter in situ process information and the tracked information at least 4 times during the non-steady state process time is preferred and at least 6 times during the non-steady state process time is more preferred and at least 10 times during the non-steady state process time is even more preferred and at least 20 times during the non-steady state process time is even more particularly preferred. Changing process control parameter value at least 4 times during the non-steady state process time is preferred and at least 6 times during the non-steady state process time is more preferred and at least 10 times during the non-steady state process time is even more preferred and at least 20 times during the non-steady state process time is even more particularly preferred. Controlling the process control parameter value at least 4 times during the non-steady state process time is preferred and at least 6 times during the non-steady state process time is more preferred and at least 10 times during the non-steady state process time is even more preferred and at least 20 times during the non-steady state process time is even more particularly preferred. Currently, a non-steady state process time of at most 3 minutes is preferred and of at most 2 minutes is more preferred and of at most 1.5 minutes is even more preferred and of at most 1 minute is even more particularly preferred. By repeatedly determining, changing and controlling through adjusting the process control parameter(s) value(s), better process control and improved cost of manufacture can be effected. By repeatedly calculating and adjusting the process control parameter(s) value(s) using in situ process information and tracked information, better process control, improved refining, and improved cost of manufacture can generally be effected. Generally, a maximum of one hundred calculations and process control parameter adjustments during a non-steady state process time are preferred although more can be used for particularly critical semiconductor wafer refining (and as processor speeds and controllers improve). Repeating the sensing, determining, and changing steps above in this paragraph during a single period of non-steady state refining is preferred. Repeating the sensing, determining, and changing steps above in this paragraph at least 4 times is during a single period of non-steady state refining is more preferred. Repeating the sensing, determining, and changing steps above in this paragraph at least 10 times during a single period of non-steady state refining is more preferred in the above embodiments. Determining a change for a process control parameter using progress of refining information in real time and changing the process control parameter during the non-steady state time period can be more preferred for some applications. Determining a multiplicity of changes for a process control parameter using progress of refining information in real time and changing the process control parameter a multiplicity of times during the non-steady state time period can be more preferred for some applications. A process undergoing differential frictional changes during refining can be a preferred non-limiting example of a non-steady state change which can benefit from the non-steady state a process control methods herein.

Figure 16:
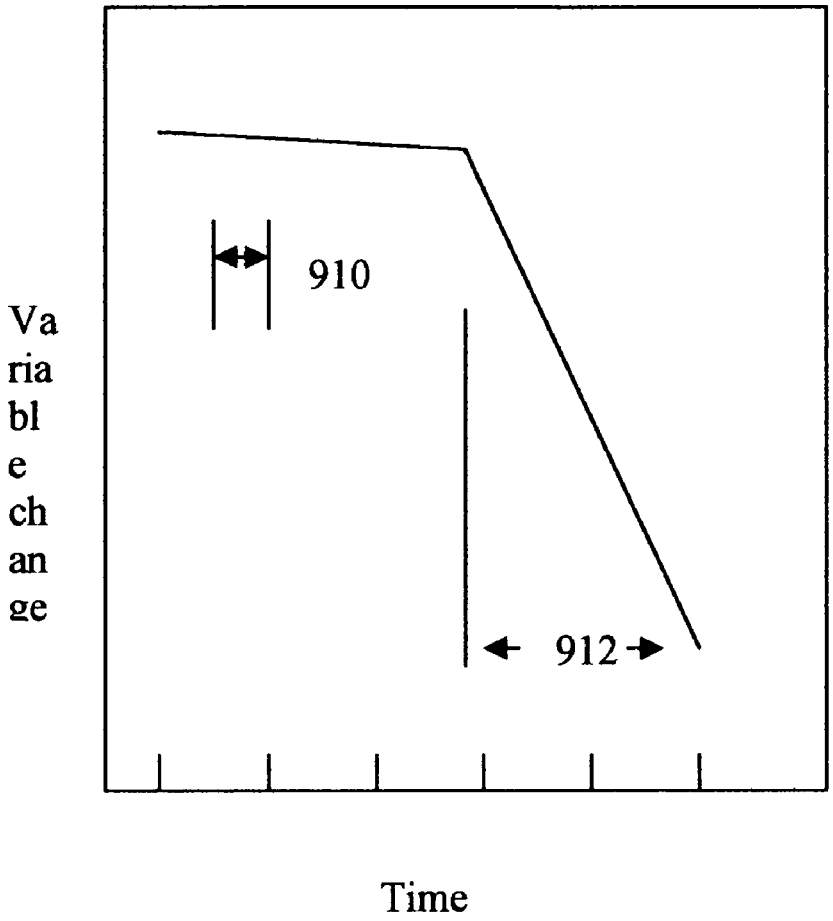
FIG. 16 is a preferred nonlimiting example of non-steady state refining

A non-steady state time period is generally understood by those skilled in the art. Certain types of non-steady state are preferred for control purposes in specific applications. A time period non-steady state finishing comprising a time period in which a process variable changes at least twice as fast as the process variable changes during a time period of most steady state planarizing, the time period of the most steady state finishing is defined as that time period equal to 10% of the entire finishing cycle time in minutes in which the smallest variation in the process variable occurs is preferred for preferred embodiments of process control. FIG. 16 illustrates a nonlimiting example of non-steady processing. Reference Numeral 910 illustrates a 10% of a finishing cycle time with the smallest variable change. Reference Numeral 912 illustrates a non-steady state time period having the same variable change at least twice as much as during the more stable period illustrated by Reference Numeral 910. A workpiece surface of having a uniform surface region and wherein the period of non-steady state finishing comprises a time period of finishing the uniform surface region wherein the cut rate of the first composition measured in angstroms per minute is changing an appreciable amount with time is also preferred for preferred embodiments of process control. A workpiece surface having a first chemical composition and a second chemical composition and wherein the period of non-steady state finishing comprises a time period of finishing the workpiece surface wherein the amount of material removed of the first chemical composition measured in micrograms per minute is changing an appreciable amount with time is also preferred for preferred embodiments of process control. A workpiece surface having a first region and a second region and wherein the period of non-steady state finishing comprises a time period of finishing the workpiece surface wherein the amount of material removed of the first region measured in micrograms per minute is changing an appreciable amount with time is also preferred for preferred embodiments of process control. A workpiece having a surface and the period of non-steady state finishing comprises a period in minutes of finishing the workpiece surface wherein the amount of material removed from a portion of the surface of the layer measured in micrograms per minute is changing an appreciable amount with time is also preferred in preferred embodiments. A finishing cycle time comprising a time in which the workpiece resides in a specific workpiece holder while applying a continuous finishing energy is a preferred finishing cycle time.

A workpiece holder holds the workpiece during finishing. A workpiece holder including a vacuum holding mechanism and/or system can be preferred. A workpiece holder including a mechanical holding mechanism and/or system can be preferred. A workpiece holder including a magnetic holding mechanism and/or system can be preferred. A workpiece holder using an adhesion mechanism and/or system can be preferred. Workpiece holders generally known in the industry can be effective.

Storing the information used for process control for future use is preferred. By storing information, preferably electronically, more preferably in look-up tables, the information can be looked-up and used without having to re-enter data with its associated costs and potential for error. Using the stored information to make a change, more preferably an appreciable change, to a process model having a plurality of organic lubricating control parameters is preferred. As an illustrative example, the stored information can be used to modify the Preston Equation in a process model for polishing which is generally known to those skilled in the semiconductor wafer polishing art. The stored information can be used for data mining. Data mining can be used to improve a process model, cost of manufacture, cost of manufacture model, and/or to identify preferred changes to control parameters for improved finishing. The stored information during ramp-up stage can used to improve a commercial stage process model and/or cost of manufacture model. By directly storing information for future use, a multiple valuable uses are made available at reduced cost and with reduced chance for error.

A workpiece having a tracking code including an associated amount of workpiece tracked information is preferred. A workpiece having a quantity of workpiece tracked information is preferred. A workpiece having an amount of workpiece tracked information is preferred. The tracked information can include prior process steps, metrology information, cost information (past, current, or expected future (for example, step costs)), customer information, customer order information, metrology information (past and/or current), prior (step) finishing recipes, future (step) planned finishing recipes, unique batch number, unique workpiece number, starting topology information, quality information, workpiece composition batch number, and other useful information. A tracking number unique to a singe workpiece is preferred. Tracking information can be stored in look-up tables. Tracking information can be stored in a database. Tracking information stored in a computer readable memory device is preferred.

Historical performance is generally preferred. Historical information is a preferred type of historical information. Historical information stored in a computer readable memory device is preferred. Historical information can grouped by individual workpiece, by batch, by tracking code, by workpiece characteristics such as gate length, by workpiece size, by workpiece number of layers, by workpiece feature sizes, by customers, by customer order, by time, by region, by cost, by profit, can all be useful and comprise illustrative preferences. Historical performance can be stored and then evaluated for changes such as new groupings, simplification, data compression, truncation, archiving, regroupings. Preferably the historical information is evaluated for change with an algorithm(s). A quantity of tracked information is preferred. An amount of tracked information is preferred. A quantity of historical performance including a quantity of historical tracked information is preferred. A quantity of historical performance including an amount of historical tracked information is preferred. A cost of manufacture parameter(s) using activity based accounting can be a preferred illustrative member of historical tracked information. Fuzzy logic, neural networks, mathematical formulas are some non-limiting preferred techniques.

A method wherein at least one member of the group consisting of storing information, evaluating the stored information, changing the at least one member of information, and using the at least one member of information is performed during at least a portion of time with a processor which the operative control subsystem is free of access to is preferred. A method wherein at least one member of the group consisting of storing information, evaluating the stored information, changing the at least one member of information, and using the at least one member of information is performed during at least a portion of time with a processor which the operative control subsystem is without access to is preferred. A method wherein at least one member of the group consisting of storing information, evaluating the stored information, changing the at least one member of information, and using the at least one member of information is performed during at least a portion of time with a processor which the operative control subsystem has access to is preferred. A method wherein at least one member of the group consisting of storing information, evaluating the stored information, changing the at least one member of information, and using the at least one member of information is performed during at least a portion of time during the finishing cycle time is preferred. A method wherein at least one member of the group consisting of storing information, evaluating the stored information, changing the at least one member of information, and using the at least one member of information is performed during at least a portion of time outside of the finishing cycle time is also preferred. A method wherein at least one member of the group consisting of storing information, evaluating the stored information, changing the at least one member of information, and using the at least one member of information is performed during at least a portion of time is different from the finishing cycle time is also preferred. Storing information, such as a preferred parameter or group of information or information set, can be preferred. Storing related information, such as a preferred parameter or group of information or information set, can be more preferred. A preferred form of related information is information related by a means of an algorithm. As a nonlimiting illustration, a first set of information can be operated on by a mathematical algorithm to give a new set of information related to the first set information through the mathematical algorithm. As a simple nonlimiting illustration, a first set of information can be simplified, compressed, and/or averaged to give a new set of information related to the first set information. As a nonlimiting illustration, a first set of information can be operated on by a computer algorithm to give a new set of information related to the first set information through the computer algorithm. By using process control information for multiple uses, the costs can generally be reduced and profitability of workpieces generally enhanced. For instance, on or offline, using the information stored, bottlenecks can be identified and more easily and cost effectively managed. Datamining can be enhanced by having a rich data file to extract and/or ascertain hidden trends in cost or process changes which will enhance profitability.

A method of evaluating of planarizing process information and progress of planarizing information in real time is preferred. A method of evaluating of planarizing process information and progress of planarizing information in situ is preferred. A method of controlling a control parameter in real time is preferred. A method of controlling a control parameter in situ is preferred. A method of adjusting a control parameter in real time is preferred. A method of adjusting a control parameter in situ is preferred. By using a method which functions in real time, faster adjustment to the process control parameter can effected and generally a lower cost of manufacture is thus available (rather than waiting for the next batch, run, or semiconductor wafer and any adverse costs thereby associated therewith for waiting). Adverse costs can include removing the semiconductor wafer for the process apparatus only to have to reload it later therefor incurring excess costs for labor costs, materials costs, and loss of apparatus utilization for the unloading and loading (and also any defects caused therebetween). Further with processors, multiple improved process control parameter(s) settings can be determined and then adjusted with the control subsystem using the preferred method.

Data mining can be accomplished on information used previously for process control. This reduces the cost of creating a new table or database for data mining. Further, the data mining results can be more readily applied to new, advanced process control algorithms. New process control algorithms can be developed by evaluating ramp-up historical information including process control parameters and then applying the new process control algorithm for commercial manufacture. New process control algorithms can be developed by evaluating ramp-up historical information including process control parameters and cost of manufacture parameters and then applying the new process control algorithm for commercial manufacture. New process control algorithms can be developed by evaluating previous historical information including process control parameters and then applying the new process control algorithm for future commercial manufacture. New process control algorithms can be developed by evaluating previous historical information including process control parameters and cost of manufacture parameters and then applying the new process control algorithm for future commercial manufacture. Thus the historical performance which is stored in a look-table is preferably used for a plurality of purposes to reduce the cost of manufacture and/or improved the enterprise profitability. By using the historical information used for initial process control multiple times cost of manufacture modeling, and process control algorithm improvement is accomplished in a new, more effective manner to give a new lower cost result because historical information does not have to be entered twice or more times for this analysis.

Storing information is preferred and then evaluating the stored information for change and changing the stored information is more preferred. Changing the stored information with an algorithm is a preferred method of changing the stored information. The stored information can be reduced in size using a computer algorithm. Simplifying stored information is a preferred method of changing stored information. Historical performance is a preferred type of stored information. Historical performance including tracked information is a preferred type of stored information. A tracking code and tracked information belonging to the tracking code is a preferred type of stored information. A process model having at least in part a portion of tracked information is a preferred type of stored information. A process model developed at least in part with tracked information is a preferred type of stored information. Determining a change using the stored information for a process model is a preferred use of the stored information. Changing a model to change process control optimization is a preferred method of changing the stored information. Determining a change using the stored information with operative control subsystem or accessible computer or processor is a preferred method of changing the stored information. Transferring the stored information to a different computer (or processor) and determining a change with the different computer using at least in part the transferred information can also be preferred. Determining a change using the stored information with operative control subsystem or accessible computer or processor is a preferred method of changing the stored information. Determining a change using the stored information while accessing computer or processor with operative control subsystem is a preferred method of changing the stored information. Stored information can be used to determine previously unknown or under appreciated process control parameter(s) using various computer algorithms. Stored information can be used to determine previously unknown or under appreciated process control parameter interactions using various computer algorithms. Stored information can be used to determine previously unknown or under appreciated workpiece design interactions (such as feature size or gate dimensions for integrated circuits) with predicted cost of manufacturing parameters using various computer algorithms. Stored information can be used to determine a change for workpiece design (such as a changed feature size or gate dimensions for integrated circuits) before manufacturing, thus improving manufacturability. Stored information can be used to determine a process model, a cost of manufacture model, and/or cost of manufacture parameters for a new workpiece to determine future manufacturability and/or cost therefore. Stored information can be used to determine apparatus or network of multiple apparatus for a new workpiece (such as changed feature size or gate dimensions for integrated circuits) to determine future manufacturability and/or cost therefore. Mathematical algorithms can be used for these determinations. Fuzzy logic can be used for these determinations. Neural networks can be used for these determinations. These new and useful results can improve time to market and reduce to costs to reach to the market.

A generally robust control subsystem for manufacturing a workpiece having multiple manufacturing steps having at least a non-steady time periods or portion of the finishing cycle time is preferred. A control system with a plurality of operative sensors, a plurality of processors, and at least one controller is a nonlimiting example of a preferred control subsystem for controlling during non-steady state time periods. A process model and/or a cost of manufacture model can be preferred. A workpiece having an identification code is preferred and a workpiece having a unique identification code is preferred. An identification code can further aid process control of a manufacturing process having multiple steps. A semiconductor wafer is a preferred example of a workpiece. A workpiece having a microelectronic component is another example.

Figure 17:
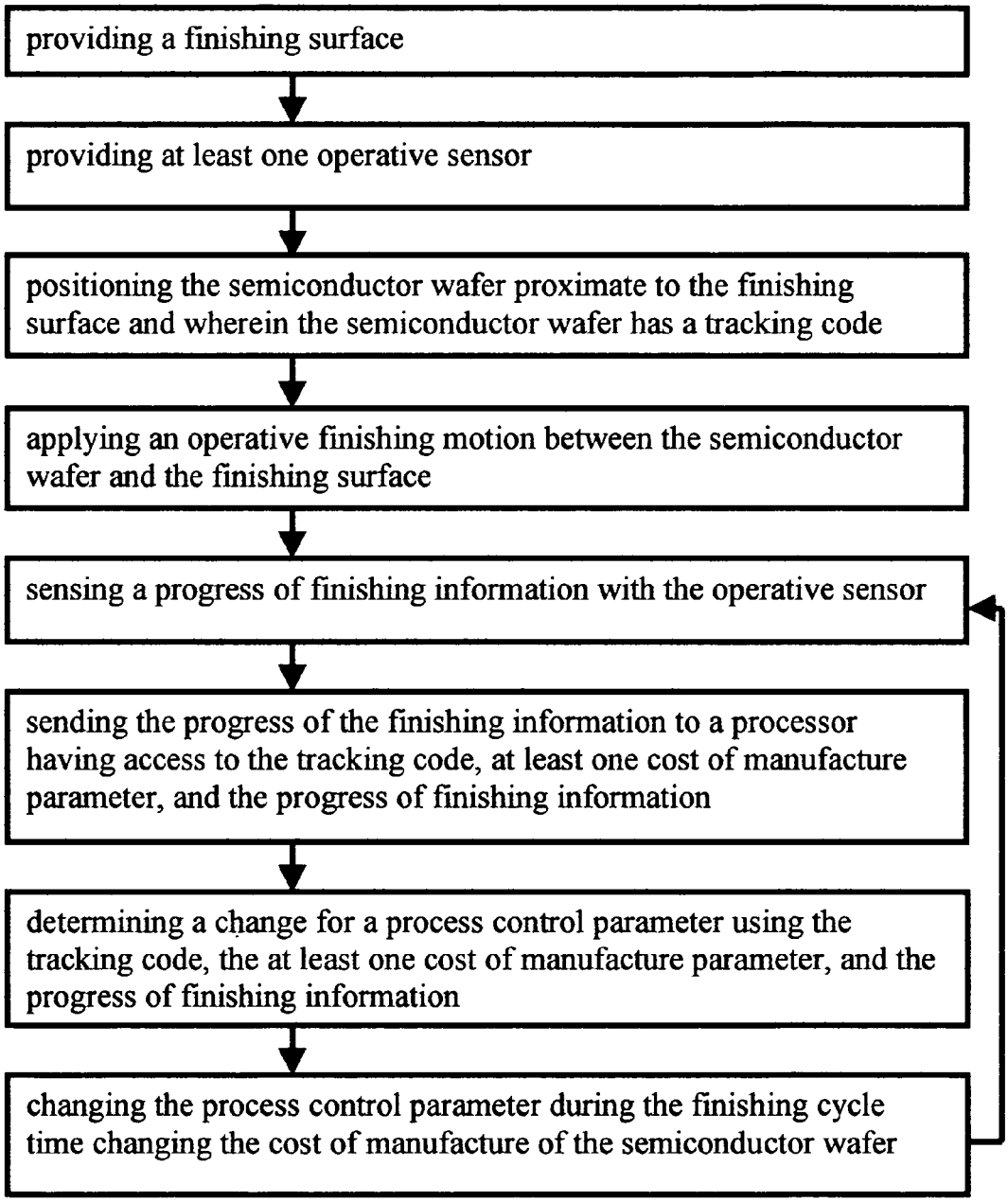
FIG. 17 shows preferred steps in one embodiment of the control semiconductor wafer finishing
Figure 18:
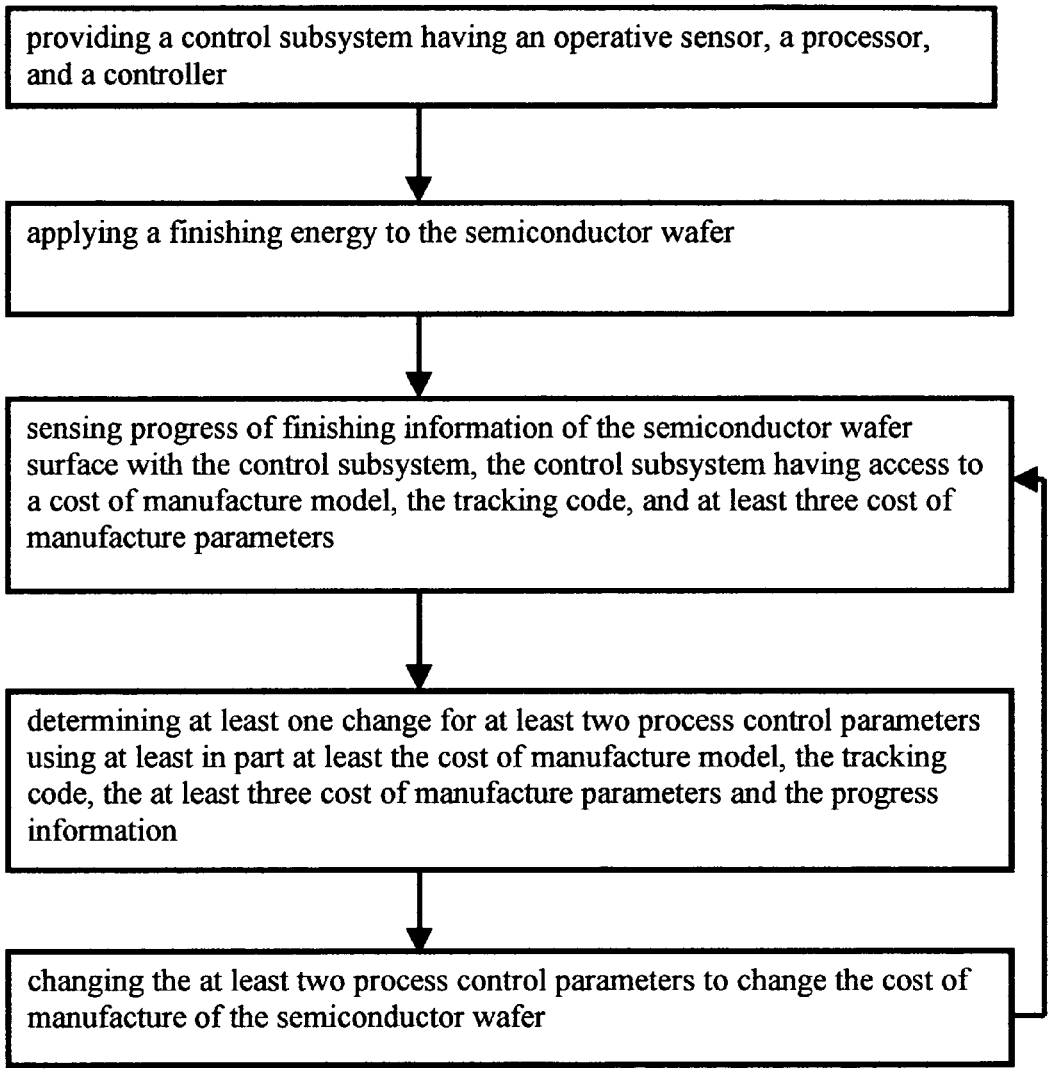
FIG. 18 shows preferred steps in one embodiment of the controlled semiconductor wafer finishing
Figure 19:
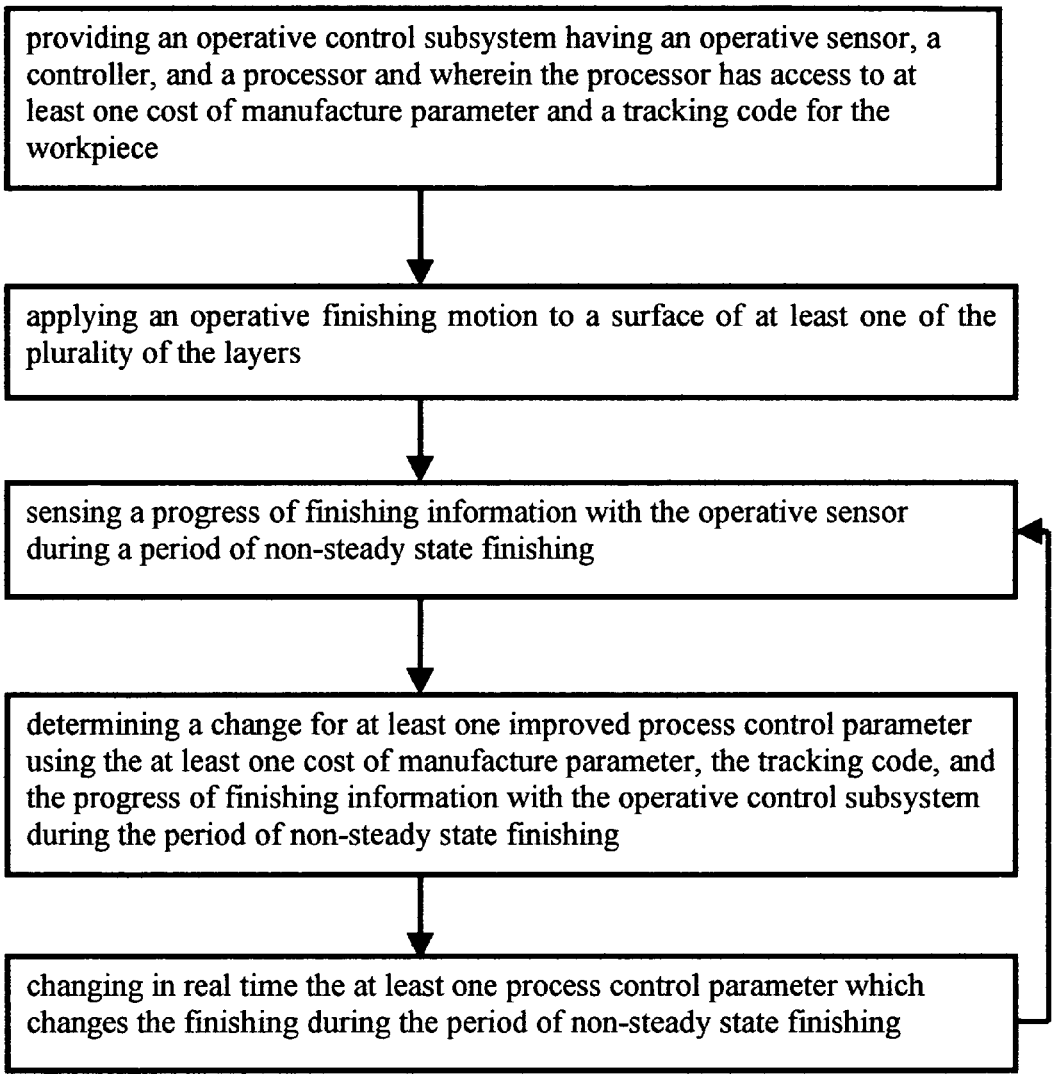
FIG. 19 shows preferred steps in one embodiment of the controlled semiconductor wafer finishing FIGS. 20*a, b* nonlimiting illustrative examples of a networked control subsystems

FIGS. 17–19 shows some preferred steps in some preferred control embodiments. Further, as discussed above sensing, determining, changing steps can be preferred for some non-steady state process control operations.

Figure 20A:
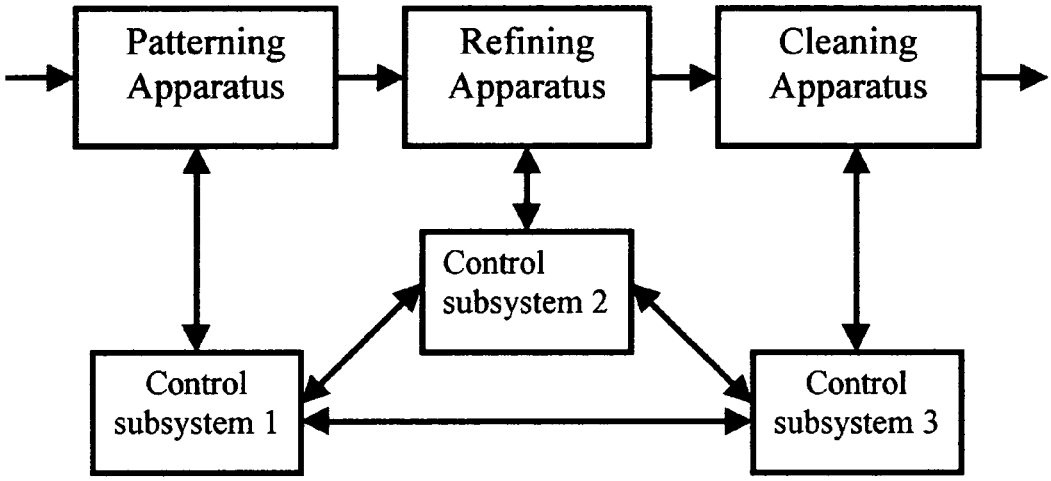
Figure 20B:
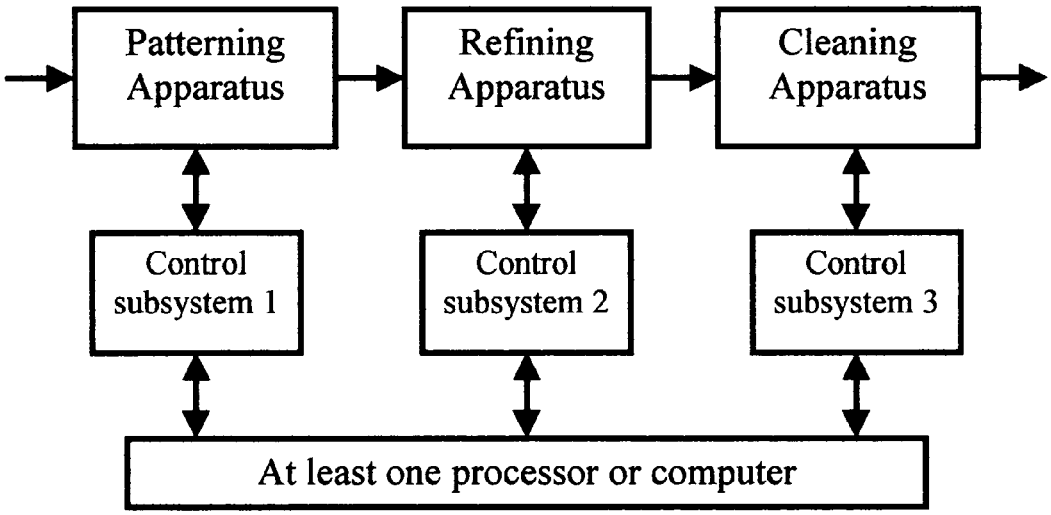

FIG. 20*a* is a nonlimiting illustrative of a control subsystem which is networked to each other and to their respective process equipment (patterning apparatus, planarizing apparatus, and cleaning apparatus). As indicated by the arrows other process steps and apparatus can proceed this equipment and other process steps and apparatus can be downfield of this equipment. Further the as is generally known in the semiconductor industry, some steps or groups of steps can be repeated during the manufacture of a semiconductor wafer. FIG. 20*b* is a nonlimiting illustrative of a control subsystem which is networked to each other through a more central computer unit and directly to their respective process equipment (patterning apparatus, planarizing apparatus, and cleaning apparatus). As indicated by the arrows other process steps and apparatus can proceed this equipment and other process steps and apparatus can be downfield of this equipment. Further the as is generally known in the semiconductor industry, some steps or groups of steps can be repeated during the manufacture of a semiconductor wafer. Still further, there are many generally known operative networking systems which are generally known in the computer art field and process control field which will be functional and useful. For instance, the control subsystems can be embedded or remote or some combination thereof. Networks and operative connections can be direct or indirect and/or some combination thereof. An operative network can aid in the process control using information selected from the group consisting of tracking codes, tracking information, cost of manufacture parameters, and models and combinations thereof. An operative network can aid process control by increasing the availability of information to use to evaluate and/or determine changes to improve finishing control. Having a network of information can also reduce the manual cost and the time lost of entering and reentering information for storage and evaluation of past workpiece costs, current workpiece costs, and future workpiece costs, optimization of process control parameters, determinations with cost of manufacture parameters, and models therefore. Having a network of information can aid in real time evaluation of variables to improve and optimize process control parameters using cost of manufacture parameters and models therefore.

SUMMARY

As is generally known in the semiconductor wafer art, development of actual preferred embodiments is generally accomplished in stages along with numerous process and design specific information. Given the teachings and guidance contained herein, preferred embodiments are generally implemented in stages while taking into account numerous business, process, and product specific information by those generally skilled in the semiconductor wafer arts. Although the implementation of a preferred embodiment may have generally numerous steps while taking into account the numerous business, process, and product specific information, implementation merely requires routine experimentation and effort given the teachings and guidance contained herein. Thus although the implementation may be somewhat time-consuming, it is nevertheless a generally routine undertaking for those of ordinary skill in the art having the benefit of the information and guidance contained herein. In some discussion herein, generally known information, processes, procedures, and apparatus have not been belabored so as not to obscure preferred embodiments of the present invention.

Applying an operative finishing motion with a finishing entity (entities) to form an organic lubricating boundary layer is preferred. A finishing element is a preferred finishing entity. Abrasive particles comprise preferred finishing entities. A finishing entity (entities) which rub against the semiconductor wafer surface being finished during finishing in the presence of an organic boundary lubricant forming an organic boundary lubricating layer is a preferred embodiment. Applying an operative finishing motion with a finishing entity (entities) to form an organic lubricating film is preferred. A finishing element is a preferred finishing entity. Abrasive particles comprise preferred finishing entities. A finishing entity (entities) which rub against the semiconductor wafer surface being finished during finishing in the presence of an organic lubricant forming an organic lubricating film is a preferred embodiment.

Preferred embodiments of this invention include the combination of in situ control using a processor having access to cost of manufacture parameters and using mathematical evaluations and/or mathematical formulas to change in real time process control parameters which change the effective coefficient of friction at the operative finishing interface. Preferred embodiments of this invention include the combination of in situ control using a processor having access to cost of manufacture parameters and using models such as process models and/or cost models to change in real time process control parameters which change the effective coefficient of friction at the operative finishing interface. Real time rapid control of such preferred process control parameter such as the finishing energy, as illustrated the by chemical and/or frictional energy, applied to the operative finishing interface to improve finishing is preferred. Real time rapid control of such preferred process control parameter as the relative velocity or pressure in the operative finishing interface to improve finishing is preferred. At least one process sensor is preferred and at least two process sensors are more preferred and at least three process sensors are even more preferred. A friction sensor probe remote from the workpiece being finished is preferred. Changing the Effective Coefficient of Friction in the operative finishing interface having an organic lubricating film with fast response process control variables is preferred. A change in pressure is a particularly preferred, fast response time process control parameter which can be varied over reversible ranges. Particularly preferred cost of manufacture parameters can be selected from the group consisting of parametric yield, equipment yield, defect density, and finishing rate. Other preferred cost of manufacture parameters include equipment utilization, raw materials cost such as slurry, chemicals, finishing element cost, cleaning chemicals and/or equipment. Thus another preferred set of cost of manufacture parameters can be selected from the group consisting of parametric yield, equipment yield, defect density, finishing rate, and consumable materials costs. Still other preferred cost of manufacture parameters include mean time to finishing element change and mean time to finishing element conditioning. Illustrative examples of consumable materials costs include slurry cost, other chemical costs, and cleaning chemical costs. The cost of manufacture effects on other steps of the manufacturing of the completed semiconductor wafer can also be considered such as lithography (and of other cost of individual processing steps). The cost of the semiconductor wafer is a preferred cost of manufacture parameter and the cost of the semiconductor wafer before finishing is a more preferred cost of manufacture parameter. The in process cost of the semiconductor wafer before the current finishing step is a preferred cost of manufacture parameter. Thus another preferred set of cost of manufacture parameters can be selected from the group consisting of parametric yield, equipment yield, defect density, finishing rate, and consumable materials costs. Thus another preferred set of cost of manufacture parameters can be selected from the group consisting of consumable materials costs and the inprocess cost of the semiconductor wafer. By tracking individual semiconductor wafer, the in process cost of manufacture of individual semiconductor wafer can be tracked and used for improving the finishing process. A processor is needed to perform the multiple calculations in the preferred real time rapid process control to improve finishing. Storing information is preferred and then evaluating the stored information for change and changing the stored information is more preferred. Changing the stored information with an algorithm is a preferred method of changing the stored information. The stored information can be reduced in size using a computer algorithm. Simplifying stored information is a preferred method of changing stored information. Changing a model to change process control optimization is a preferred method of changing the stored information. Compressing the stored information is a preferred method of changing the stored information. This can help reduce unwanted surface defects and also change and/or reduce the cost of manufacture for finishing (both current and future costs).

Illustrative nonlimiting examples of useful technology have been referenced by their patents numbers and all of these patents are included herein by reference in their entirety for further general guidance and modification by those skilled in the arts.

The scope of the invention should be determined by the appended claims and their legal equivalents, rather than by the preferred embodiments and details as discussed herein.

What is claimed is:

1. A method of finishing a semiconductor wafer during a finishing cycle time comprising the steps of:

providing a finishing surface;

providing at least one operative sensor;

applying an operative finishing motion between the semiconductor wafer and a finishing surface;

sensing a progress of finishing information with the operative sensor;

sending the progress of finishing information to a processor;

determining a change for a process control parameter using the processor, a tracking code, at least one cost of manufacture parameter, and the progress of finishing information; and changing the process control parameter during the finishing cycle time to change the cost of manufacture of the semiconductor wafer.

2. The method according to claim 1 wherein the method further comprises using an historical performance of the method.

3. The method according to claim 1 wherein the method further comprises using an historical performance of the method and a process model.

4. The method according to claim 1 wherein the method further comprises using an historical performance of the method, a process model, and a cost of manufacture model.

5. The method according to claim 1 wherein the method further comprises using an historical performance of the method, a process model, and an activity based cost of manufacture model.

6. The method according to claim 1 wherein the method further comprises using an historical performance of the method, a process model, and an activity based cost of manufacture model.

7. The method according to claim 6 comprising the further steps of:

storing information related to the process control parameter, the tracking code, the at least one cost of manufacture parameter, the historical performance of the method, the process model, the activity based cost of manufacture model, and the progress of finishing information;

evaluating the stored information using a computer algorithm to determine at least one change for one member selected from the group consisting of the process control parameter, the tracking code, the at least one cost of manufacture parameter, the historical performance of the method, the process model, and the activity based cost of manufacture model; and changing the stored information.

8. The method according to claim 1 comprising the further steps of:

storing information related to the at least one of the cost of manufacture parameter, the at least one process control parameter, and the progress of finishing information;

evaluating the stored information using a first computer algorithm to determine at least one change for one member selected from the group consisting of the tracking code, the at least one of the cost of manufacture parameter and the at least one process control parameter; and changing the stored information using a second computer algorithm.

9. The method according to claim 1 wherein the at least one cost of manufacture parameter comprises a recurring cost.

10. The method according to claim 9 wherein the at least one cost of manufacture parameter comprises a maintenance cost.

11. The method according to claim 9 wherein determining a change for a process control parameter comprises using neural networks.

12. The method according to claim 1 wherein:

the at least one operative sensor comprises at least two operative sensors; and the at least one cost of manufacture parameter comprises at least two cost of manufacture parameters.

13. The method according to claim 12 wherein the at least one cost of manufacture parameter comprises a recurring cost.

14. The method according to claim 13 wherein determining a change for a process control parameter comprises using neural networks.

15. The method according to claim 12 wherein the at least one cost of manufacture parameter comprises a utilization cost.

16. The method according to claim 12 wherein the at least one cost of manufacture parameter comprises a first pass first quality yield.

17. The method according to claim 12 wherein determining a change for a process control parameter comprises using neural networks.

18. The method according to claim 1 wherein:

the at least one operative sensor comprises at least three operative sensors; and the at least one cost of manufacture parameter comprises at least five cost of manufacture parameters.

19. The method according to claim 18 wherein the at least one cost of manufacture parameter comprises a recurring cost.

20. The method according to claim 19 wherein determining a change for a process control parameter comprises using neural networks.

21. The method according to claim 18 wherein the at least one cost of manufacture parameter comprises a utilization cost.

22. The method according to claim 18 wherein determining a change for a process control parameter comprises using neural networks.

23. The method according to claim 18 wherein the at least one cost of manufacture parameter comprises a first pass first quality yield.

24. The method according to claim 1 the method further comprising using a model developed at least in part with stored historical information of the method.

25. The method according to claim 1 the method further comprising using a model developed at least in part with stored historical information of the method including tracked cost of manufacture information.

26. A method for finishing a workpiece having a workpiece surface and having a finishing cycle time in minutes, the method comprising the steps of:

providing an operative control subsystem having an operative sensor, a controller, and a processor;

applying an operative finishing motion to the workpiece surface;

sensing a progress of finishing information with the operative sensor during at least a portion of the finishing cycle time;

determining a change for at least one process control parameter using the processor, a cost of manufacture information, a quantity of historical performance of the method including the quantity of historical tracked information, the workpiece tracking code, a quantity of the workpiece tracked information, and the progress of finishing information with the operative control subsystem during at least the portion of the finishing cycle time; and changing the at least one process control parameter which changes the finishing during at least the portion of the finishing cycle time.

27. The method according to claim 26 comprising the further steps of: storing information related to the cost of manufacture information, the quantity of historical performance of the method including the quantity of historical tracked information, the workpiece tracking code, the quantity of the workpiece tracked information, and the progress of finishing information;

evaluating the stored information using a computer algorithm to determine at least one change for at least one member of information selected from the group consisting of the at least one cost of manufacture parameter, the quantity of historical performance of the method including the quantity of historical tracked information, the workpiece tracking code, the quantity of the workpiece tracked information, and the progress of finishing information; and changing the at least one member of the information forming at least one changed member of information.

28. The method according to claim 27 the method additionally comprising:

using the at least one changed member of information for evaluating a workpiece process control or a workpiece cost; and wherein at least one member selected from the group consisting of storing information, evaluating the stored information, changing the at least one member of information, and using the at least one member of information is performed during at least a portion of time with a at least one processor without an operative connection to the operative control subsystem.

29. The method according to claim 27 the method additionally comprising:

using the at least one changed member of information for evaluating a workpiece process control or a workpiece cost; and wherein at least one member selected from the group consisting of storing information, evaluating the stored information, changing the at least one member of information, and using the at least one member of information is performed during at least a portion of time with a at least one processor with an operative connection to the operative control subsystem.

30. The method according to claim 27 the method additionally comprising:

using the at least one changed member of information for evaluating a workpiece process control or a workpiece cost; and wherein at least one member selected from the group consisting of storing information, evaluating the stored information, changing the at least one member of information, and using the at least one member of information is performed during at least a portion of time of the finishing cycle time.

31. The method according to claim 27 the method additionally comprising:

using the at least one changed member of information for evaluating a workpiece process control or a workpiece cost; and wherein at least one member selected from the group consisting of storing information, evaluating the stored information, changing the at least one member of information, and using the at least one member of information is performed during at least a portion of time outside of the finishing cycle time.

32. The method according to claim 26 the method further comprising using a model developed at least in part with stored historical information of the method.

33. The method according to claim 26 the method further comprising using a model developed at least in part with stored historical information of the method including tracked cost of manufacture information.

34. The method according to claim 33 the method further comprising using predictive control.

35. The method according to claim 33 wherein the workpiece comprises a workpiece which is manufactured in at least 3 separate and distinct manufacturing steps.

36. The method according to claim 33 the method further comprising:

using an apparatus for applying the operative finishing motion and wherein the apparatus for applying the operative finishing motion is connected to a multiplicity of other separate workpiece fabrication machinery, and information derived therefrom in an operative computerized network and the control subsystem is operatively connected to at least a portion of the other separate workpiece fabrication machinery, metrology equipment, and information derived therefrom.

37. A method of finishing a workpiece during a finishing cycle time comprising the steps of:

providing a finishing surface;

providing at least one operative control subsystem having at least one operative sensor, at least one processor, and at least one controller;

applying an operative finishing motion between the workpiece and the finishing surface;

sensing a progress of finishing information with the operative sensor;

sending the progress of the finishing information to the at least one processor;

determining a change for a process control parameter using the at least one processor, a tracking code, at least one cost of manufacture information, a workpiece tracking code, a quantity of the workpiece tracked information of the method, an amount of historical performance of the method including tracked information from at least 3 workpieces, and the progress of finishing information; and changing the process control parameter during the finishing cycle time to change the finishing of the workpiece.

38. The method according to claim 37 comprising the further steps of:

storing information related to the at least one cost of manufacture information, the workpiece tracking code, the quantity of the workpiece tracked information, the amount of historical performance of the method including tracked information from the at least 3 workpieces, and the progress of finishing information;

evaluating the stored information using a computer algorithm to determine at least one change for at least one member of information selected from the group consisting of the at least one cost of manufacture parameter, the workpiece tracking code, the quantity of the workpiece tracked information of the method the amount of historical performance of the method including tracked information of the method from the at least 3 workpieces, and the progress of finishing information; and changing the at least one member of the information forming at least one changed member of information.

39. The method according to claim 28 the method additionally comprising:

using the at least one changed member of information for evaluating a workpiece process control or a workpiece cost; and wherein at least one member selected from the group consisting of storing information, evaluating the stored information, changing the at least one member of information, and using the at least one member of information is performed during at least a portion of time with a at least one processor without an operative connection to the operative control subsystem.

40. The method according to claim 28 the method additionally comprising:

using the at least one changed member of information for evaluating a workpiece process control or a workpiece cost; and wherein at least one member selected from the group consisting of storing information, evaluating the stored information, changing the at least one member of information, and using the at least one member of information is performed during at least a portion of time with a at least one processor with an operative connection to the operative control subsystem.

41. An apparatus for finishing a workpiece having a tracking code, the apparatus comprising:

a workpiece holder;

an operative control subsystem having at least three operative sensors, a controller, and a processor and wherein the processor is operatively connected to a processor readable memory device having a cost of manufacture information including activity based accounting, a model, and the tracking code for the workpiece; and an operative finishing surface for applying an operative finishing motion to the workpiece held by the workpiece holder.

42. An apparatus for finishing according to claim 41 wherein the apparatus for finishing is connected to a multiplicity of other separate workpiece fabrication machinery, and information derived therefrom in an operative computerized, network and the control subsystem is operatively connected to at least a portion of the other separate workpiece fabrication machinery, metrology equipment, and information derived therefrom.

43. The apparatus according to claim 41, wherein the apparatus for finishing is connected to a multiplicity of other separate workpiece fabrication machinery, and information derived therefrom in an operative computerized, network and the operative control subsystem is operatively connected to at least a portion of the other separate workpiece fabrication machinery, metrology equipment, and information derived therefrom and wherein the activity based accounting includes a multiple of different levels of activity costs and a multiple of different cost drivers in each of the multiple of different levels of activity costs.

44. The apparatus according to claim 41 wherein the apparatus for finishing is connected to a multiplicity of other separate workpiece fabrication machinery, and information derived therefrom in an operative computerized network and the operative control subsystem is operatively connected to the other separate workpiece fabrication machinery, metrology equipment, and information derived therefrom for feedforward and feedback control while applying the operative finishing motion to the workpiece and wherein the workpiece holder comprises a semiconductor wafer holder.

45. The apparatus according to claim 41 wherein the apparatus for finishing is connected to a multiplicity of other separate workpiece fabrication machinery, and information derived therefrom in an operative computerized network and operative control subsystem is operatively connected to the other separate workpiece fabrication machinery, metrology equipment, and information derived therefrom for feedforward and feedback control while applying the operative finishing motion to the workpiece.

46. The apparatus of according to claim 45 wherein the at least three operative sensors comprise at least two operative workpiece sensors for sensing progress of finishing and the workpiece holder comprises a workpiece holder for holding a semiconductor wafer having a diameter of at least 300 mm.

47. The apparatus of claim 41 wherein the model comprises a cost model.

48. The apparatus of claim 41 wherein the model comprises a cost of manufacture model.

49. The apparatus of claim 41 wherein the model comprises at least two models including a process model and a cost model.

50. The apparatus of claim 41 wherein the model comprises an activity based cost of sales model which assigns activity costs by customer.

51. The apparatus of claim 41 wherein the model comprises a business model including cost and revenue.

52. The apparatus of claim 41 wherein the processor readable memory device additionally includes tracked information.

53. The apparatus of claim 52 wherein the tracked information comprises tracked cost of manufacture information.

54. The apparatus of claim 41 wherein the model comprises a model developed at least in part with stored historical information of the method including tracked cost of manufacture information.

55. A method of finishing a workpiece during a finishing cycle time comprising the steps of:

providing a finishing surface;

providing at least one operative sensor;

applying an operative finishing motion between the workpiece and the finishing surface for finishing;

sensing a progress of finishing information with the operative sensor, sending the progress of the finishing information to a processor;

determining a change for a process control parameter using the processor, a cost of manufacture information, a workpiece tracking code, a quantity of the workpiece tracked information of the method, an at least one business model including cost and revenue, an amount of historical performance of the method including tracked information from an at least 3 workpieces, and the progress of finishing information; and changing the process control parameter during the finishing cycle time to change the finishing of the workpiece.

56. A method for finishing a workpiece having a workpiece surface and having a finishing cycle time in minutes, the method comprising the steps of:

providing an operative control subsystem having an operative sensor, a controller, and a processor;

applying an operative finishing motion to the workpiece surface;

sensing a progress of finishing information with the operative sensor during at least a portion of the finishing cycle time;

determining a change for at least one process control parameter using the processor, a cost of manufacture information, a workpiece tracking code, a quantity of the workpiece tracked information, and the progress of finishing information with the operative control subsystem during at least the portion of the finishing cycle time; and changing the at least one process control parameter which changes the finishing during at least the portion of the finishing cycle time.

57. The method according to claim 56 comprising the further steps of:

storing information related to the at least one process control parameter comprising the cost of manufacture information, the workpiece tracking code, the quantity of the workpiece tracked information, and the progress of finishing information forming a group of stored information;

evaluating the group of stored information using a computer algorithm to determine at least one change for at least one member of information selected from the group consisting of the cost of manufacture information, the workpiece tracking code, the quantity of the workpiece tracked information, and the progress of finishing information; and changing the at least one member of information forming at least one changed member of information.

58. The method of finishing according to claim 56 the method further comprising:

storing information related to the at least one process control parameter comprising the cost of manufacture information, the workpiece tracking code, the quantity of the workpiece tracked information, and the progress of finishing information forming a group of stored information;

evaluating the group of stored information using a computer algorithm to determine at least one change for at least one member of information selected from the group consisting of the cost of manufacture information, the workpiece tracking code, the quantity of the workpiece tracked information, and the progress of finishing information;

changing the at least one member of information forming at least one changed member of information; and using the at least one changed member of information for evaluating a workpiece process control.

59. The method of finishing according to claim 56 the method further comprising:

storing information related to the at least one process control parameter comprising the cost of manufacture information, the workpiece tracking code, the quantity of the workpiece tracked information, and the progress of finishing information forming a group of stored information:

evaluating the group, of stored information using a computer algorithm to determine at least one change for at least one member of information selected from the group consisting of the cost of manufacture information, the workpiece tracking code, the quantity of the workpiece tracked information, and the progress of finishing information;

changing the at least one member of information forming at least one changed member of information; and using the at least one changed member of information for evaluating a future workpiece process control.

60. The method of finishing according to claim 56 the method further comprising:

storing information related to the at least one process control parameter comprising the cost of manufacture information, the workpiece tracking code, the quantity of the workpiece tracked information, and the progress of finishing information forming a group of stored information;

evaluating the group of stored information using a computer algorithm to determine at least one change for at least one member of information selected from the group consisting of the cost of manufacture information, the workpiece tracking code, the quantity of the workpiece tracked information, and the progress of finishing information;

changing the at least one member of information forming at least one changed member of information; and using the at least one changed member of information for evaluating a workpiece cost.

61. The method of finishing according to claim 56 the method further comprising:

storing information related to the at least one process control parameter comprising the cost of manufacture information, the workpiece tracking code, the quantity of the workpiece tracked information, and the progress of finishing information forming a group of stored information:

evaluating the group of stored information using a computer algorithm to determine at least one change for at least one member of information selected from the group consisting of the cost of manufacture information, the workpiece tracking code, the quantity of the workpiece tracked information, and the progress of finishing information;

changing the at least one member of information forming at least one changed member of information; and using the at least one changed member of information for evaluating a workpiece cost wherein the workpiece cost is selected from the group consisting of a previous workpiece cost, a current workpiece cost, and a future workpiece cost.

62. A method of finishing according to claim 56 wherein the steps of:

sensing the progress of finishing information with the operative sensor during at least a portion of the finishing cycle time;

determining the change for at least one process control parameter using the at least one cost of manufacture parameter, the workpiece tracking code, the quantity of the workpiece tracked information, and the progress of finishing information with the operative control subsystem during at least the portion of the finishing cycle time; and changing the at least one process control parameter which changes the finishing during at least the portion of the finishing cycle time are repeated at least 10 times.

63. The method according to claim 56 wherein the quantity of the workpiece tracked information comprises at least in part cost of manufacture information.

64. The method according to claim 56 the method further comprising using a model.

65. The method according to claim 64 the method further comprising:

using an apparatus for applying the operative finishing motion and wherein the apparatus for applying the operative finishing motion is connected to a multiplicity of other separate workpiece fabrication machinery, and information derived therefrom in an operative computerized network and the control subsystem is operatively connected to at least a portion of the other separate workpiece fabrication machinery, metrology equipment, and information derived therefrom.

66. The method according to claim 64 wherein the model comprises a cost model.

67. The method according to claim 64 wherein the model comprises a cost of manufacture model.

68. The method according to claim 64 wherein the model comprises an activity based cost of sales model which assigns activity costs by customer.

69. The method according to claim 64 wherein the model comprises a business model including cost and revenue.

70. The method according to claim 64 wherein the model comprises a cost of manufacture model using activity accounting.

71. The method according to claim 64 the method further comprising using a model developed at least in part with stored historical information of the method including tracked cost of manufacture information.

72. The method according to claim 71 the method further comprising using predictive control.

73. The method according to claim 72 wherein the workpiece comprises a semiconductor wafer having memory chips.

74. The method according to claim 72 wherein the workpiece comprises a semiconductor wafer having digital signal processing chips.

75. The method according to claim 72 wherein the workpiece comprises a semiconductor wafer having telecommunications chips.

76. The method according to claim 72 wherein the workpiece comprises a semiconductor wafer having microprocessor chips.

77. The method according to claim 64 the workpiece comprises a workpiece which is manufactured in at least 3 separate and distinct manufacturing steps.

78. The method according to claim 64 wherein the workpiece surface comprises the workpiece surface having a heterogeneous surface composition.

79. A method of finishing a semiconductor wafer during a finishing cycle time comprising the steps of:

providing a finishing surface;

providing at least one operative sensor;

applying an operative finishing motion between the semiconductor wafer and the finishing surface;

sensing a progress of finishing information with the operative sensor;

sending the progress of finishing information to a processor, determining a change for a process control parameter using the processor, a tracking code, a cost of manufacture information, and the progress of finishing information; and changing the process control parameter during the finishing cycle time to change the cost of manufacture of the semiconductor wafer.

80. The method according to claim 79 wherein the cost of manufacture information includes activity based accounting.

81. The method according to claim 80 comprising the further steps of:

storing information; and using the stored information for data mining.

82. The method according to claim 81 wherein the stored information comprises tracked cost of manufacture information.

83. The method according to claim 80 comprising the further steps of:

storing information during ramp-up stage of production; and using the stored information to improve a commercial stage process model or cost of manufacture model.

84. The method according to claim 83 wherein the stored information comprises tracked cost of manufacture information.

85. The method according to claim 80 comprising the further steps of:

storing information; and using the stored information to improve a member selected from the group consisting of a process model, a cost of manufacture model, and changes to control parameters.

86. The method according to claim 85 wherein the stored information comprises tracked cost of manufacture information.

87. The method according to claim 80 wherein the method includes predictive control.

88. The method according to claim 80 wherein the method includes adaptive control.

89. The method according to claim 80 wherein the activity based accounting includes a multiple of different levels of activity costs and a multiple of different cost drivers in each of the multiple of different levels of activity costs.

90. The method according to claim 79 wherein the method includes predictive control.

91. The method according to claim 90 wherein the semiconductor wafer has a diameter of at least 300 millimeters.

92. The method according to claim 90 wherein the semiconductor wafer has at least one low k layer and has a diameter of at least 300 millimeters.

93. The method according to claim 79 wherein the method includes adaptive control.

94. The method according to claim 93 wherein the semiconductor wafer has a diameter of at least 300 millimeters.

95. The method according to claim 79 wherein the semiconductor wafer has at least one low k layer and has a diameter of at least 300 millimeters.

* * * * *